US005269246A

United States Patent [19]

Goldbach et al.

[11] Patent Number: 5,269,246

[45] Date of Patent: Dec. 14, 1993

[54] VESSEL HULL CONSTRUCTION AND METHOD

[75] Inventors: Richard A. Goldbach, Norfolk, Va.; Richard Salzer, Sugar Land, Tex.; Frank E. McConnell, Norfolk, Va.

[73] Assignees: Metro Machine Corporation, Norfolk, Va.; Marinex International, Inc., Hoboken, N.J.

[21] Appl. No.: 818,588

[22] Filed: Jan. 9, 1992

Related U.S. Application Data

[63] Continuation-in-part of Ser. No. 678,802, Apr. 1, 1991, Pat. No. 5,090,351.

[51] Int. Cl.[5] ..... B63B 3/02

[52] U.S. Cl. ..... 114/45; 114/5 R

[58] Field of Search ..... 114/45, 46, 47, 48, 114/65 R

[56] References Cited

U.S. PATENT DOCUMENTS

| | | | |
|---|---|---|---|
| 2,576,928 | 12/1951 | Engstrand | 114/45 |
| 3,415,212 | 12/1968 | Hennig | 114/45 |
| 3,610,192 | 10/1971 | Mauritzen | 114/45 |
| 4,104,082 | 8/1978 | Boujard et al. | 114/45 |
| 4,267,789 | 5/1981 | Ivanon et al. | 114/65 R |
| 4,476,797 | 10/1984 | Ivanon et al. | 114/65 R |
| 5,078,071 | 1/1992 | Miura | 114/45 |
| 5,090,351 | 2/1992 | Goldbach et al. | 114/65 R |

OTHER PUBLICATIONS

"Sun Ship's Plans for New Shipbuilding Facilities", memorandum from Robert Galloway, dated Oct. 22, 1973.

Pennsylvania Shipbuilding "Instruction Manual for Drydock No. 4", Hull Technical Department, dated Feb. 1985.

"Vessel Handling Procedure" of Sun Shipbuilding & Dry Dock Co., Chester, Pa., Sun SK No. DD4-783-1--Way, Alt. O.

"General Arrangement & Loading Plan No. 48 Drydock" of Sun Shipbuilding & Dry Dock Co., Chester, Pa., Hull Technical Dept., ref. No.=DR. No. DD4-70-0-121, Alto No. Z dated Sep. 28, 1973.

*Primary Examiner*—David M. Mitchell
*Assistant Examiner*—Stephen P. Avila
*Attorney, Agent, or Firm*—Cushman, Darby & Cushman

[57] ABSTRACT

For fabricating a double-hulled tanker, or a major component of one including at least part of longitudinal midbody, a floating drydock is used which has two independently elevatable-depressible sections. The midbody part is made of individual modules, each of which is fabricated in an upended orientation. The upended modules are successively floated onto a tilting assembly on one drydock section, tilted over and serially added to a growing midbody on the other drydock section. The two drydock sections are pumped out and flooded as the process progresses for shifting the positioning of the growing midbody and modules. Other parts, including a bow and stern are added, to provide a complete vessel.

19 Claims, 61 Drawing Sheets

VESSEL HULL CONSTRUCTION AND METHOD

REFERENCE TO RELATED APPLICATION

This is a continuation-in-part of application No. 07/678,802, filed Apr. 1, 1991, now U.S. Pat. No. 5,090,351.

BACKGROUND OF THE INVENTION

In the co-pending applications of Cuneo et al., No. 07/532,329, filed Jun. 5, 1990, Goldbach et al., No. 07/678,802, filed Apr. 1, 1991, and Goldbach et al., No. 07/713,990, filed Jun. 12, 1991, there are disclosed apparatus and methods for constructing a novel double-hulled product, which as panels, modules and midbodies, are useful in the construction of vessels, in particular, bulk carriers for crude oil and other products.

The present invention relates to improvements in the method and products disclosed in the above-identified, earlier applications, the contents of which are incorporated herein by reference.

In general, the invention relates to providing a double-hulled vessel which, compared with conventional constructions, is made with a reduced number of different pieces, a reduced complexity, which can be fabricated using a higher degree of automation, which, in many applications is more durable and/or needs less maintenance, and need not cost the 20 percent additional that a conventional double hull costs compared with a conventional single hull. In fact, in some instances, a double hull produced in accordance with the invention can successfully compete in price with a conventional single hull for the same duty and carrying capacity.

Compared with the apparatus, methods and products disclosed in the above-mentioned, earlier patent application of Cuneo et al., the above-mentioned earlier applications of Goldbach et al., teaches a modified method for constructing and coating the painted subassemblies, for assembling the painted subassemblies into modules of the hull,, for launching the modules into the water on their sides, for outfitting the modules while in the water by installing fabricated piping and auxiliary structure through the open end of each module, for retrieving each outfitted module from the water while simultaneously turning each module into its final upright position and for joining each module to a respective adjacent module.

As a result of a 1970's convention entered into by the major maritime shipping nations (the "MARPOL Convention"), bulk petroleum carrier ships must have separate tanks for ballast and cargo oil. Ships thereupon necessarily became larger in overall size for carrying the same amount of cargo. Fewer bulk petroleum carrier ships were built to this requirement than had been built to serve the same market within a comparable prior period. Also, new and aggressively expanding factors in the bulk cargo vessel field sought to capture market share by cutting out what they deemed excess weight in the construction of hulls for such vessels. Part of the reduction was accomplished by using high tensile strength steel, but some was accomplished by reducing the safety margin in the thickness, spacing and redundancy of constructional elements conventionally provided to accommodate loss of strength due to corrosion occurring during the expected life of the vessel. At the same time, carrying only ballast in certain tanks of the vessel, due to requirements of the MARPOL Convention, caused accelerated corrosion. The need for better coatings was not recognized soon enough; therefore, it is now believed that many bulk cargo-carrying ships built within the last 15 years will have unpredictably short useful lives.

A conventional double-hull tanker lets ballast be carried between hulls. Such a ship does not need to be any larger, overall, than a conventional single-hull, segregated-ballast tanker.

It is believed that in the period from 1990 to 2010, the number of tankers requiring replacement or remidbodying, assuming modest expansion of world fleet requirements, an average vessel life of 25 years, and an average vessel size of 85,000 DWT, is about 180 to 200 tankers per year.

SUMMARY OF THE INVENTION

An improved curved-plate, double-hull tanker construction is provided, having reduced or eliminated transverse reinforcing structure in its midbody, except for bulkheads. The hull, though double, can compare in weight to conventional single hulls, despite being entirely made of mild steel plate. It is made of significantly fewer pieces, with a reduction in welding footage. More of the steel is used in the form of plate, rather than more expensive shapes. Improved productivity is possible, resulting from standardization of parts, less scrap, greater use of jigs and fixtures, automated welding, blast-cleaning and painting, so that not so much staging is needed, the work environment can be safer, and the product can be produced at a lower unit labor cost. Preferably, cathodic epoxy painting is used for durability and reduction in problems due to blast cleaning, solvent evaporation and generation of refuse. Extending the double-hull structure from the bottom and sides of the hull to the main deck can provide space for fuel oil to be located safely away from the skin of the ship, rather than in possibly vulnerable deep tanks at the stern. The constructional technique is believed to be applicable to vessel hulls in the 70,000 DWT to 300,000 DWT range. The vessel hull midbody module subassemblies may be assembled into modules, hull midbodies and vessels using the method and apparatus disclosed in the applications of Cuneo et al., No. 07/532,329, filed Jun. 5, 1990, Goldbach et al., No. 07/678,802, filed Apr. 1, 1991, and Goldbach et al., No. 07/713,990, filed Jun. 12, 1991. However, the prior methods for turning the modules from an upended to an upright condition, for assembling the modules to one another and for connecting major components to provide a tanker are improved by use of a set of two floating drydock sections, one of which has a tiltable platform-bearing trunnion assembly.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
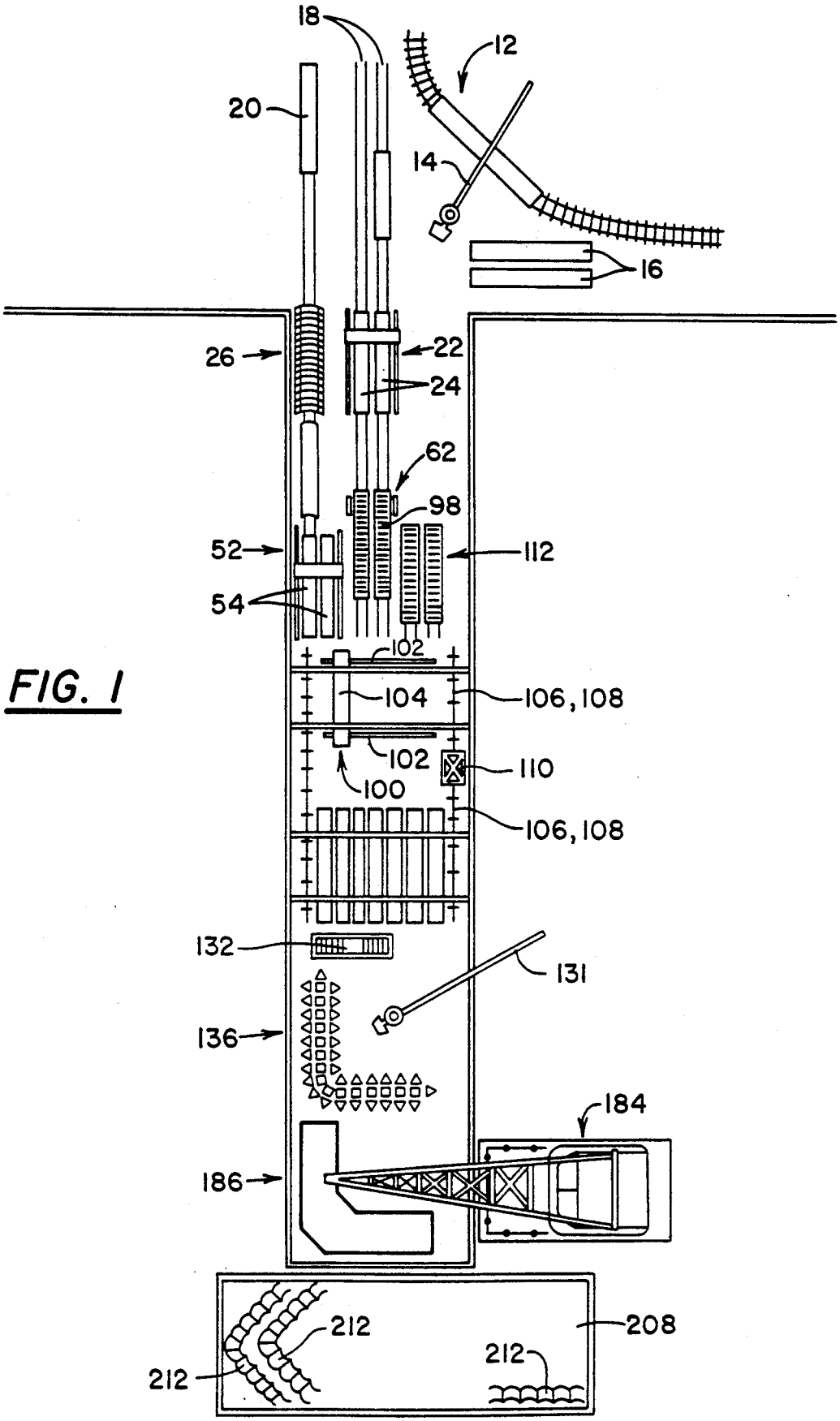
FIG. 1 is a fragmentary schematic top plan view of a facility for fabricating steel plate into subassemblies of modules for double-hull, bulk-carrier (e.g., VLCC) vessel hull midbodies, according to principles of the present invention.

Referring first to FIG. 1, a facility for transforming steel sheets into subassemblies for modules for double-hulled longitudinal midbodies of bulk cargo carriers is shown at 10.

Figure 2:
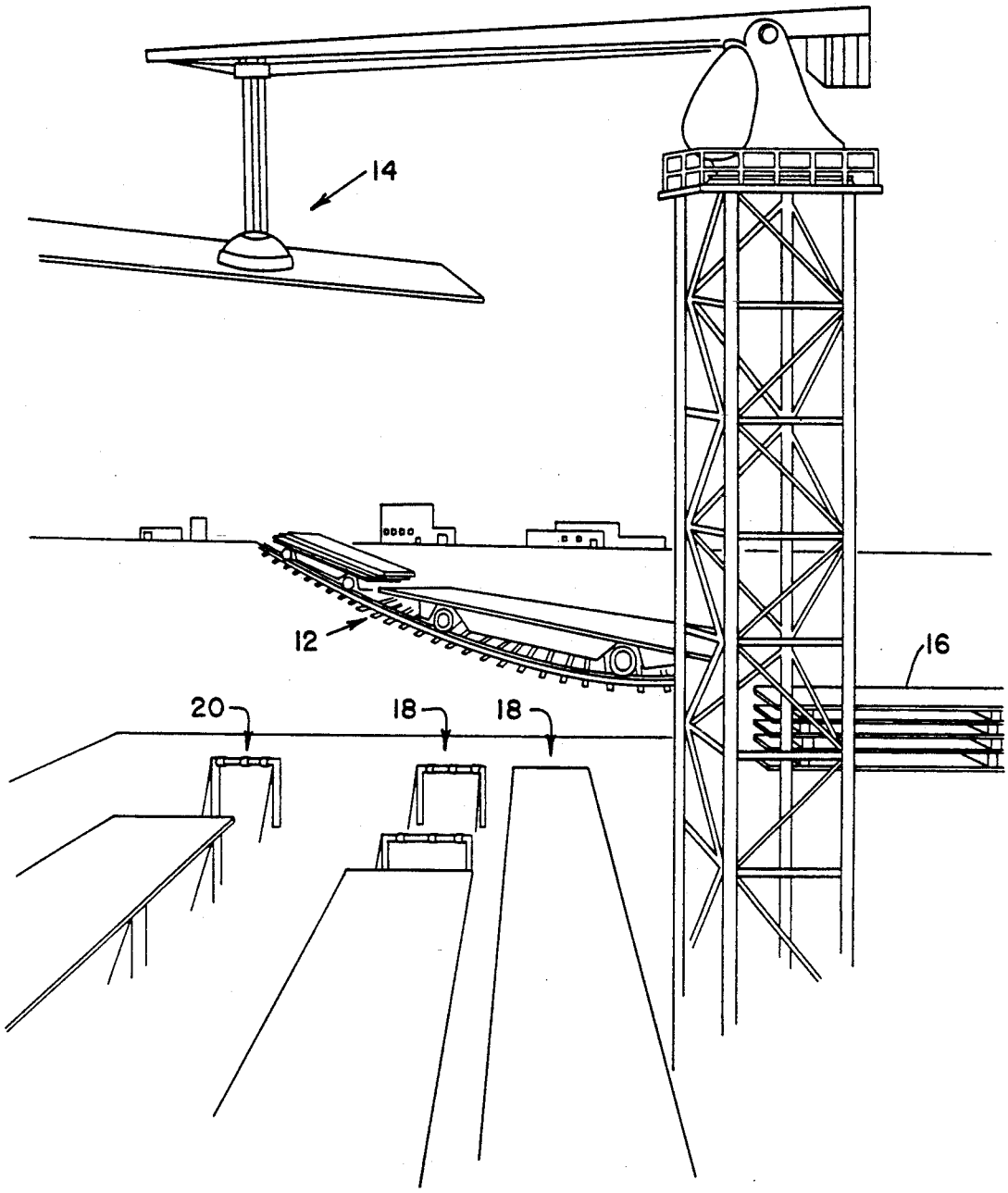
FIG. 2 is a fragmentary pictorial perspective view of a station on the line shown in FIG. 1, for offloading incoming steel plate from rail cars onto the line, or into storage.

Raw steel plate, typically 0.5 to 1.25 inch thick and approximately 8 feet wide and 50 feet long, procured from a steel mill, is received by rail car 12 (FIGS. 1 and 2), lifted off by an electromagnet-type grasping device-equipped crane 14 and placed either in storage 16, on one of two conveyor lines 18 feeding flat panel fabrication, on a rail car with an installed conveyor called a collocator car (not shown), or on a conveyor line 20 feeding curved panel fabrication.

Figure 3:
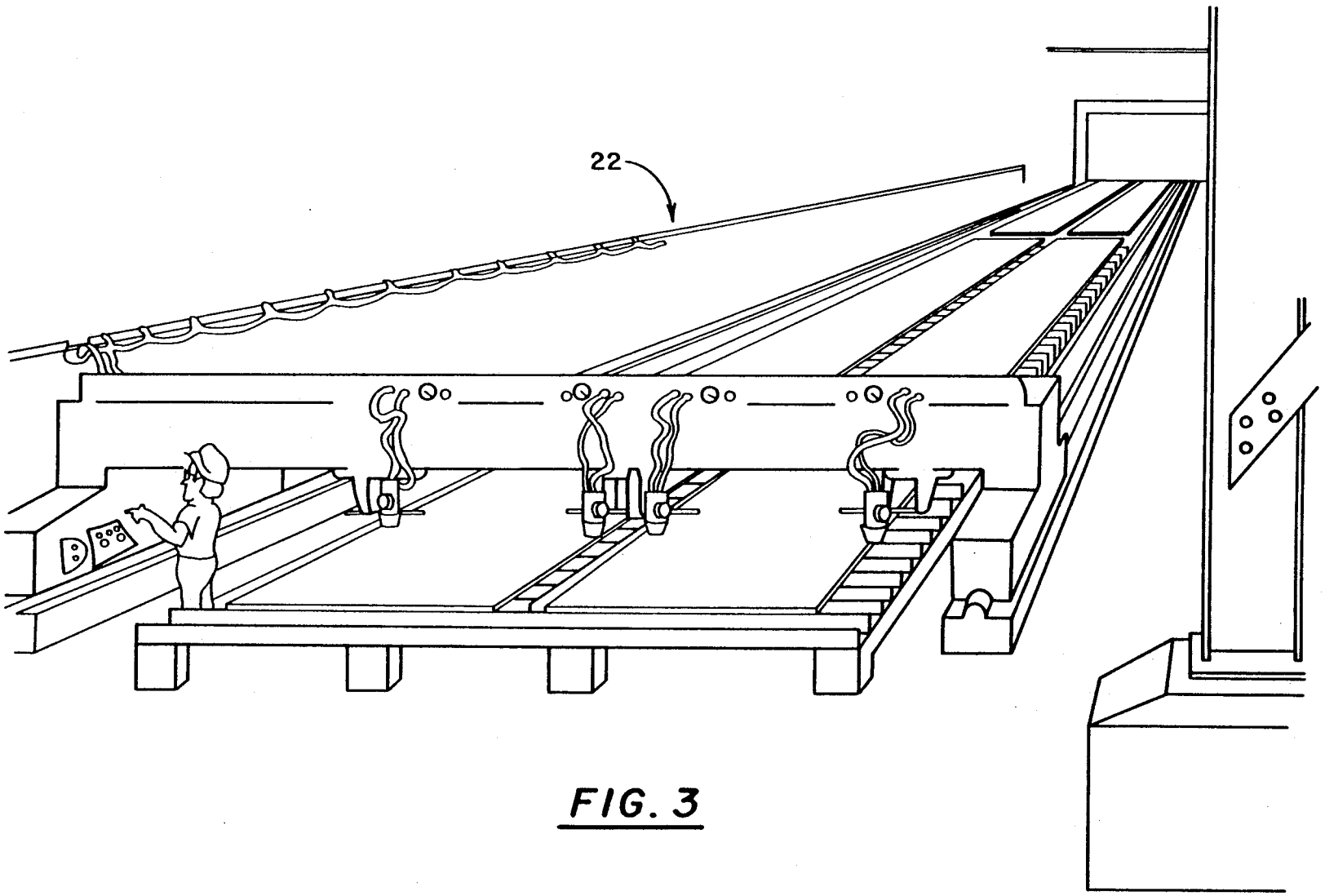
FIG. 3 is a fragmentary pictorial perspective view of apparatus on the line for flame cutting the steel plate into pieces of required configuration for use in fabricating the double-hull module subassemblies.

Raw steel plate destined for stiffened flat panels is conveyed on the lines 18 to an automatic burning machine 22 (FIGS. 1, 3 and 4) where it is cut to final configuration, including any lightening holes (not shown, but see the Cuneo et al. application) to provide flat steel plates 24.

Figure 4:
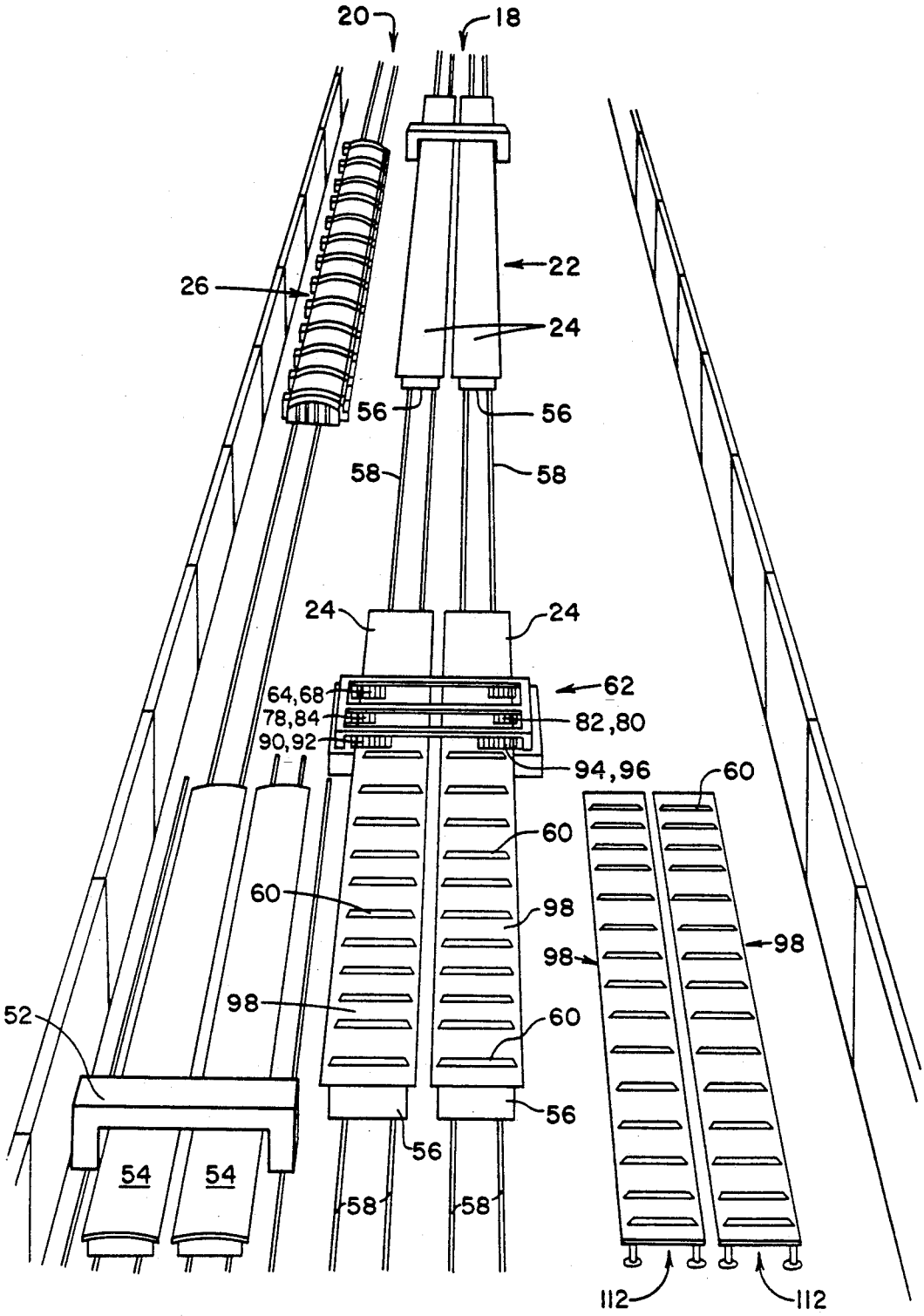
FIG. 4 is a fragmentary pictorial perspective view of apparatus on the line for fabricating the cut plate into curved (at the left) and stiffened flat (at the center and right) panels that will later be assembled with one another to create the module subassemblies.
Figure 5:
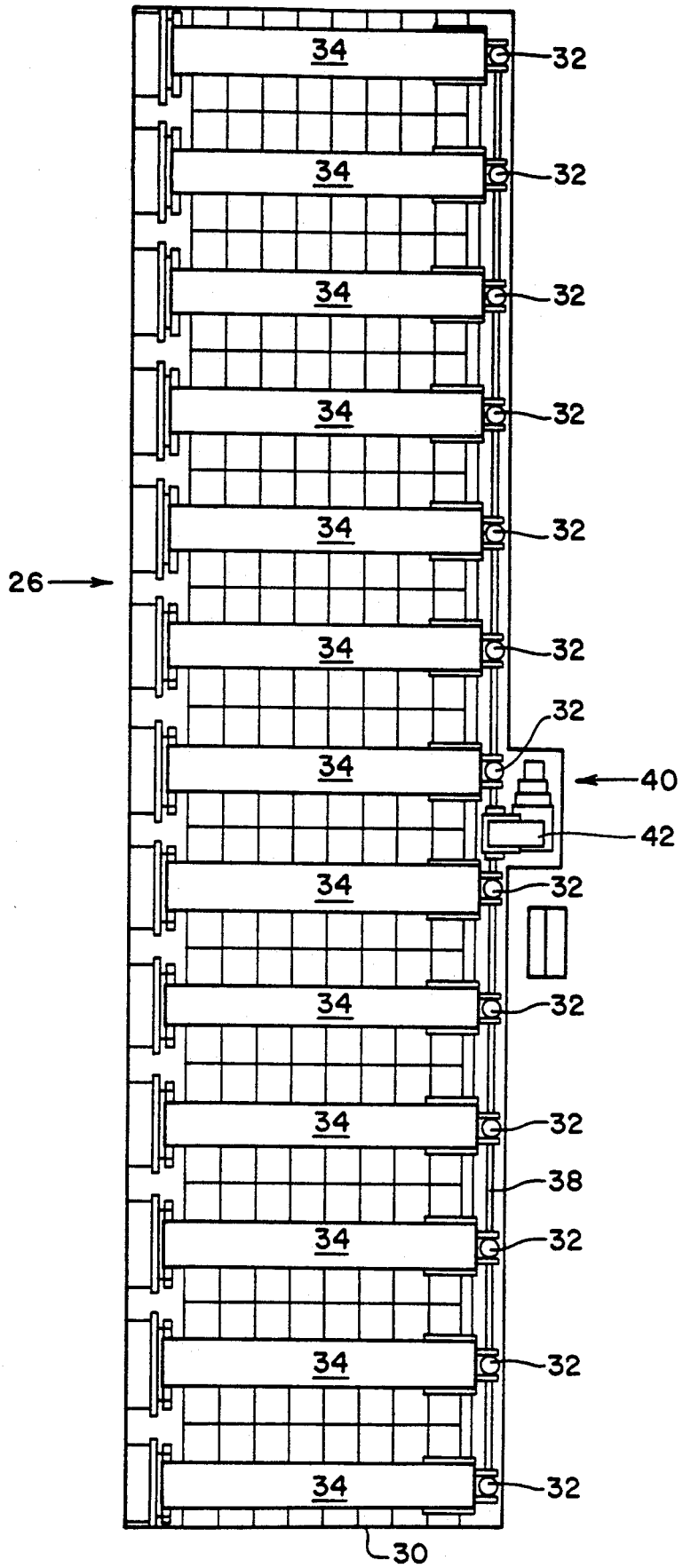
FIG. 5 is a schematic top plan view of a press assembly for producing the curved plates.
Figures 6, 7:
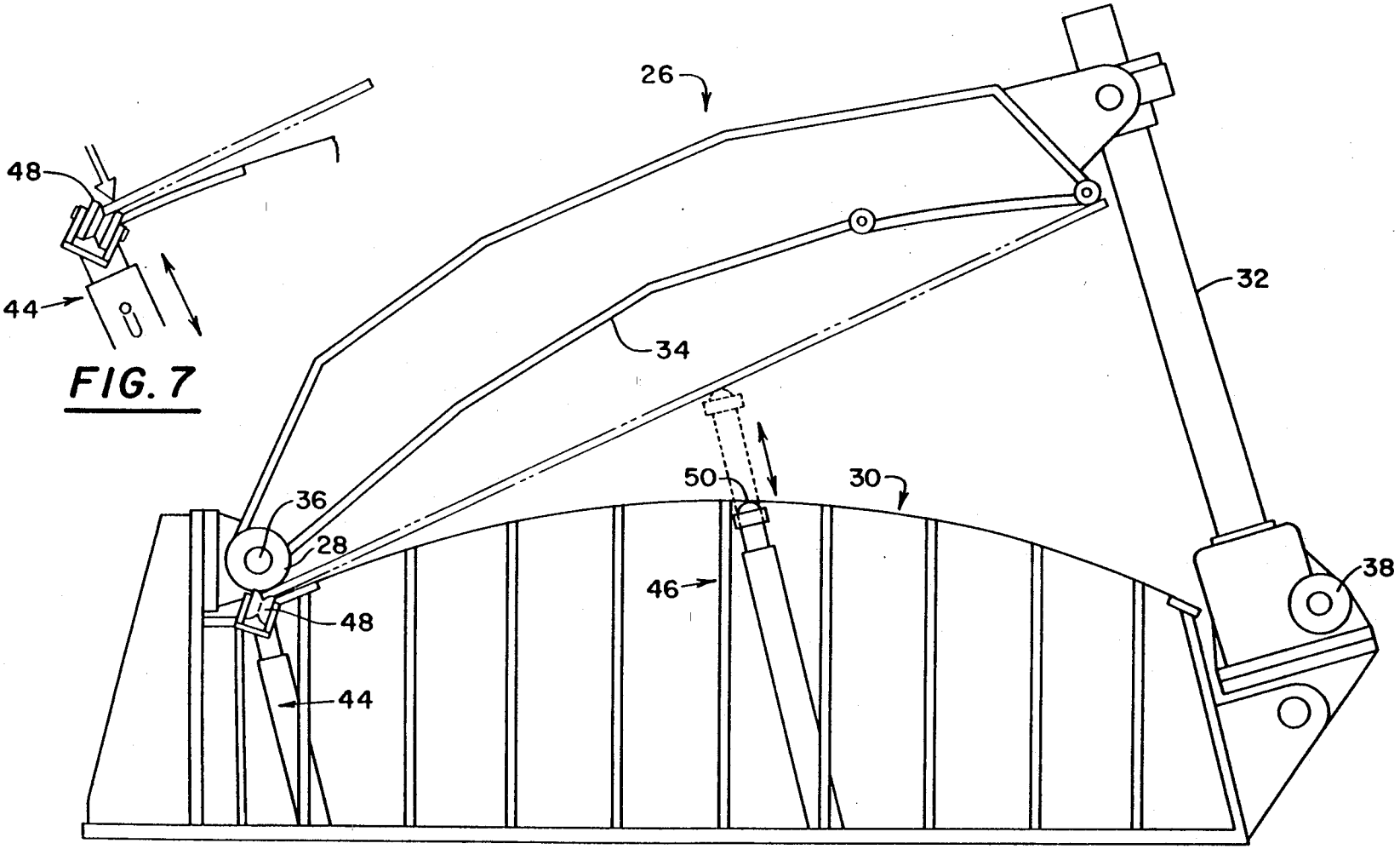
FIG. 6 is an end view of the press assembly of FIG. 5, showing the assembly about to be closed on a piece of plate stock for press-forming a curved panel therefrom.
FIG. 7 is an enlarged scale end view of a portion of the press assembly of FIG. 6, showing a retractable means for conveying an edge of the plate stock at the hinge side of the press assembly.
Figure 8:
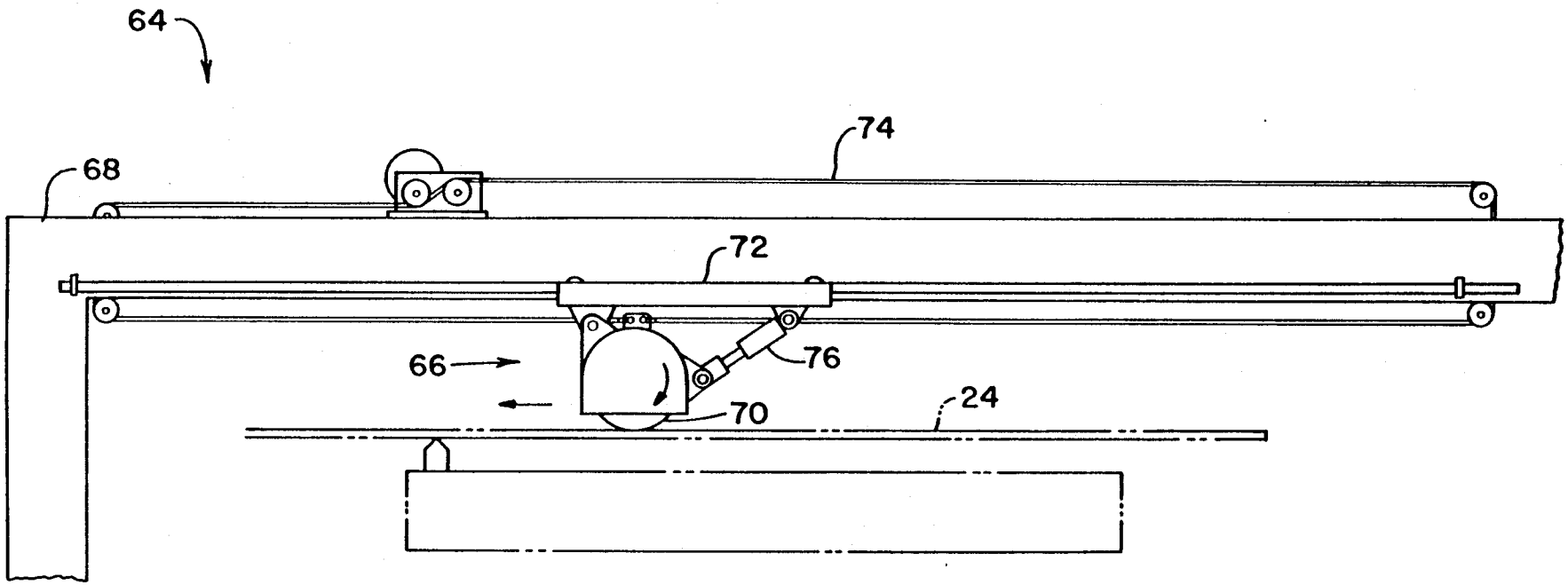
FIG. 8 is a front elevation view of a station for surface preparation of flat panel by grinding a succession of clean stripes on a surface so that respective stiffeners can be placed thereon and welded thereto.
Figure 9:
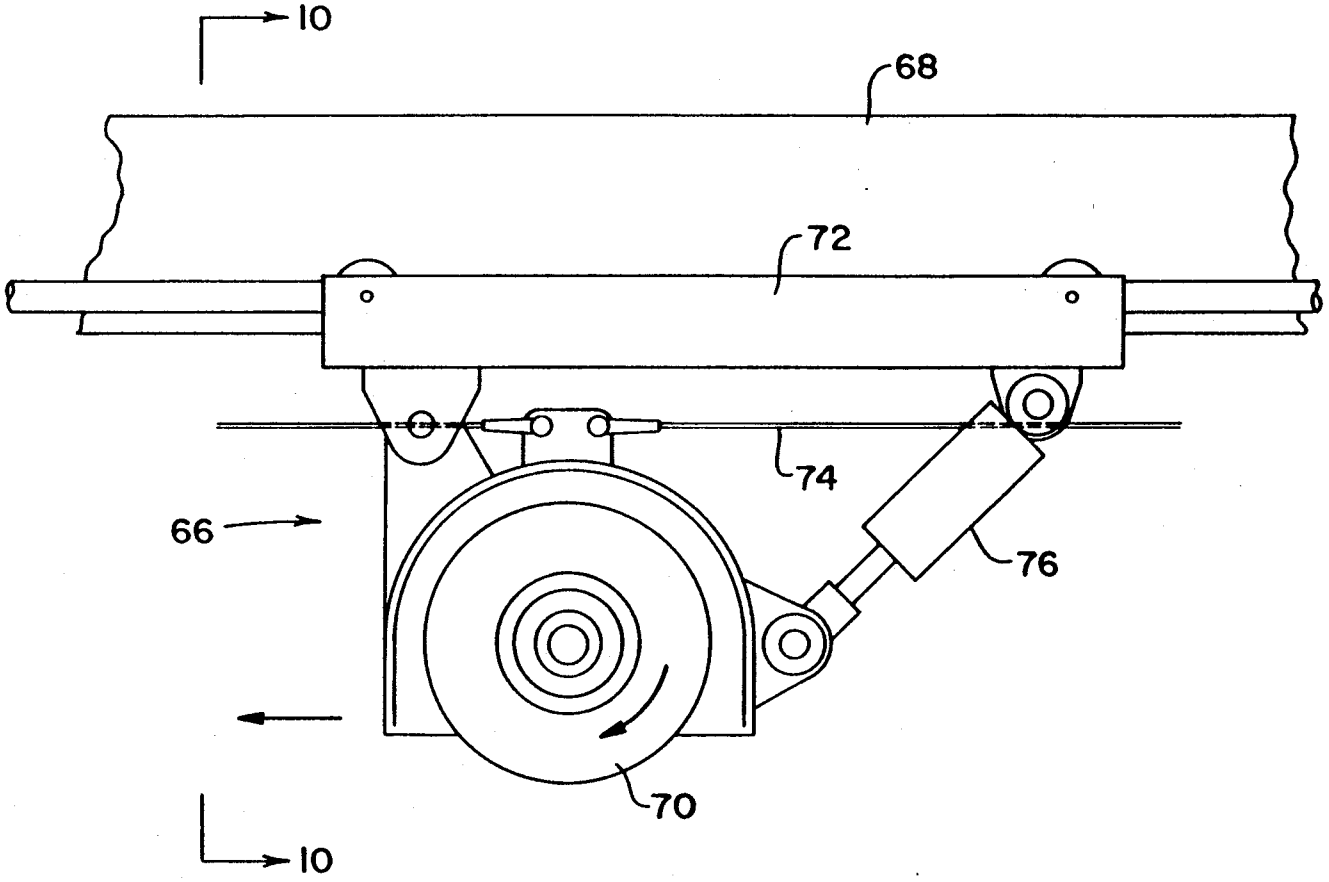
FIG. 9 is a larger scale fragmentary elevation view of the surface preparation station shown in FIG. 8.
Figure 10:
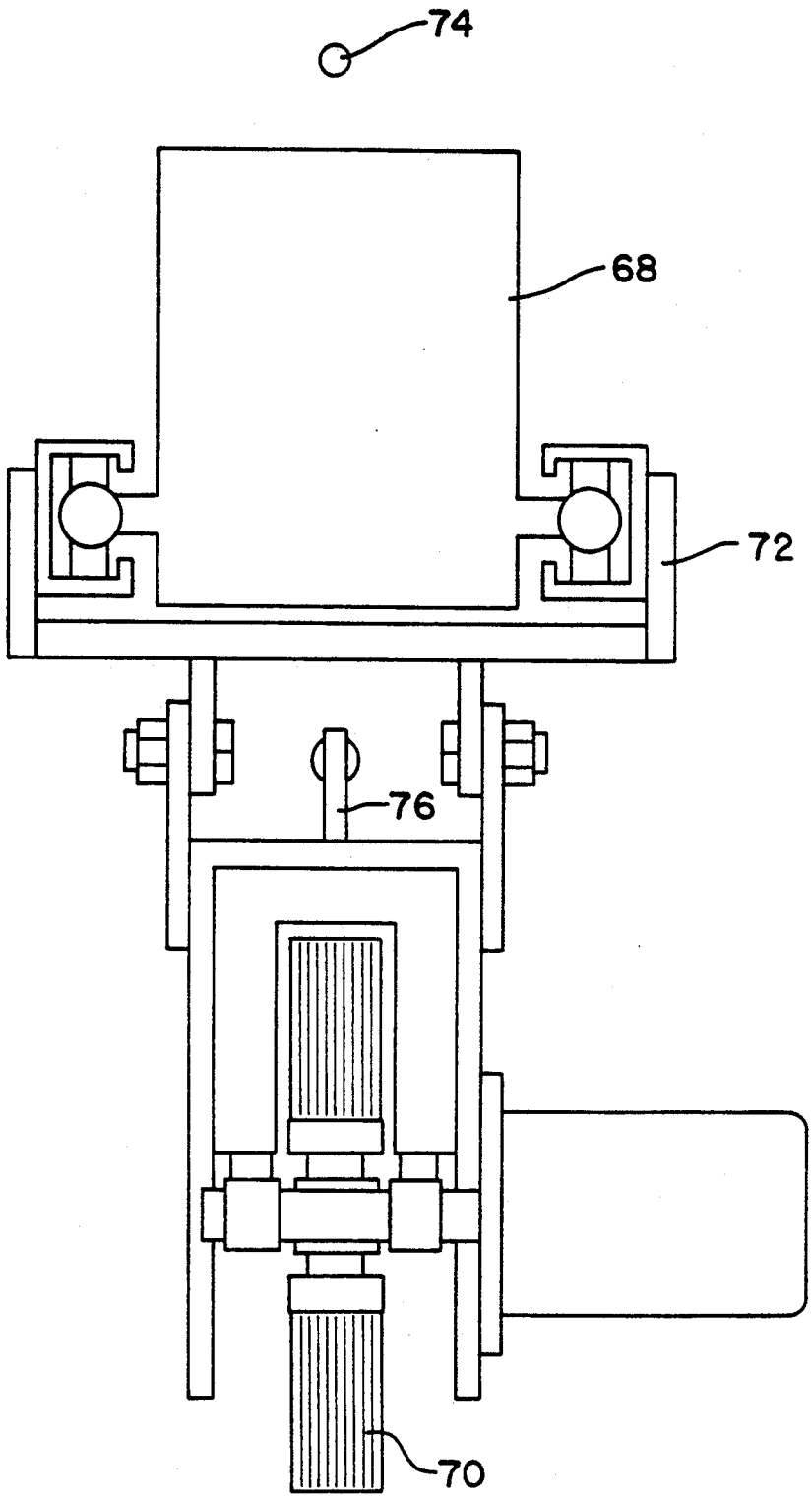
FIG. 10 is a fragmentary cross-sectional view on line 10—10 of FIG. 9.

Raw steel plate destined for curved panels is conveyed on the line 20 to the plate forming machine 26 (FIGS. 1 and 4–6), preferred details of which are shown in FIGS. 5–7, to produce curved steel plates.

The plate forming machine 26 puts a constant radius curve in a succession of steel plates each approximately 8 feet wide and 50 feet long by holding one longitudinal edge of a raw steel plate in a holder 28 and bending the plate along its transverse axis over an upwardly convex stationary die 30 using a series of hydraulically operated screw jacks 32 attached to a series of downwardly concave forming presses 34. The screw jacks 32 of the preferably forming presses 34, hinged at 36 to the stationary base at an edge of the stationary die 30 are operated simultaneously by a common shaft 38 driven by a hydraulic power plant 40 through a reduction gear 42. The fixed side of the plate is held by a series of cams 28 built into the forming presses. The stationary die 30 is fabricated of steel in an "egg crate" type weldment, so that upper edges of its elements cooperate to define the die. Retractable plate conveying devices 44, 46 are built into the plate bending machine. The devices 44, 46, respectively, have v-grooved and convex rimmed rollers 48, 50 at their plate edge and plate underscale engaging upper ends.

The resulting curved but still not sized steel plates are then conveyed on the line 20 to a flame planer 52 (FIGS. 1 and 4), similar to automatic burning machine 22 for flat stiffened panels, where they are cut into precise final configuration to provide curved steel plates 54.

Each collocator car 56, comprises a rail car with a roller conveyor on its deck, receives a respective fabricated flat steel plate approximately 8 feet wide and 50 feet long from the automatic burning machine 22 and locates the steel plate in a precise position on the car.

The flat steel plates 24 are transported by respective collocator cars 56 on rails 58 which continue the flat panel lines 18 (FIG. 4) where kickplate stiffeners 60 are installed at precise intervals (typically of approximately 32 inches) in a three-stage stiffener installation mechanism 62 (FIGS. 1 and 4). In order to facilitate this, each collocator car 56, on which a respective flat steel plate 24 is resting, advances by indexing forwards at the same precise intervals using an appropriate gear mechanism.

The first stage, 64 (FIGS. 1, 4 and 8–10), of this stiffener installation mechanism utilizes a grinding machine 66 to remove an approximate 2-inch wide path of mill scale in the way of where each stiffener 60 will be installed. The grinding machine 66 comprises a fixed gantry 68 containing one or more power-rotated grinding wheels 70 mounted on a carriage 72 running transverse to the line of travel of the collocator cars 56, which remove a path of mill scale approximately 2 inches wide in successive precise increments of approximately thirty-two inches as each collocator car 56 is indexed from position to position beneath it. The grinding wheel carriage 72 is electrically driven through a belt or chain mechanism 74 across the gantry. A pneumatic cylinder 76 holds the grinding wheel 70 to the plate with proper force.

The second stage, 78, of the stiffener installation mechanism, receives stiffeners from a kickplate stiffener collator 80, precisely fits and holds each stiffener 60 in its turn to a respective location, which has previously been cleaned of mill scale at 64, and tack welds each stiffener, using a tack welder 82, to the flat plate 24. The second stage 78 includes a fixed gantry 84, located a precise distance of approximately thirty-two inches after the grinder gantry 68, running transverse to the lines of travel of the collocator cars and having for each line a guide 86 into which a succession of identical kickplate steel flat-bar stiffeners 60 is inserted one by one as the collocator cars are indexed from position to position beneath the fixed gantry 84. The fixed gantry 84 is equipped with a mechanical, hydraulic or pneumatic mechanism to lower guides and compress each successive stiffener 60 onto the respective flat plate 24, to enable the stiffener 60 to be tack-welded to the plate using gantry-mounted tack welders 82, and then to raise the guides to permit the collocator cars 56 to index to the next position.

Each kickplate stiffener collator/inserter 80 is a device onto which a bundle of approximately eighteen identical kickplate stiffeners each approximately seven feet long, six inches deep and one-half inch thick is loaded as each fifty-foot long flat plate is processed. Individual kickplates 60 are oriented transverse to the line of flow of the respective collocator car and stacked side by side in the direction of the line of flow of the respective collocator car. The lead kickplate 60 is positioned alongside the opening to the respective guide of the kickplate positioning gantry 84 and inserted into the guide by use of a mechanical, electrical, pneumatic or hydraulic plunger as the respective collocator car 56 and flat plate 24 are indexed into position. Each remaining stack of kickplates 60 is indexed in the same direction as the line of travel of the respective collocator car. Each time each collocator car 56 is indexed thirty-two inches forward, the respective remaining stack of kickplates is indexed one-half inch using mechanical electrical, hydraulic or pneumatic plungers calibrated mechanically or electronically to the movement of the respective collocator car. Thus, as each flat plate 24 is indexed into the kickplate installation position, a kickplate 60 is always available to be inserted.

Each collocator 80 is structured and functions similar to a transverse feeder on the head end of a magazine of a photographic slide projector.

The third stage 90 of the stiffener installation mechanism final-welds each stiffener 60 in its turn. Alternately, the second and third stages may be combined, with tack welding being eliminated. In the preferred construction, the third stage comprises a fixed gantry 92 containing for each line a carriage-mounted double fillet, flux-core welding machine 94 or substitute located a precise distance of approximately thirty-two inches after the kickplate installation gantry 78 and oriented transverse to the line of flow of the collocator car. The double fillet welding heads of the welding machine 96 are each equipped with a known seam tracker and appropriate positioning slides to compensate for slightly out-of-flatness of the respective plate 24 or minor misalignment of the kickplate stiffeners 60. The welding machines 96 perform finish welding of individual kickplate stiffeners 60 as the flat plates 24 with fitted kickplates 60 are indexed beneath it on the collocator cars 56, thereby providing stiffened flat panels 98.

Figure 11:
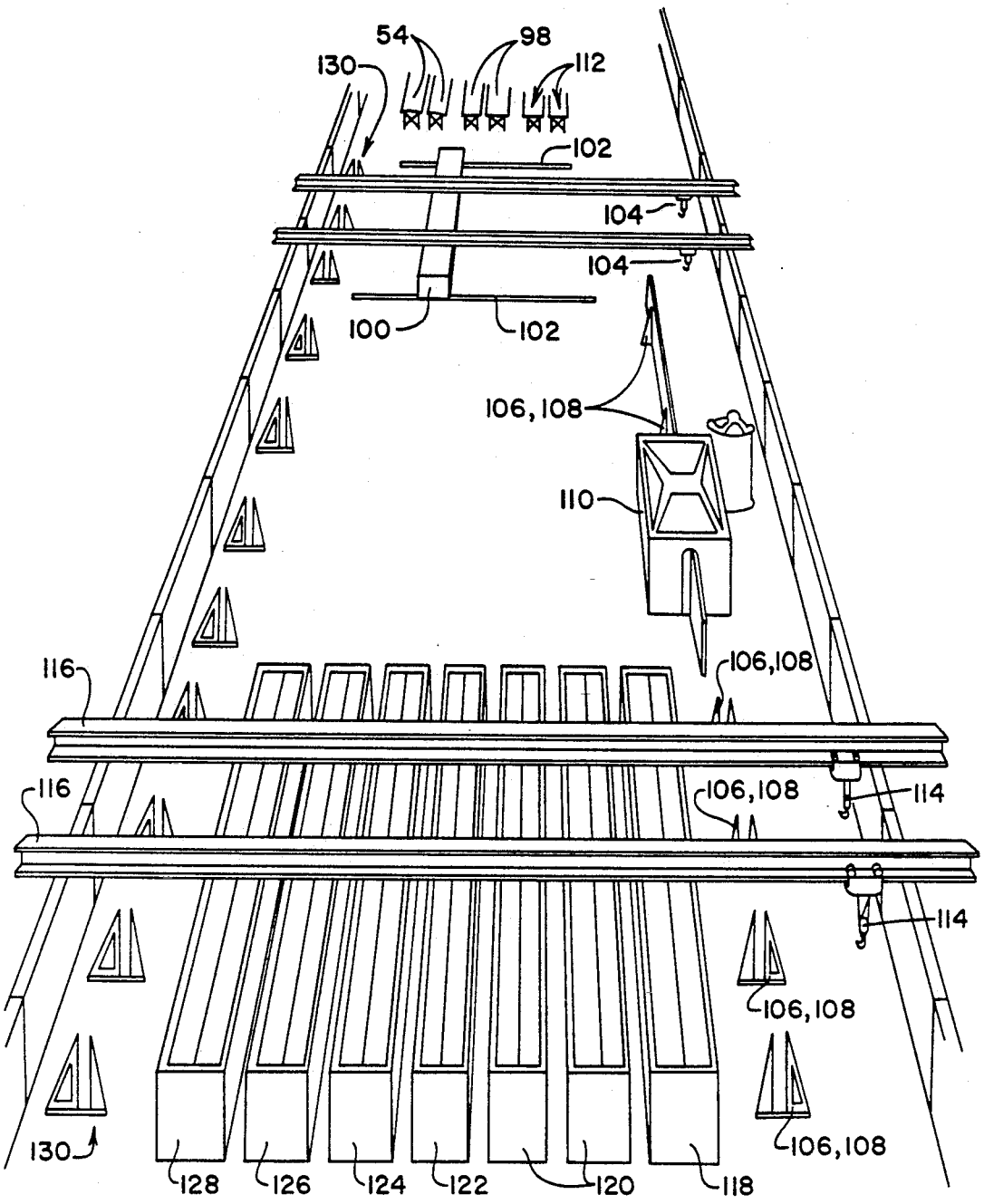
FIG. 11 is a fragmentary pictorial perspective view showing a repair station on the line, for stiffened panels, and a station for surface preparation and coating of both curved and stiffened flat panels.

Fabricated curved panels 54 and stiffened flat panels 98 are then conveyed to a transporter car 100, which travels laterally on tracks 102, and then are lifted by hoists 104 from their horizontal positions to a vertical orientation and places it on a chain drive conveyor 106, so that each rests on one of its long edges. The chain drive conveyor 106 transports panels, through guides 108, into and out of a steel-shot abrasive cabinet 110 (FIGS. 1 and 11) for removal of mill scale, weld slag, weld splatter and other foreign matter.

In the shot-blast cabinet 110, recyclable steel abrasive shot or grit (not shown) is propelled automatically against all surfaces of curved and stiffened flat steel panels 54, 98 being transported through the cabinet by the chain drive conveyor 106 through guides 108 leading into and out of the cabinet. This removes all mill scale, weld slag, weld splatter and other foreign matter from the panels 54, 98.

Fabricated flat panels requiring rework are conveyed by the transporter car 100 to repair stations 112 (FIGS. 1 and 4) and, upon completion of repairs, are transferred to the abrasive cabinet 110, for surface preparation as described above.

After being shot blasted, curved panels and stiffened flat panels are lifted off the exit conveyor guides 108 (FIGS. 1 and 11) of the abrasive cabinet 110 using plate clamps 114 hung from the twin monorails 116 running transversely, and are immersed in a rinse tank 118 containing deionized water.

The plate clamps on the twin monorails 116 transport the shot-blasted panels 54, 98 laterally through the five or more positions of the coating process of which the rinse tank 118 is the first.

The rinse tank 118 contains deionized water and is large enough to accommodate one or more of the panels 54, 98 in a vertical position on one of its respective long edges during its rinse, after abrasive cleaning in the shot blast cabinet 110. A wash and pretreatment process is conducted in the rinse tank 118, plus sufficient tanks 120 for two or more subsequent chemical wash and pretreatment stages.

After chemical wash and pretreatment, the next position of the coating line is a cathodic coating tank 122 containing a paint and water solution and large enough to accommodate one or more of the panels for receiving an initial coating, still in a vertical position. The tanks are provided with fenders (not shown) to protect the coating.

The first coating tank preferably contains epoxy paint in water solution, and in it, each panel is cathodically coated, the coating process commercially available from PPG Coatings called Power Cron 640 conductive epoxy primer being presently preferred.

The next position is a curing position 124 with infrared or other surface heaters (not shown) large enough to accommodate one or more of the panels after its initial coating in a vertical position, with fenders (not shown) to protect the coating.

At this curing position 124, the first coating on the curved and flat panels is cured in the infrared-heating cabinet at approximately 350° F.

The next position is a second cathodic coating tank 126 similar to the one at the second position.

After curing at the first curing position 124, the curved and flat panels are immersed in the second coating tank 126 for a second cathodic coat of preferably the same type of epoxy paint, thereafter are removed to a second infrared heating cabinet 128 at a fifth position, for curing, and then stored vertically on their long sides in a storage rack 130 for inspection, with suitable fendering being provided to protect the coating.

The coated panels are then inspected. Inspection criteria include handling damage to the coating, adhesion of the coating to the steel panel, thickness of the coating (normally 2.9 to 3.5 thousandths of an inch (nils.), and curing (hardening).

Curved and stiffened flat panels with unacceptable coatings are conveyed back to the transporter car 100 for reprocessing through the entire surface preparation and coating processes.

Figure 12:
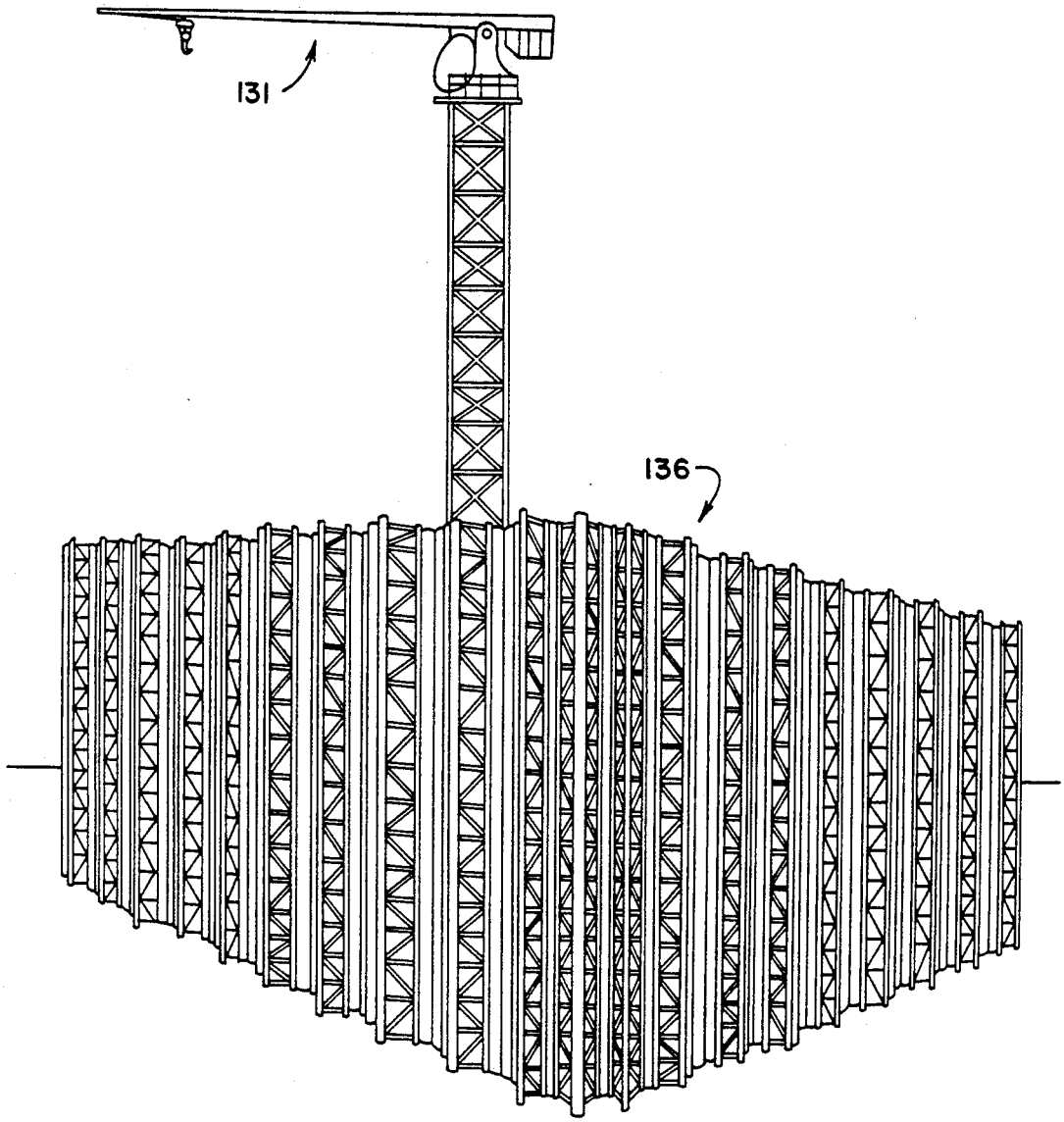
FIG. 12 is a fragmentary pictorial perspective view showing a fixture (shown empty) for receiving the coated curved and stiffened flat panels which are to be joined at respective edges to form a subassembly for a module of a double-hull midbody for a bulk cargo vessel.
Figure 13:
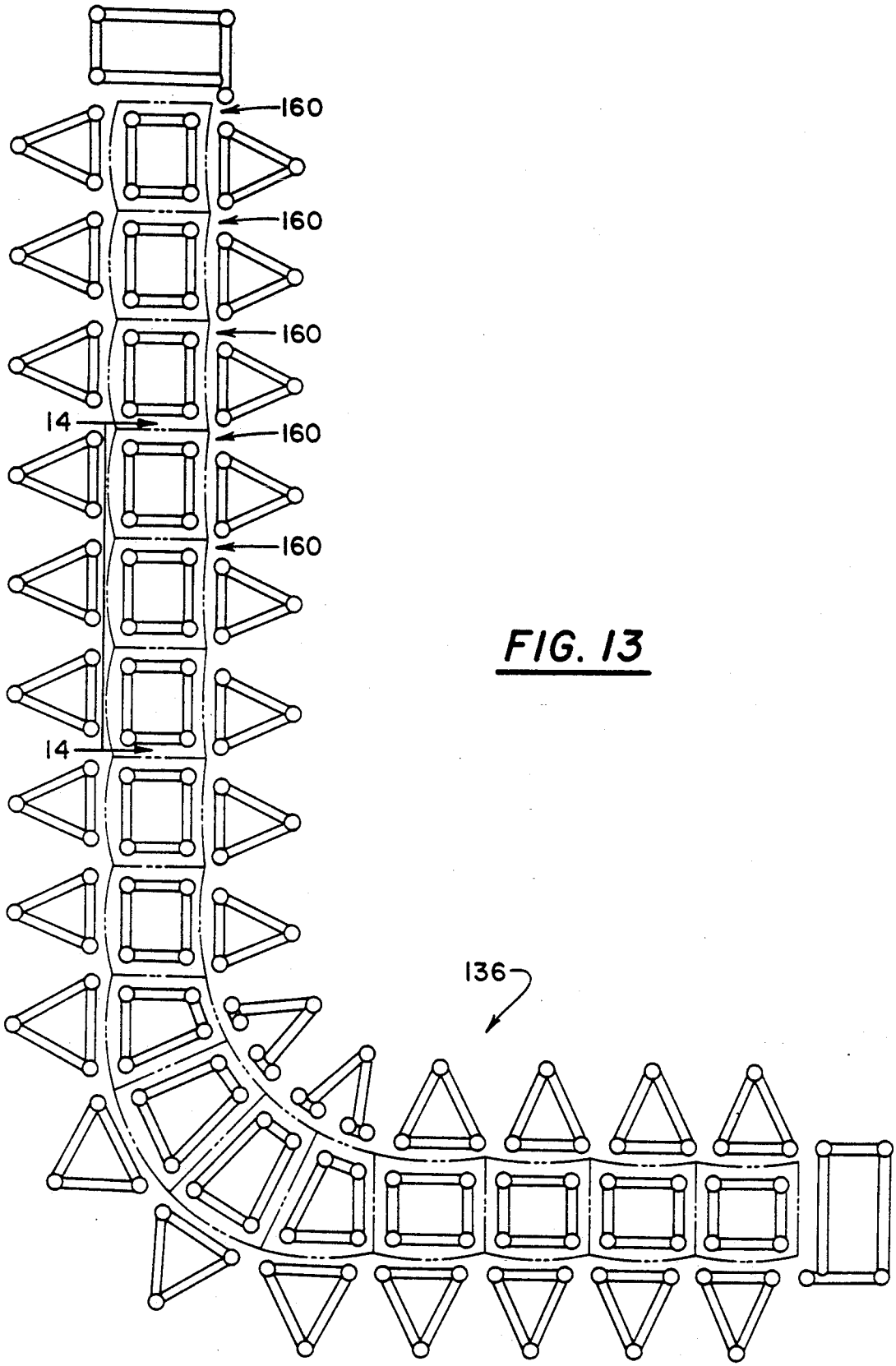
FIG. 13 is a diagrammatic top plan view of the fixture of FIG. 12.
Figure 14:
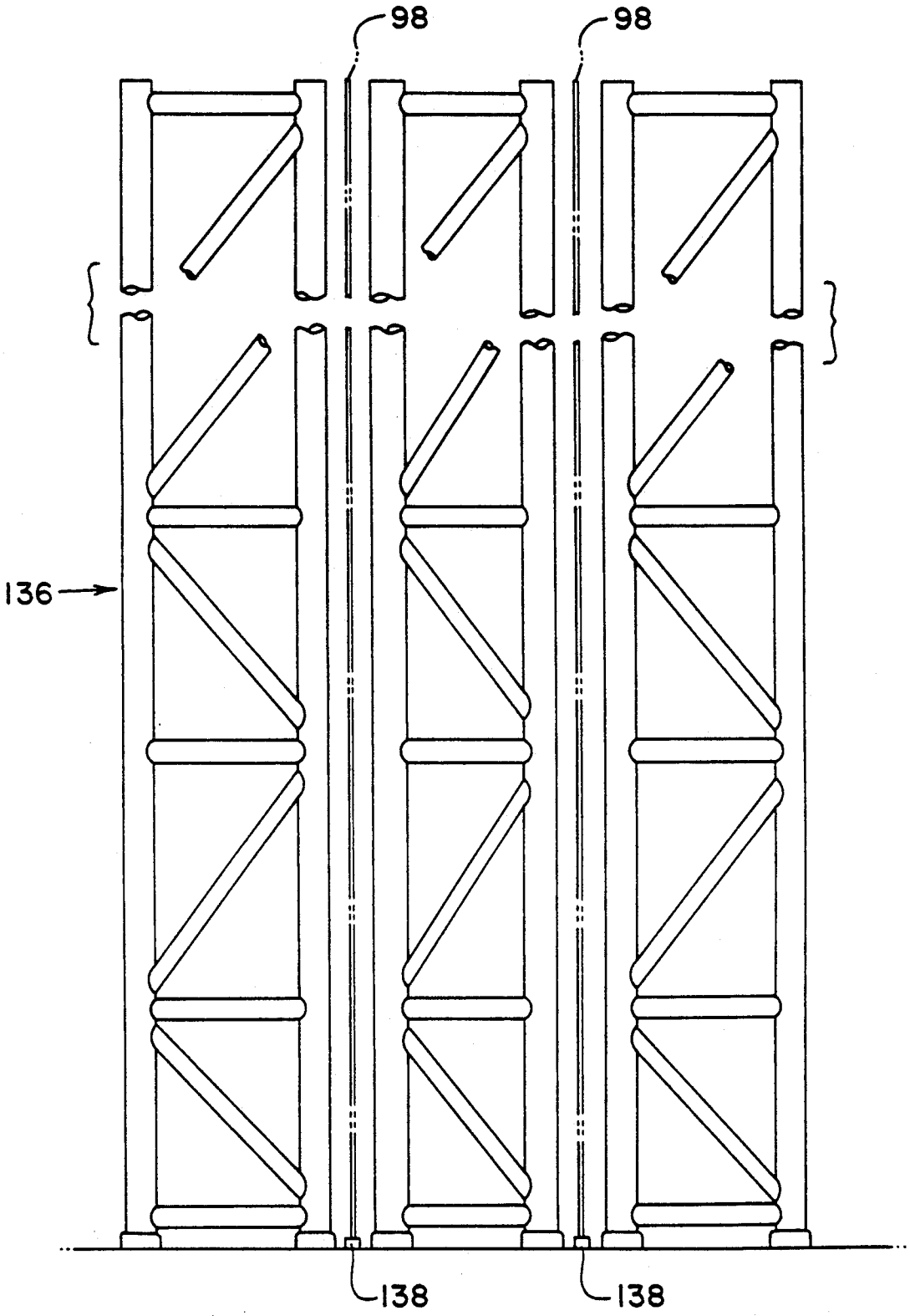
FIG. 14 is a fragmentary vertical longitudinal sectional view on line 14—14 of FIG. 13, showing two flat panels lowered into place in the fixture of FIG. 12.
Figure 15:
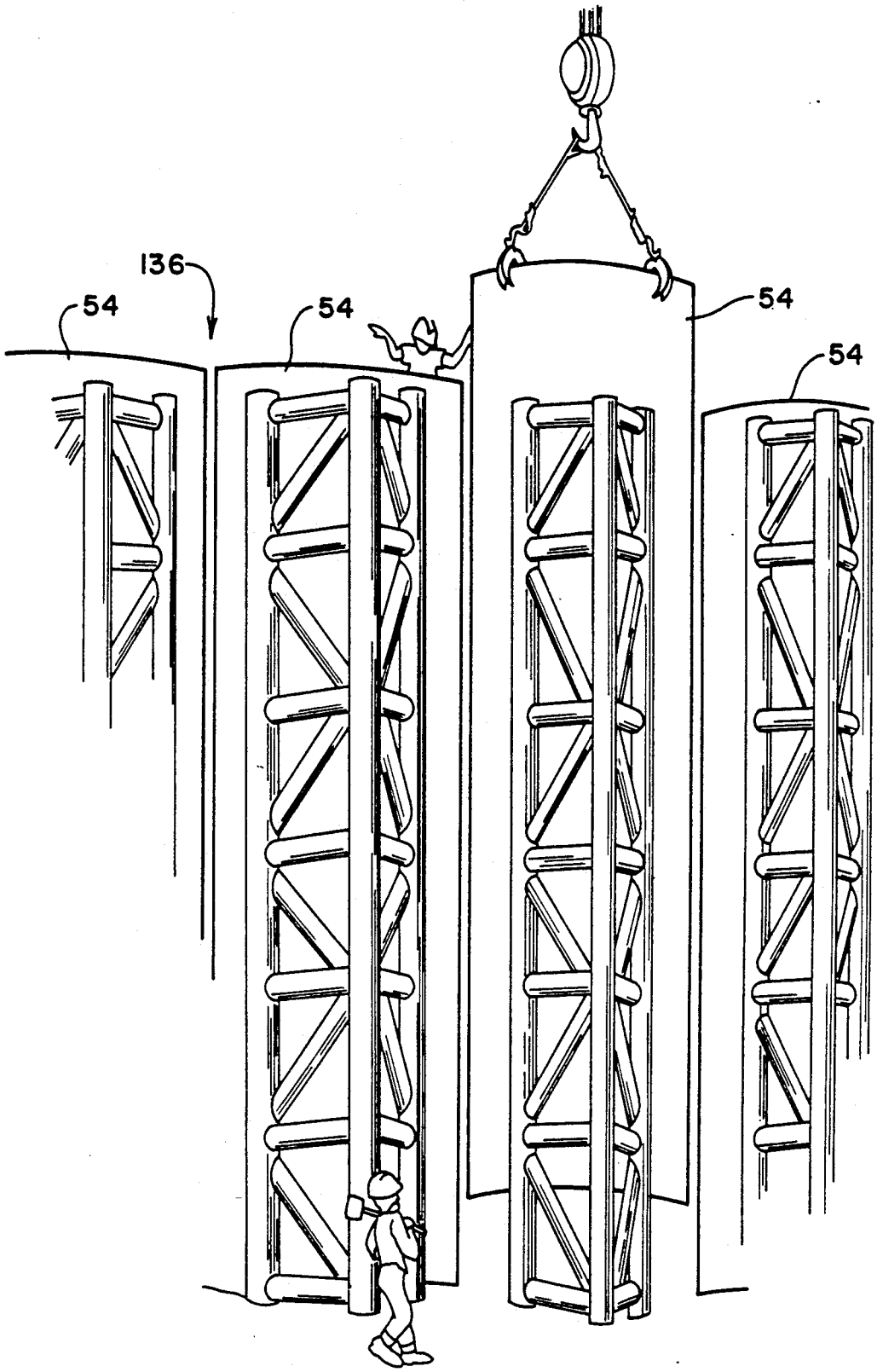
FIG. 15 is a fragmentary pictorial perspective view showing one coated, curved plate being lowered into place in the fixture of FIG. 12.

Curved and stiffened flat panels with acceptable coatings are lifted by a crane 131 (FIGS. 1 and 12), still in a vertical position on their respective end edges and placed either in buffer storage 132 or directly in the subassembly fixture 136 (as shown in FIG. 15).

In the buffer storage 132 or fixture 136, the bottom edges of the curved and flat panels being stored or loaded into the fixture are aligned by landing them in guides 138.

The guides 138 provided at the bottom of the fixture 136 are used for precisely positioning the bottom edges of the curved and stiffened flat panels as they are lowered by crane into the fixture 136, without using temporary attachments.

Figure 17:
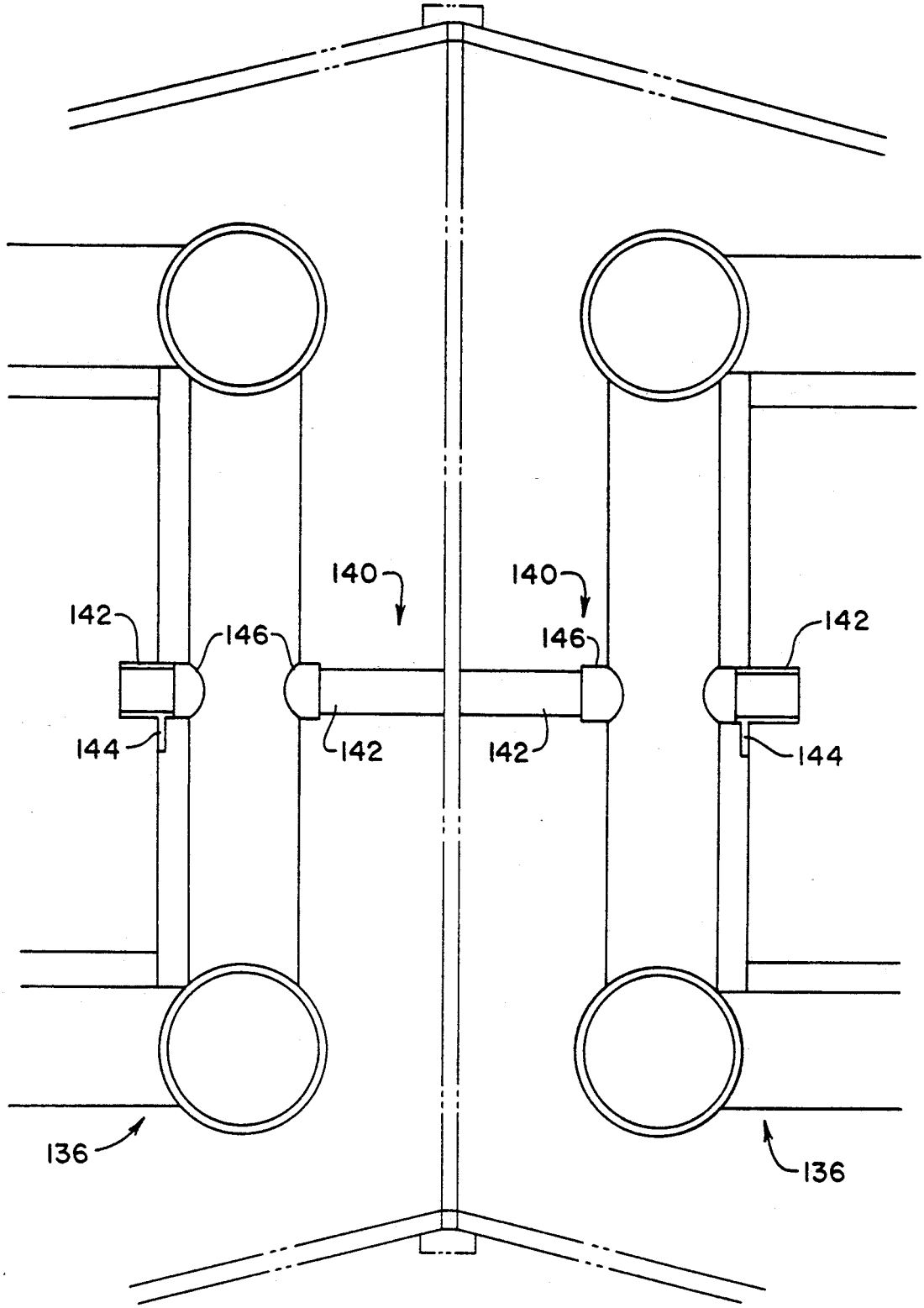
FIG. 17 is a even larger scale fragmentary top plan view of part of the structure shown in FIG. 16.
Figure 18:
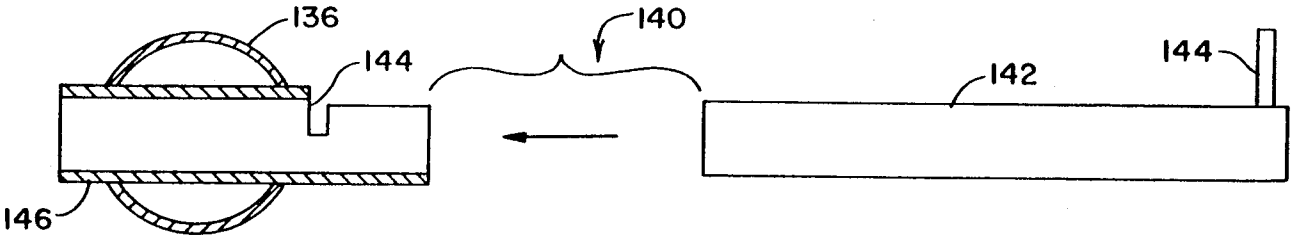
FIG. 18 is a horizontal transverse sectional view of one leg element of one tower of the fixture of FIG. 12, showing the stationary tube of one manual activating mechanism for a flat panel, and, in elevation, the extensible, latchable member of that manual activating mechanism.

In the fixture 136, buckling of the stiffened flat panels is prevented by manually activating mechanisms 140 (FIGS. 17 and 18).

Each device 140, a plunger 142, which manually telescopes into and locks at 144 in a fixture leg tube 146, holds a flat stiffened panel in position, to keep the panels from buckling without using temporary attachments.

Figure 19:
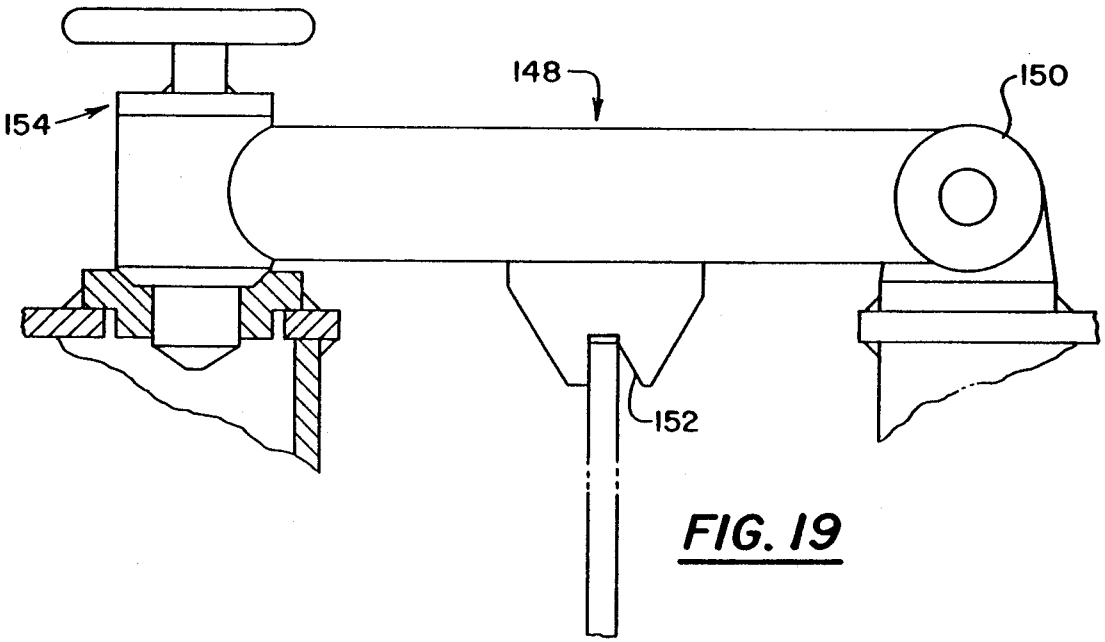
FIG. 19 is a fragmentary elevational view, partly in section, one of the manually activating devices used for aligning top edges of respective ones of the curved and flat panels in the fixture of FIG. 12.

The top edges of the curved and flat panels are aligned by manually activating devices 148 (FIG. 19).

The devices 148, hinged to one fixture leg at 150, notched at 152 to receive a plate edge and clamped to another fixture leg at 154 precisely position the tops of the curved and flat, stiffened panels, without using temporary attachments.

Figure 20:
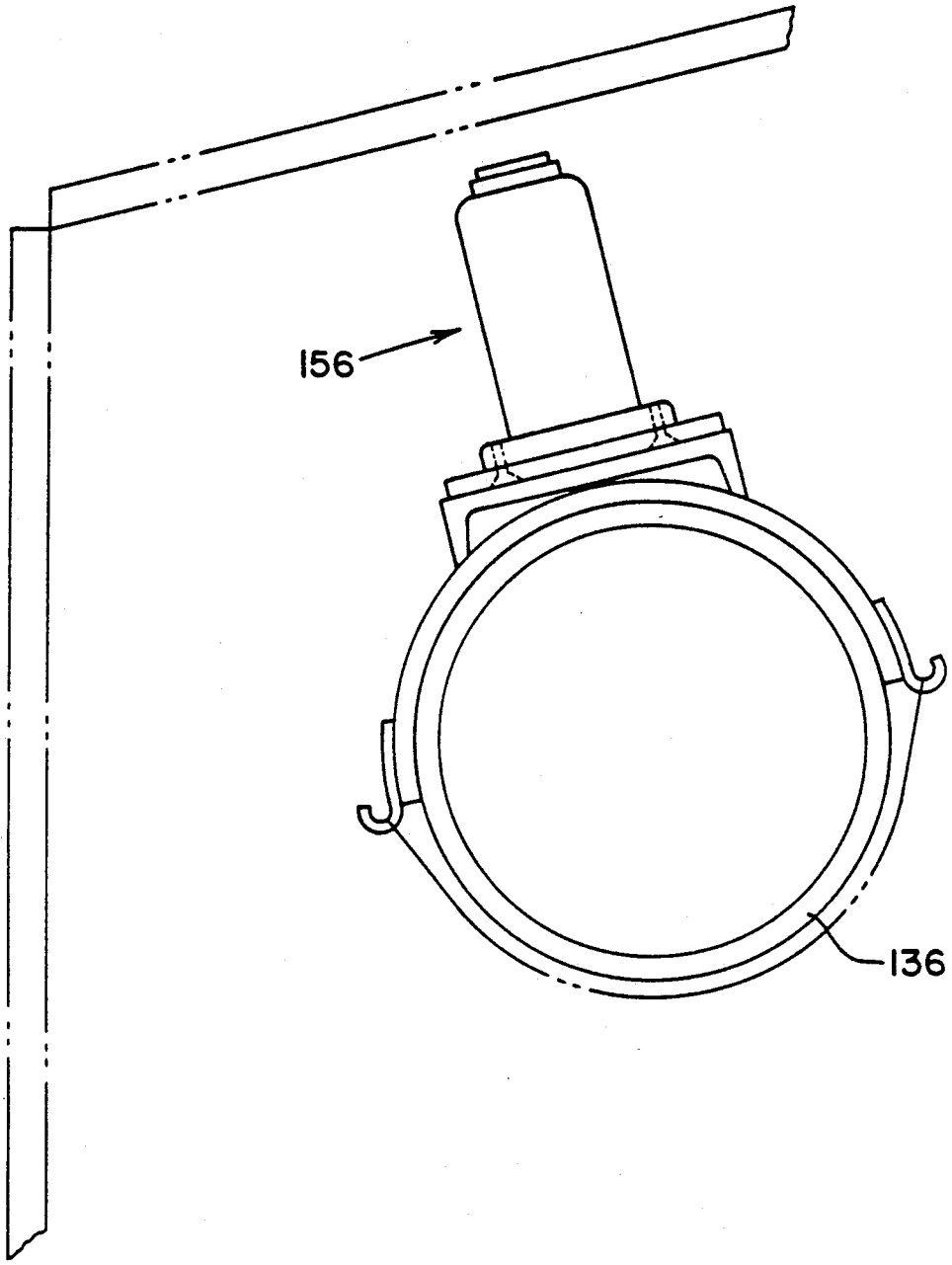
FIG. 20 is a fragmentary top plan view of one of the activating mechanisms used for removing local unfairness of respective ones of the curved and flat panels disposed in the fixture of FIG. 12.
Figure 21:
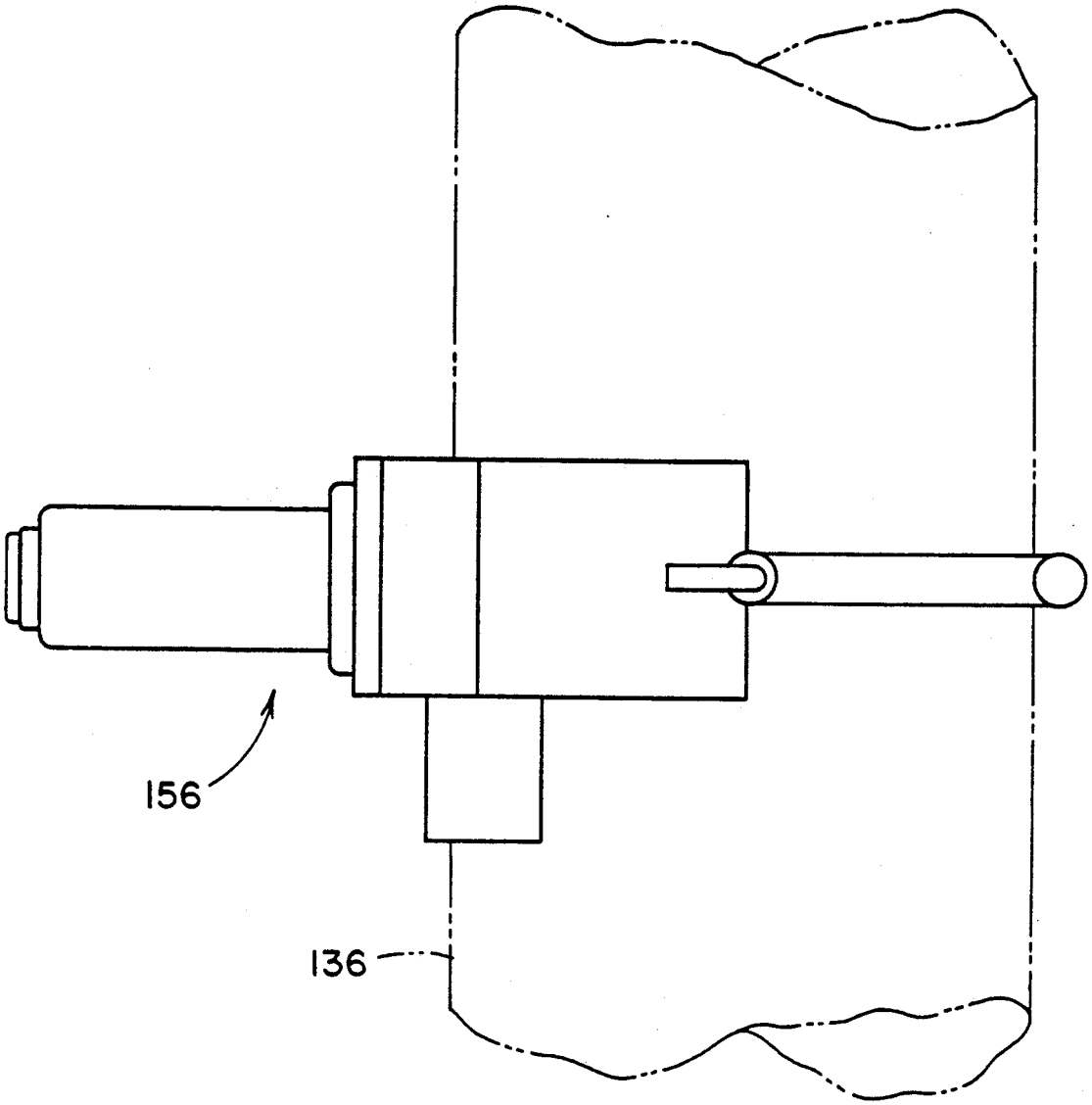
FIG. 21 is a fragmentary side elevation view of the activating mechanism of FIG. 20.

Local random unfairnesses throughout the height of curved and flat panels disposed in the fixture 136 are removed by activating mechanisms 156 (FIGS. 20 and 21).

The devices 156 apply external pressure at intermediate positions on either face of respective curved or flat plate panels to bring unfair edge portions of those plates into precise welding position, without using temporary attachments. Devices 156 are hydraulically operated and are portable, and can be moved around the fixture 136 and secured to legs or leg braces, as needed, and hydraulically activated to forcefully engage and thus fair the panels as required.

Figure 22:
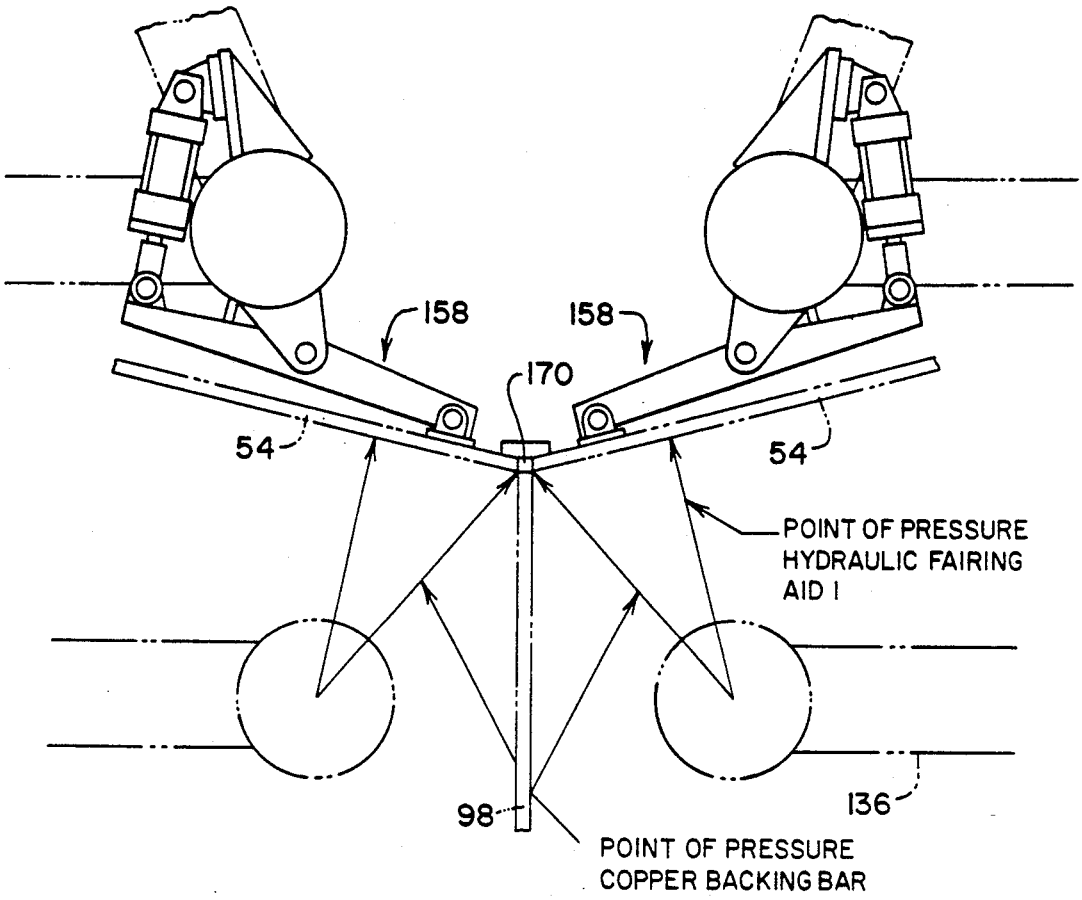
FIG. 22 is a top plan view showing how two curved panels and one flat panel are supported in the fixture of FIG. 12 where a three-edge T-joint will be welded, in particular showing where pressure is applied by respective fairing aids of FIGS. 20 and 21, and respective copper backing bars of FIGS. 23-28.

The hydraulically operated devices 158 (FIG. 22) are operated to apply external pressure at intermediate positions along edges of the curved plate panels to positively position the edges against the continuous copper backing bars (to be described). Devices 158 are hydraulically operated and are fixed to legs of the fixture 136.

Figure 16:
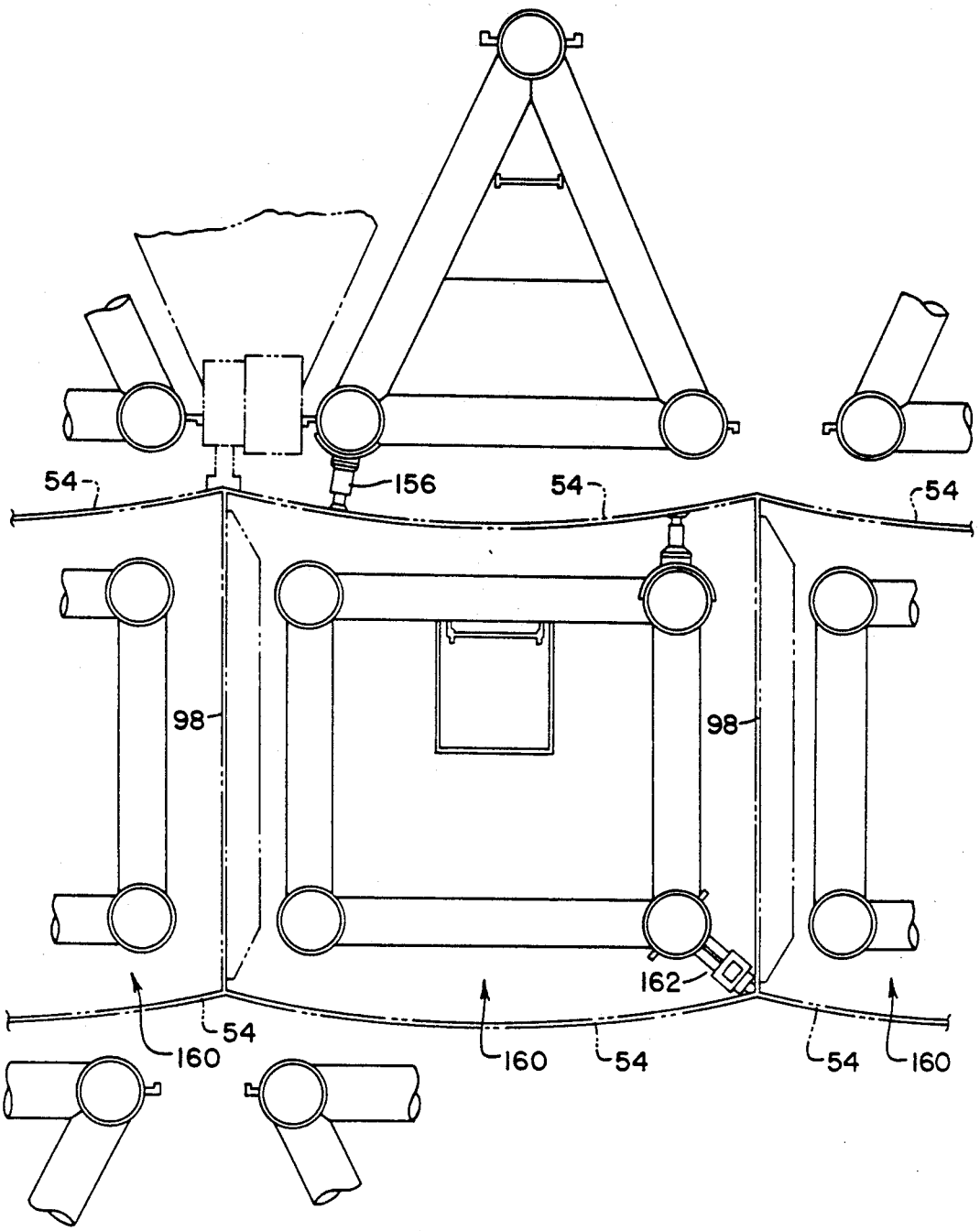
FIG. 16 is an enlarged scale fragmentary top plan view of the fixture of FIG. 12 after a complete set of flat and curved panels has been lowered into place and devices that will be further explained with reference to FIGS. 17-22 have been activated for holding the panels in place for welding of edge joints between respective adjoining edges of respective panels.
Figure 23:
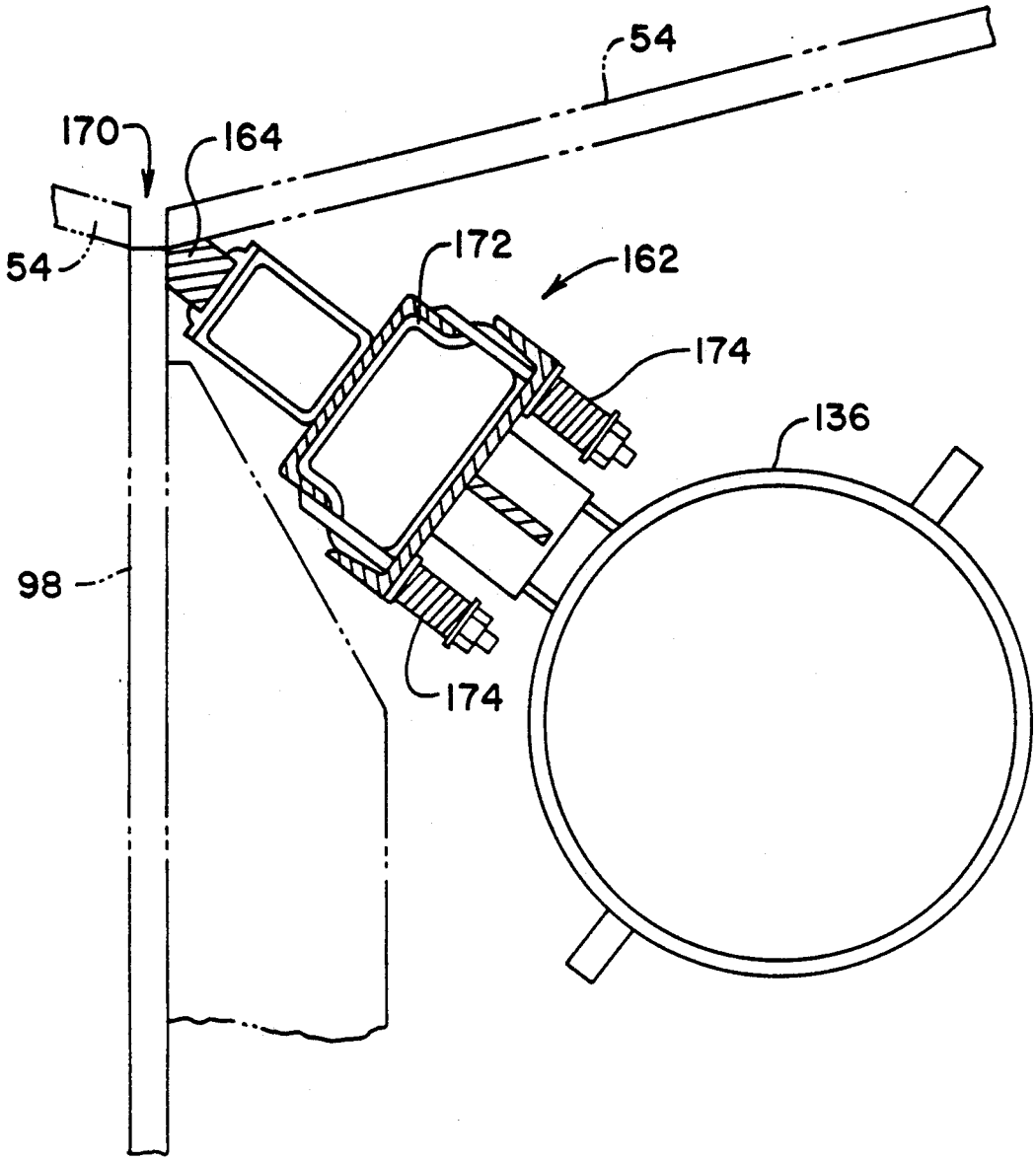
FIG. 23 is an enlarged scale horizontal transverse cross-sectional view of one copper backing bar and an actuator therefor.
Figure 24:
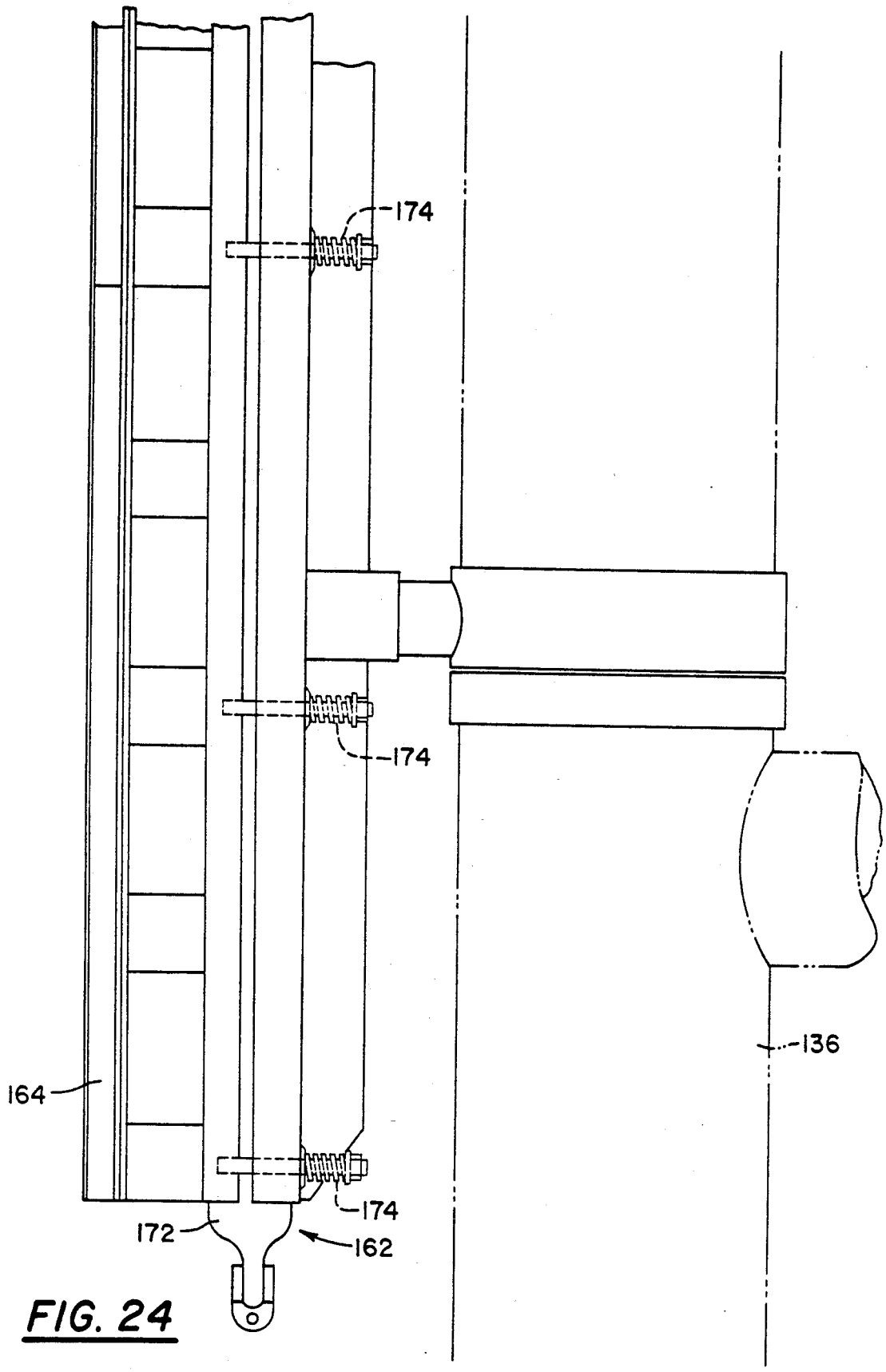
FIG. 24 is a fragmentary side elevation view of the structure shown in FIG. 23.

After all of the curved and flat panels have been brought into proper alignment in a given cell 160 of the fixture 136, mechanisms 162 (FIGS. 16, 23 and 24, only respective ones of which are shown), located in each of the four interior corners of each cell 160, are activated to position the continuous copper backing bars 164, 166, 168, which are variously of the cross-sectional configurations shown in FIGS. (23, 24, 27) 26 and 28.

The devices 158 position the curved steel plate 54 of each near intersection 170 between adjacent edges of curved and stiffened flat panels 54, 98. The backing bars 164, 166, 168 are positioned pneumatically in the valley formed by edge margins of two respective panels, by inflating a flexible hose 172, thus forcing the backing bar 164, 166, 168 with positive force into damming relationship with the two panels near the intersection. When the electrogas welding (of FIG. 25) is completed, air pressure is released from each hose 172 and a spring mechanism 174 returns the backing bars 164, 166, 168 to their original retracted positions.

Figure 25:
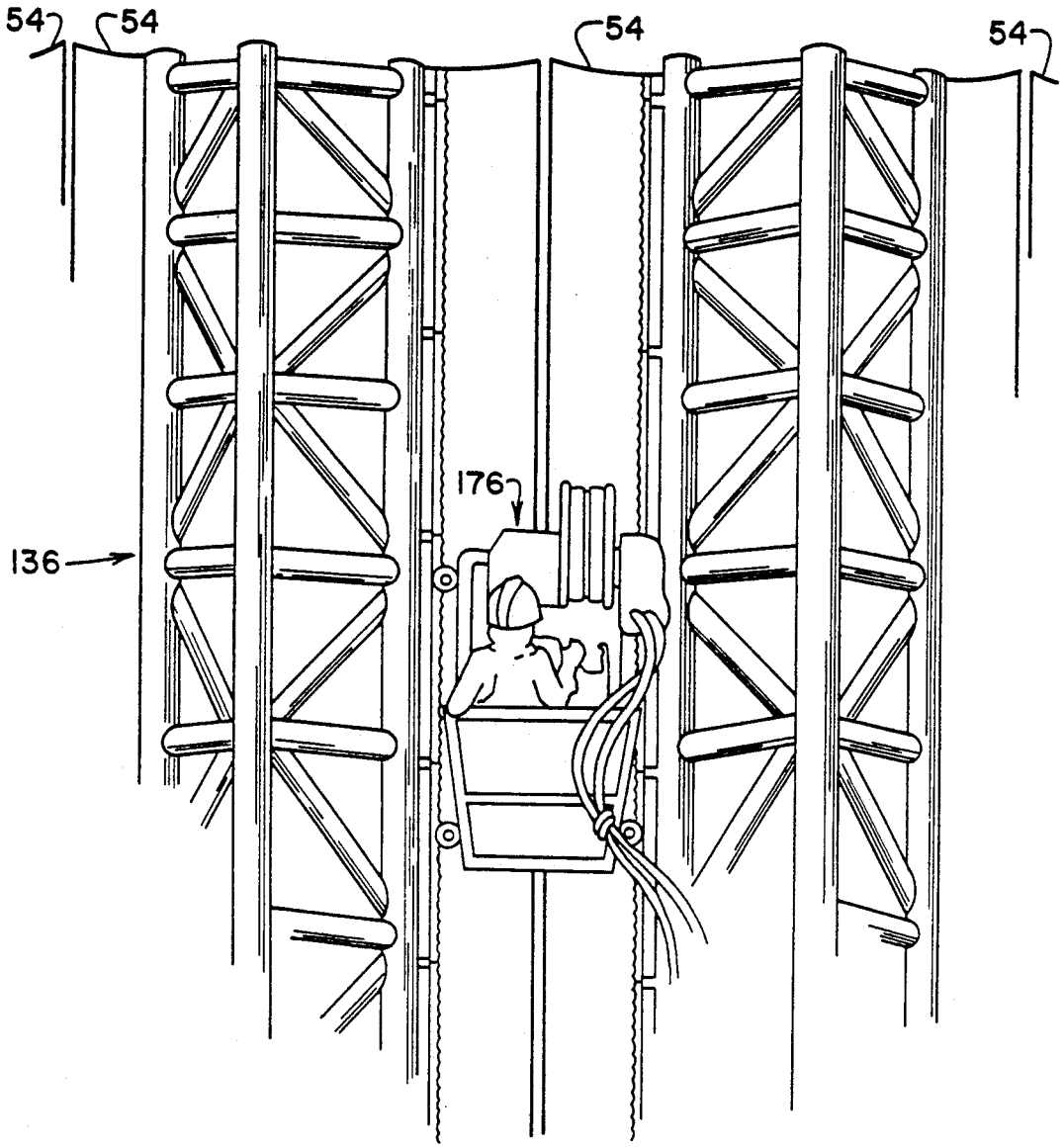
FIG. 25 is a fragmentary pictorial elevational view showing electrogas welding of a T-joint among adjacent edges of two coated curved panels and one coated stiffened flat panel, all as held in the fixture of FIG. 12.
Figure 26:
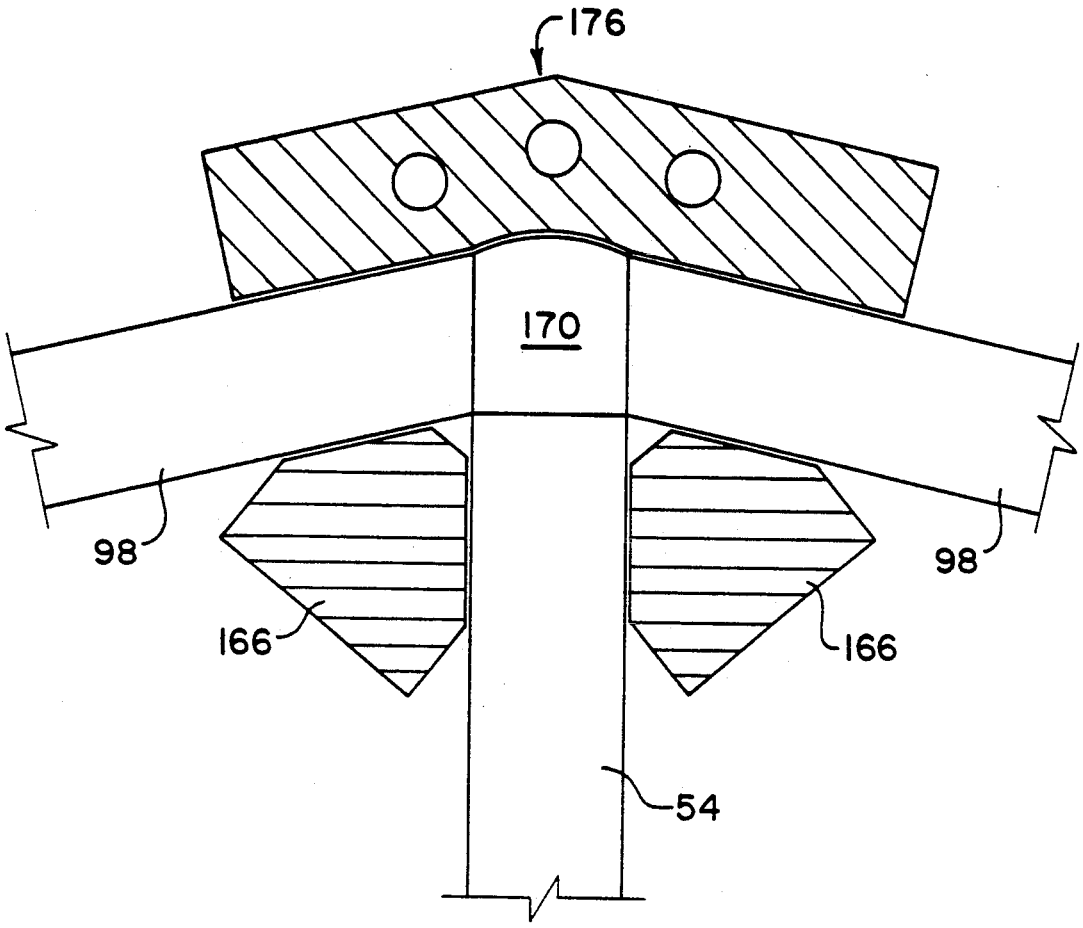
FIGS. 26, 27 and 28 are fragmentary horizontal transverse cross-sectional views of respective portions of subassembly being fabricated in the fixture of FIG. 12, showing the plate edges, copper backing bars and copper sliding shoes at sites where three different types of joint configurations are being welded for respective portions of the double-wall vessel hull module subassembly.
Figure 27:
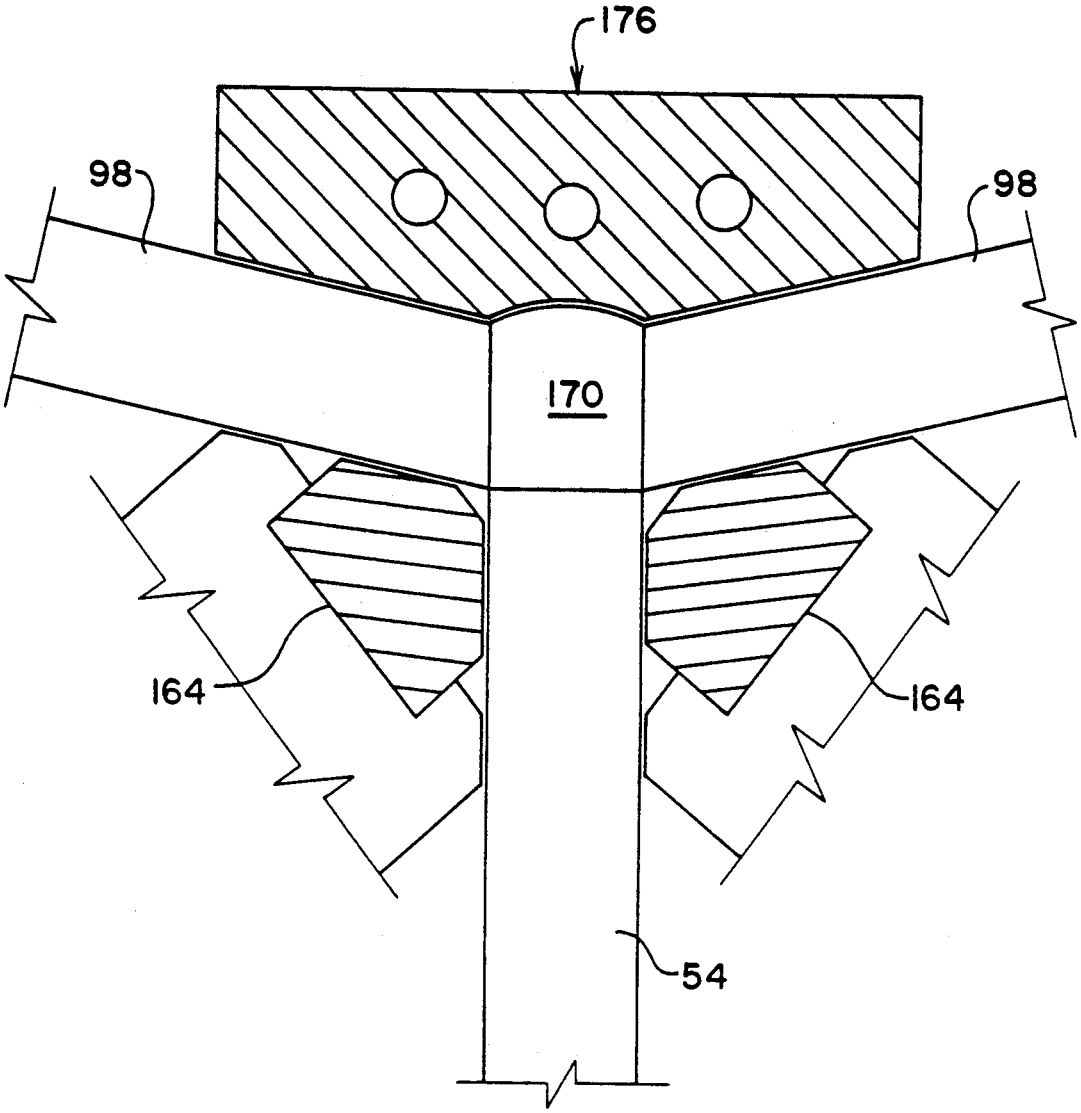
Figure 28:
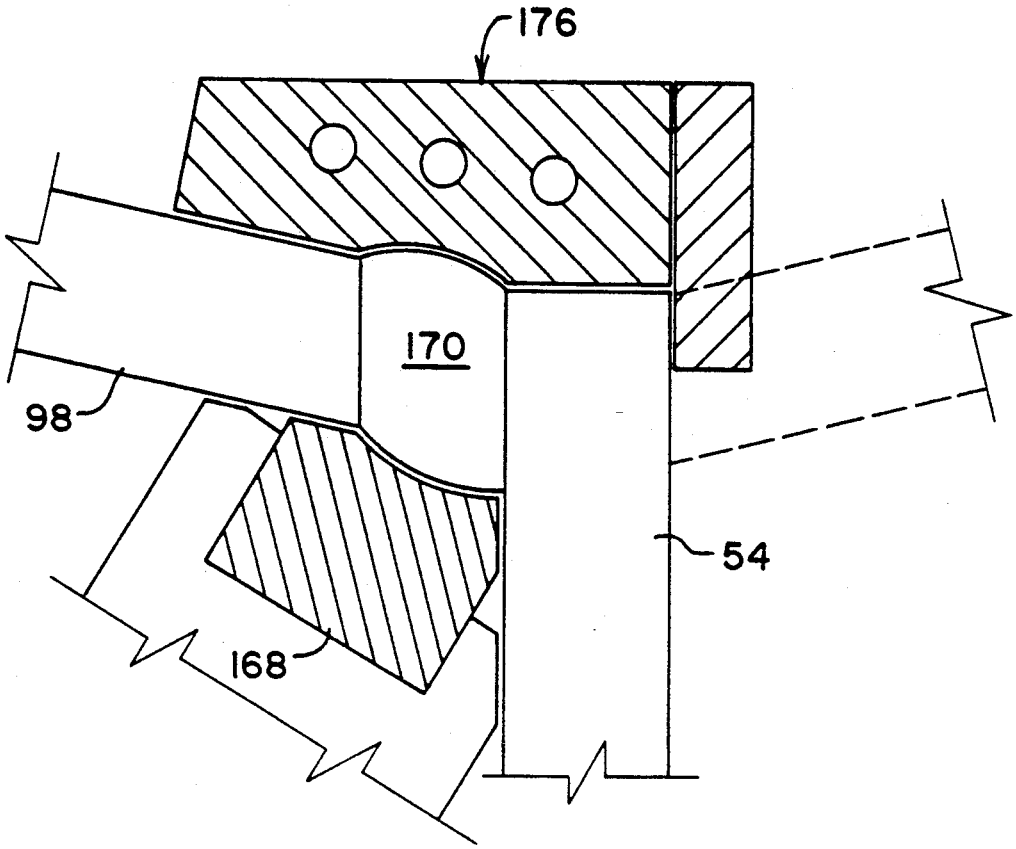
Figure 29:
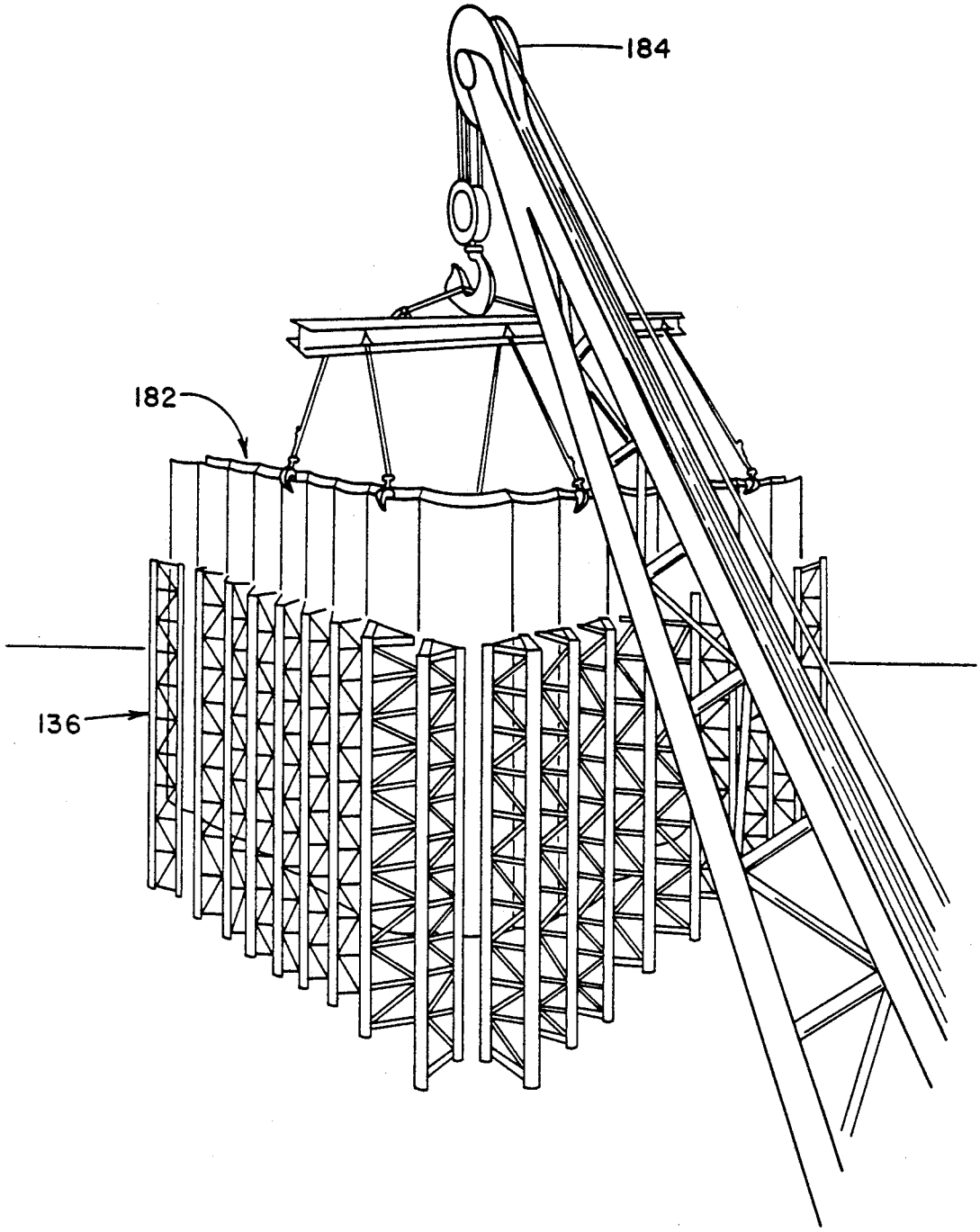
FIG. 29 is a fragmentary pictorial perspective view showing a module subassembly being removed from the fixture of FIG. 12 following completion of welding of the welded joints which interconnect the various curved and flat panels along their respective edges.

After the curved and flat panels 54, 98 are brought into alignment and the interior copper backing bars 164, 166, 168 are in extended, damming position, weld joints, joining three or two panels simultaneously, with transverse cross-sections shown in FIGS. 26, 27 or 28, are welded, using a vertical electrogas welding machine (FIG. 25). As welding machine 176 vertically rises, it is followed by a vacuum-blast nozzle, or needle gun (not shown), which removes exterior welding slag, welding splatter, burned paint, and foreign matter. The cleaned surface is then primed and finish painted by the weld machine operator, e.g., using a paint spray applicator (not shown) as the operator lowers the welding machine 176.

After electrogas vertical welding is complete and exterior of the welds have been prime painted, the panel and backing bar alignment devices 140, 148, 156, 158 and 162 are released.

Figure 30:
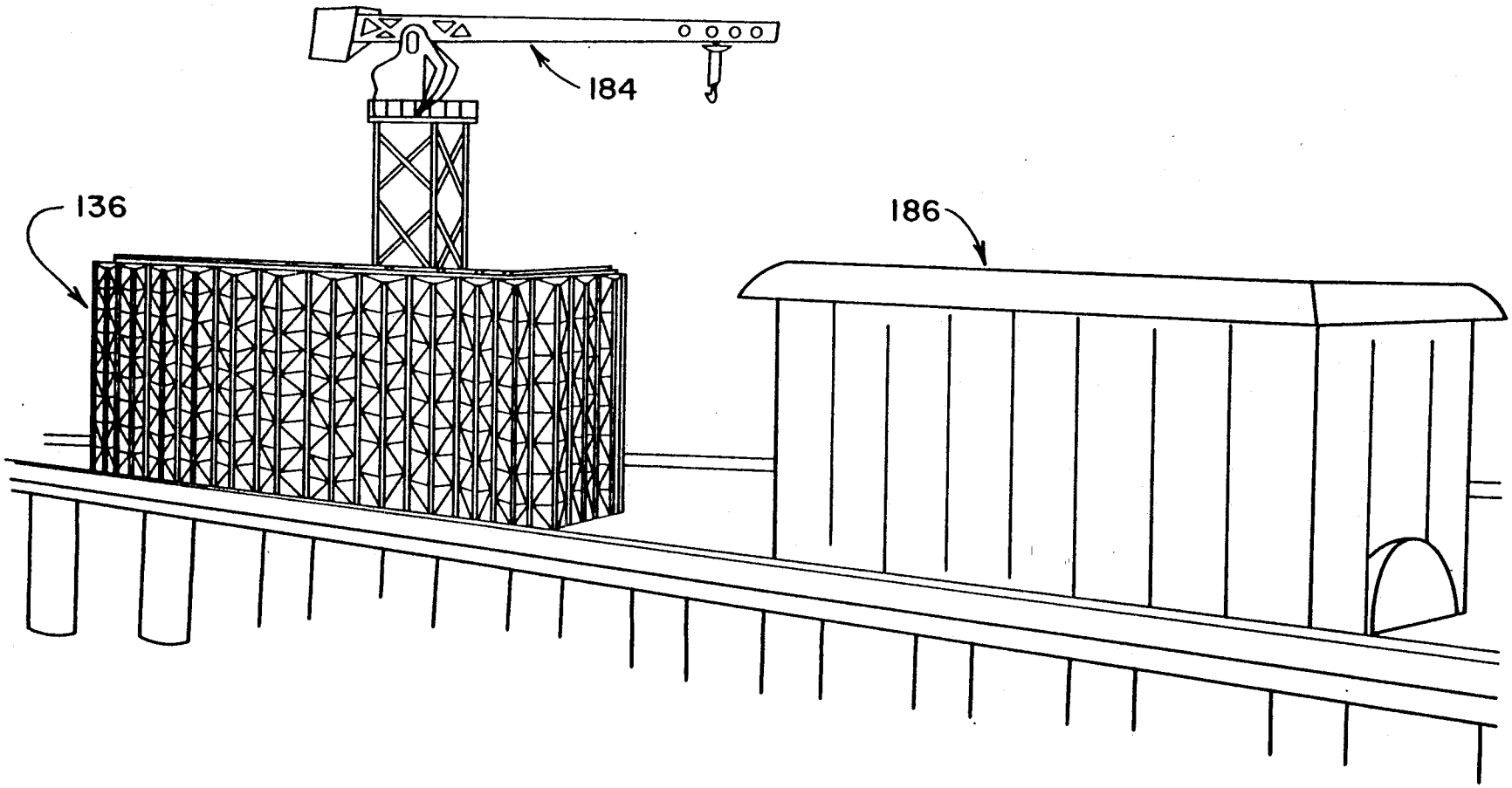
FIG. 30 is a fragmentary pictorial perspective view showing the fixture of FIG. 12 and an adjacent facility used for surface preparation and touch-up coating of the subassembly for repairing damage to the coating earlier provided on the panels caused by the electrogas welding depicted in FIG. 25.
Figure 31:
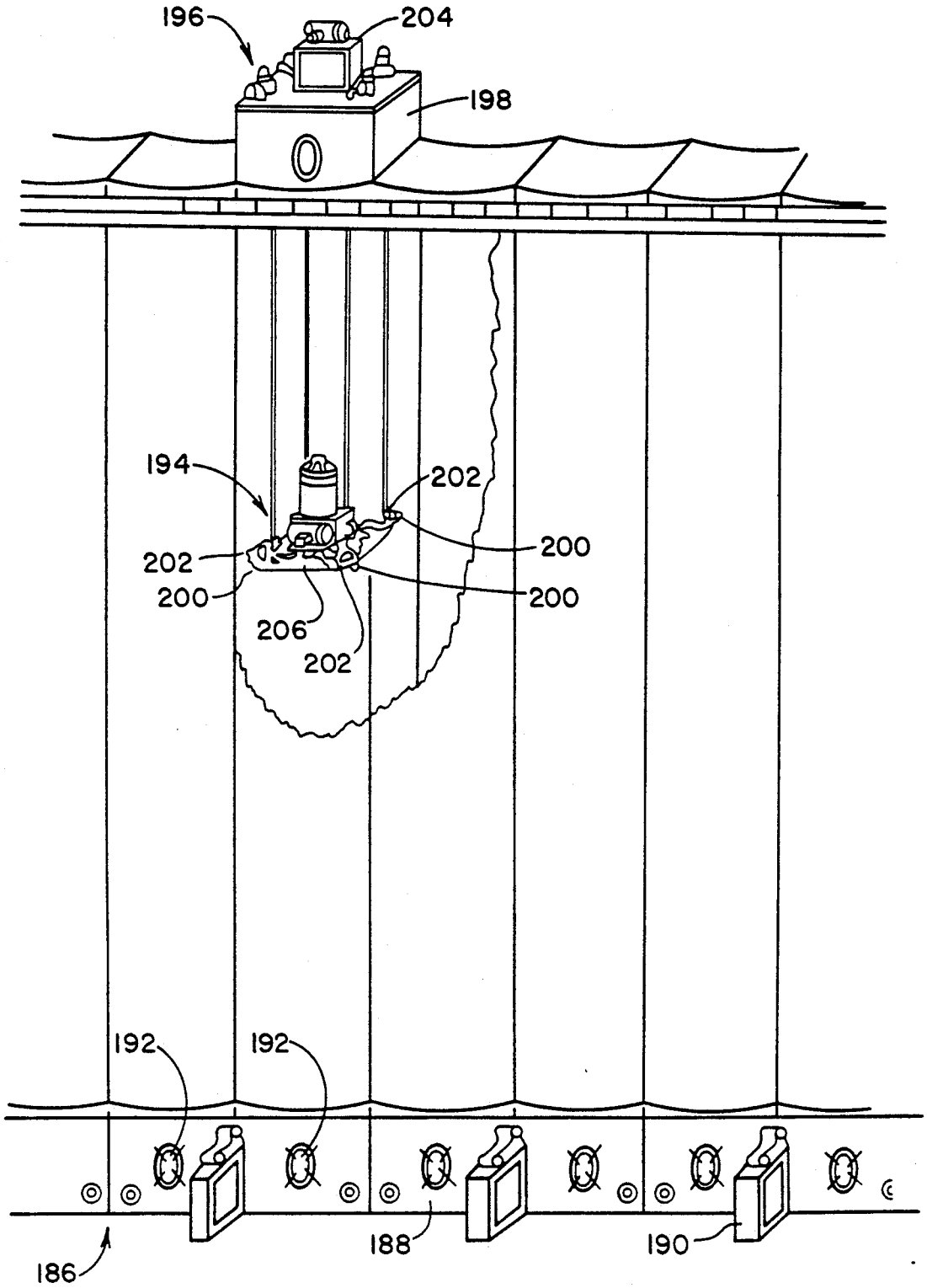
FIG. 31 is a fragmentary pictorial perspective view, partly broken away for showing the interior of a subassembly cell, illustrating surface preparation and touch-up coating of the interior walls of the cell.

The painted subassembly 182 of panels and welds is then lifted from the fixture by a revolving crane 184 (FIGS. 1, 29, 30 and 40) and placed in a subassembly touch-up blast and paint facility 186 (FIGS. 1, 30 and 31).

The main purpose of the touch-up blast and paint facility 186 is to repair interior cell coating damage caused by subassembly welding along interior edges of joints formed at 170 which form the intersection of curved panels 98 and stiffened flat panels 54. The facility 186 includes a supporting structure 188 for the subassembly, with a built-in plenum for intake air to each interior cell 160 of the subassembly including means 190 for dehumidifying intake air and heating it, using steam coils or some other non-explosive means, and, in addition, a means of access 192 to the bottom of each cell 160 to service vacuum-blast and paint equipment 194.

The facility 186 further includes a touch-up blast and paint elevator platform mechanism 196 having a cover 198 which extends over a single interior cell 160 at a time and is adequate for weather protection of that cell.

The cover 198 is provided with an elevator platform 194 having four vacuum-blast nozzles 200 and four paint-spraying nozzles 202, one of each for each interior corner of a respective cell. The platform is suspended from the bottom of the cover at all four corners by a wire rope and pulley arrangement 196 which permits synchronous raising of each corner of the platform at speeds appropriate for both automatic vacuum blasting and automatic spray painting of corners of each individual subassembly cell where welding along the edges of the panels has damaged the coating.

An explosion-proof exhaust fan 204 is mounted in the cover 198, with replaceable filters that are capable of entrapping the paint overspray which will be created by spray painting repaired areas of coating along vertical edges at intersection of curved and stiffened flat panels damaged by welding.

The vacuum-blast machine 194 is mounted on the platform and has four nozzles 200 which are oriented toward the four interior corners of the subassembly cell to accomplish recyclable abrasive blasting of areas along panel edges where the coating has been damaged, in order to remove burned paint, weld slag, weld splatter and other foreign material as the platform is raised in an appropriate speed.

Similarly, four appropriate spray painting nozzles 202 with appropriate supporting air and paint hoses are attached to the platform 206 and oriented toward the interior corners of the respective subassembly cell 160 to enable spray painting of areas vacuum blasted above as the platform is raised at an appropriate speed.

The spray paint used for spray painting of cell corners can be urethane type of any other type that is compatible with the cathodic epoxy coating utilized on the curved and flat panels.

Figure 32:
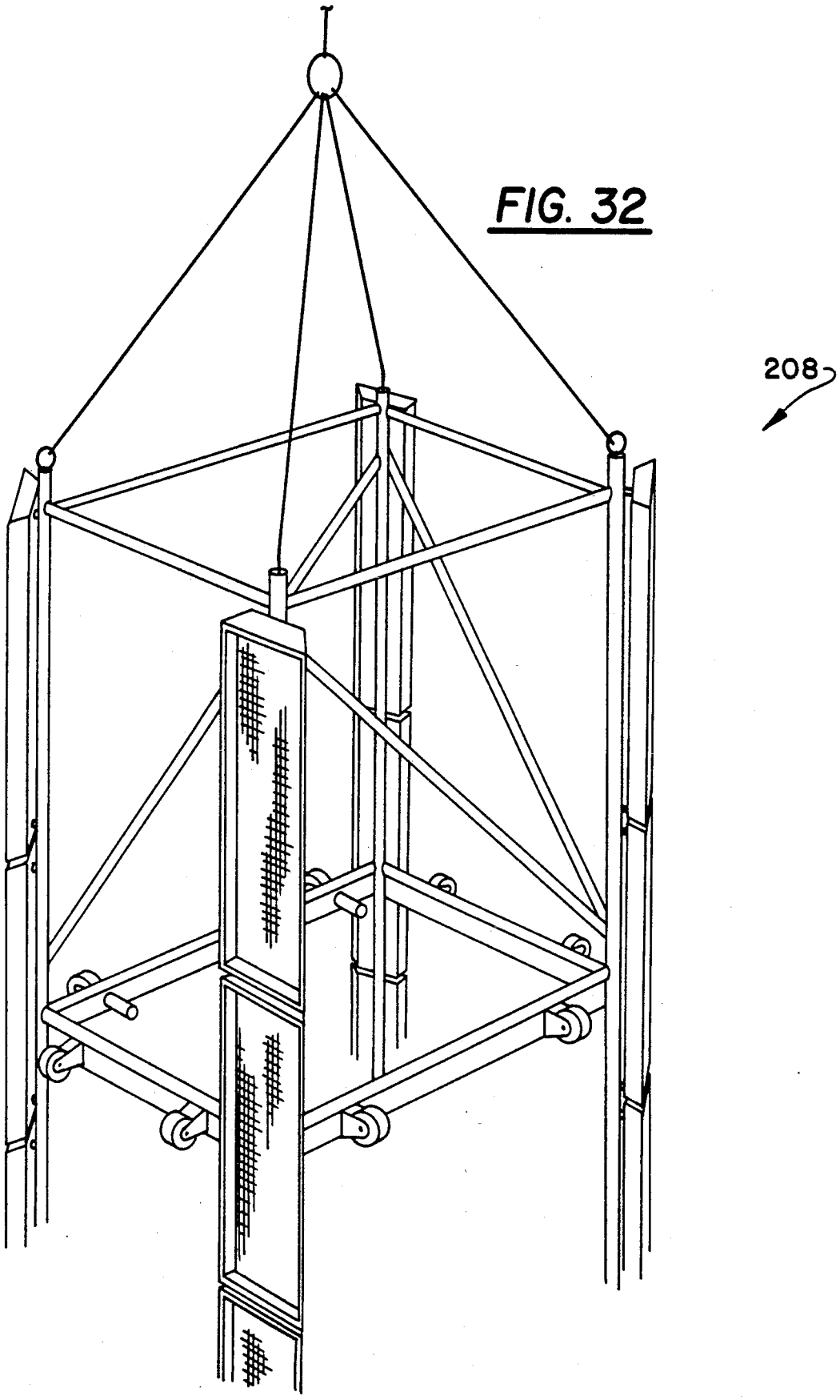
FIG. 32 is a fragmentary pictorial perspective view of a tower, with infrared, heating elements continuously arrayed along each vertical corner, the tower being configured to fit inside individual subassembly cells.
Figure 33:
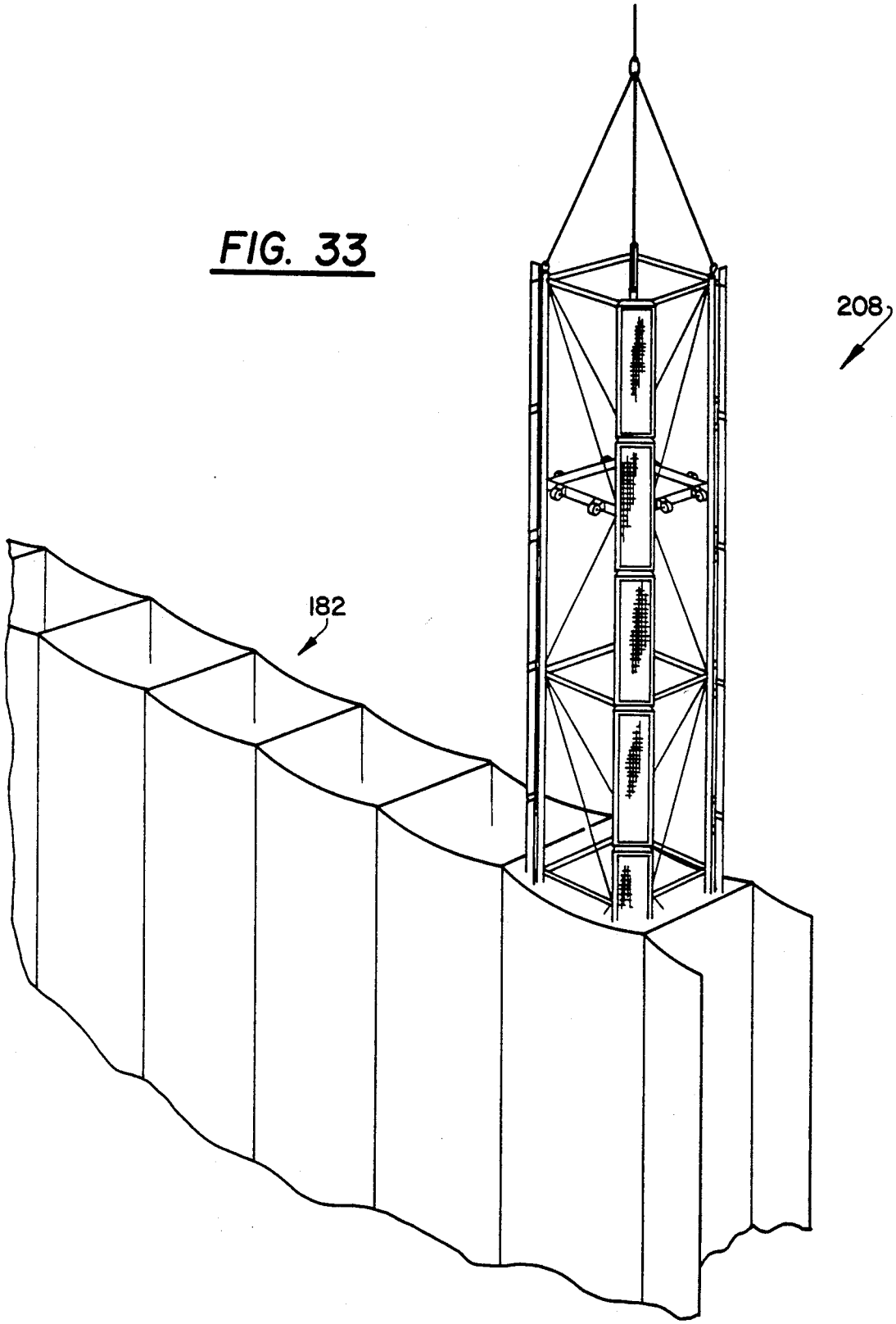
FIG. 33 is a fragmentary pictorial perspective view depicting the infrared heating tower of FIG. 32 being lowered into a subassembly cell.

After coating is completed, the cover 198, complete with elevator platform 194, vacuum blast nozzles 200 and paint spraying nozzles, is moved successively to blast- and paint-damaged areas of all cells. As elevator platform 194 is removed from a cell, the infrared heating tower 208 depicted in FIG. 32 is lowered into the cell just vacated by the elevator platform, as depicted in FIG. 33, and energized for a period sufficient to cure the urethane paint just applied (approximately 30 to 90 minutes). This process is repeated successively until the urethane paint in all of the subassembly cells is cured.

Figure 34:
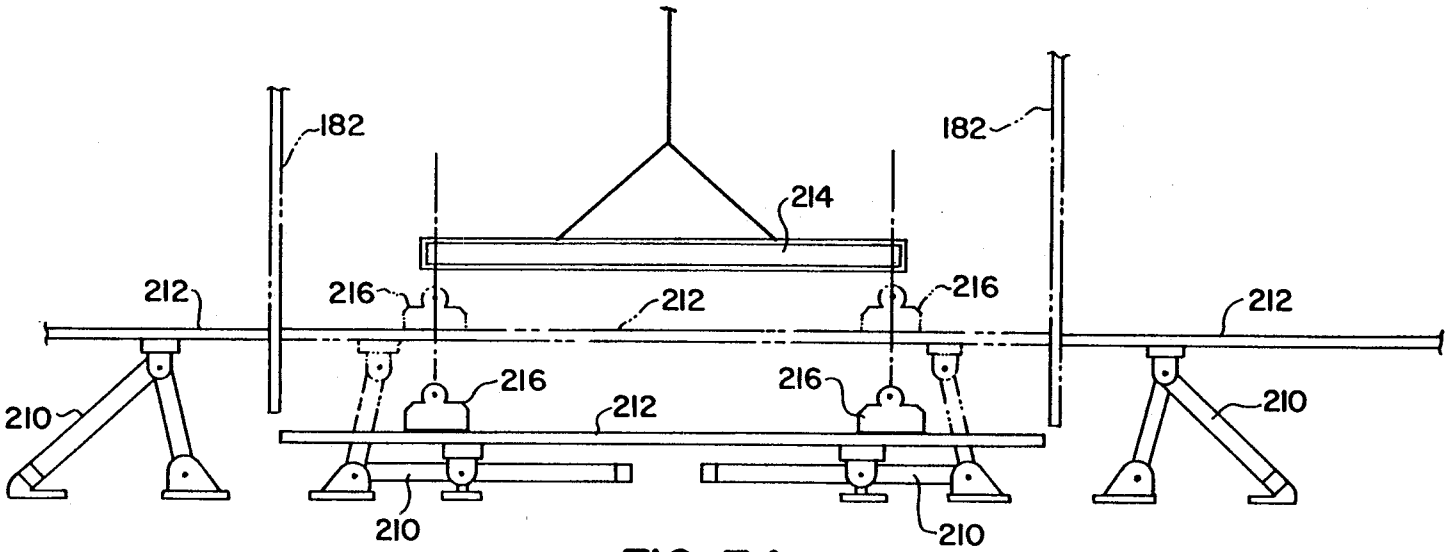
FIG. 34 is a fragmentary pictorial view of the facility used for installation and welding of transverse bulkheads into subassembly cells, the facility being shown with a single transverse bulkhead positioned beneath its matching cell, ready to be raised into position for welding.
Figure 35:
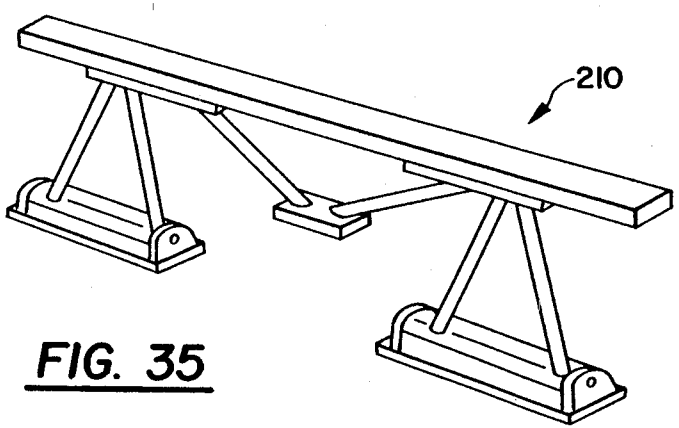
FIG. 35 is a fragmentary pictorial perspective view of the erecting devices used in the transverse bulkhead installation facility depicted in FIG. 34.
Figure 36:
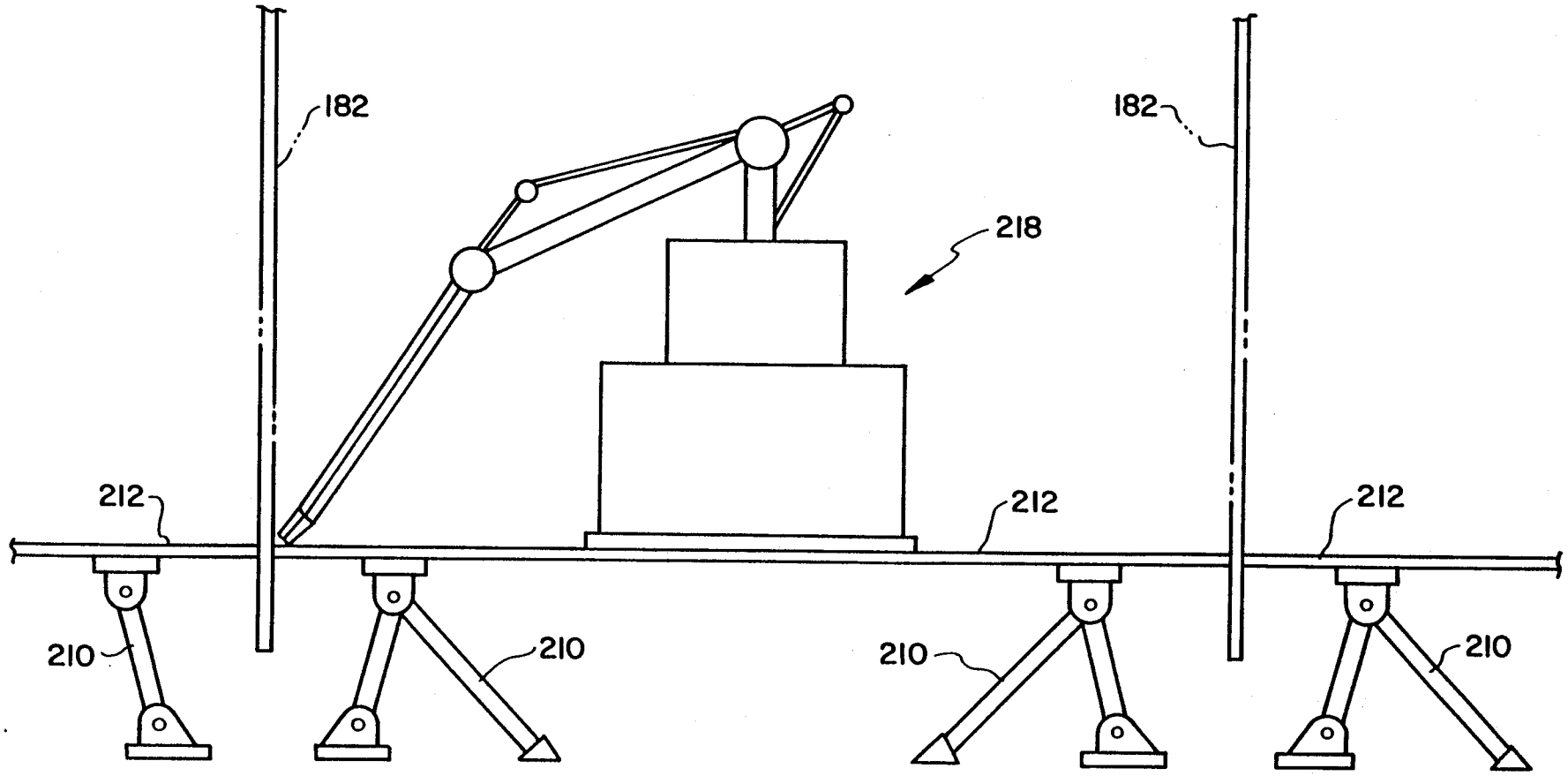
FIG. 36 is a fragmentary pictorial sectional view, showing the subassembly in place on the subassembly transverse bulkhead installation facility with a transverse bulkhead being welded robotically to the cell walls.
Figure 37:
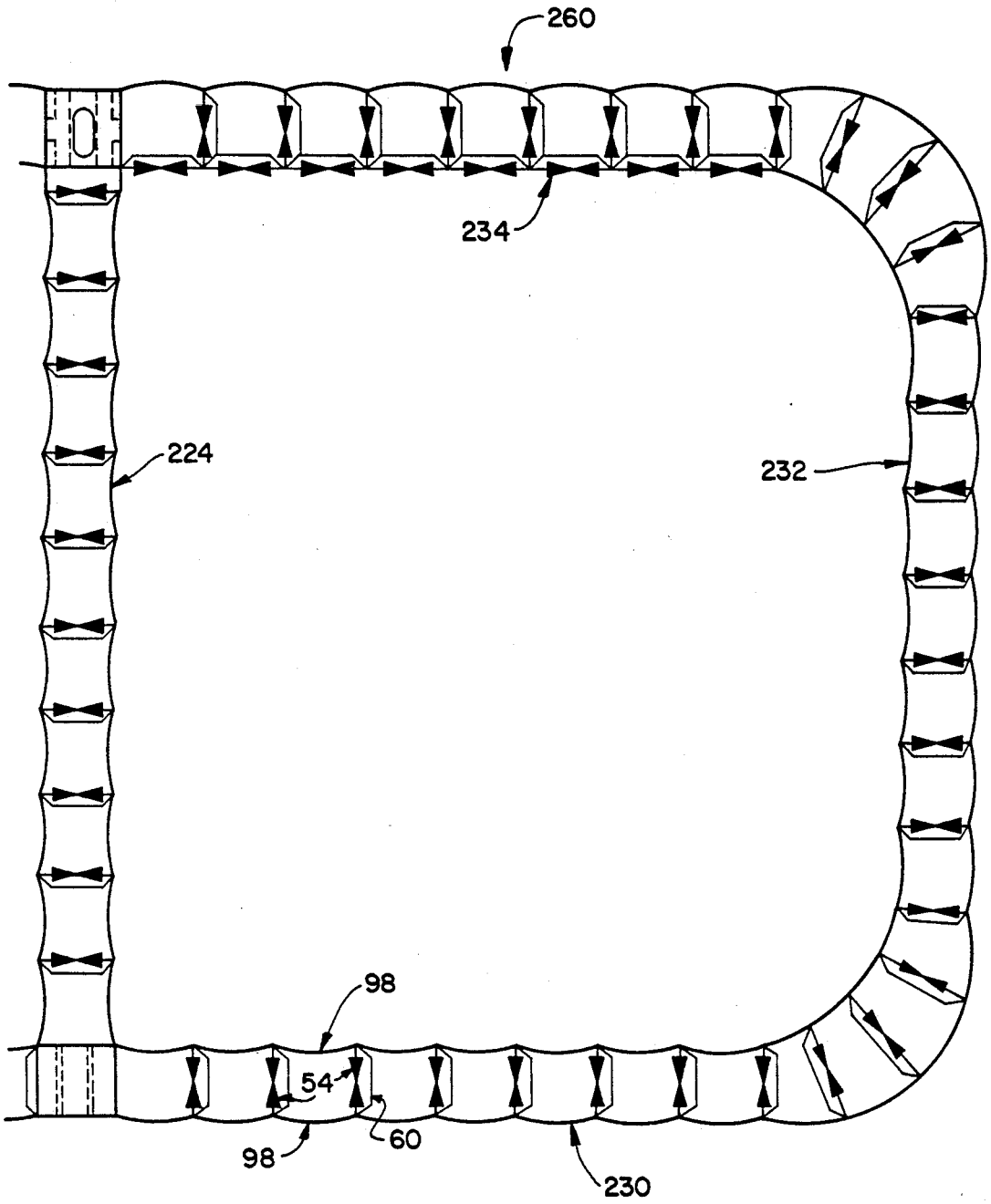
FIG. 37 is a fragmentary diagrammatic end view of a completed module at an open end.
Figure 38:
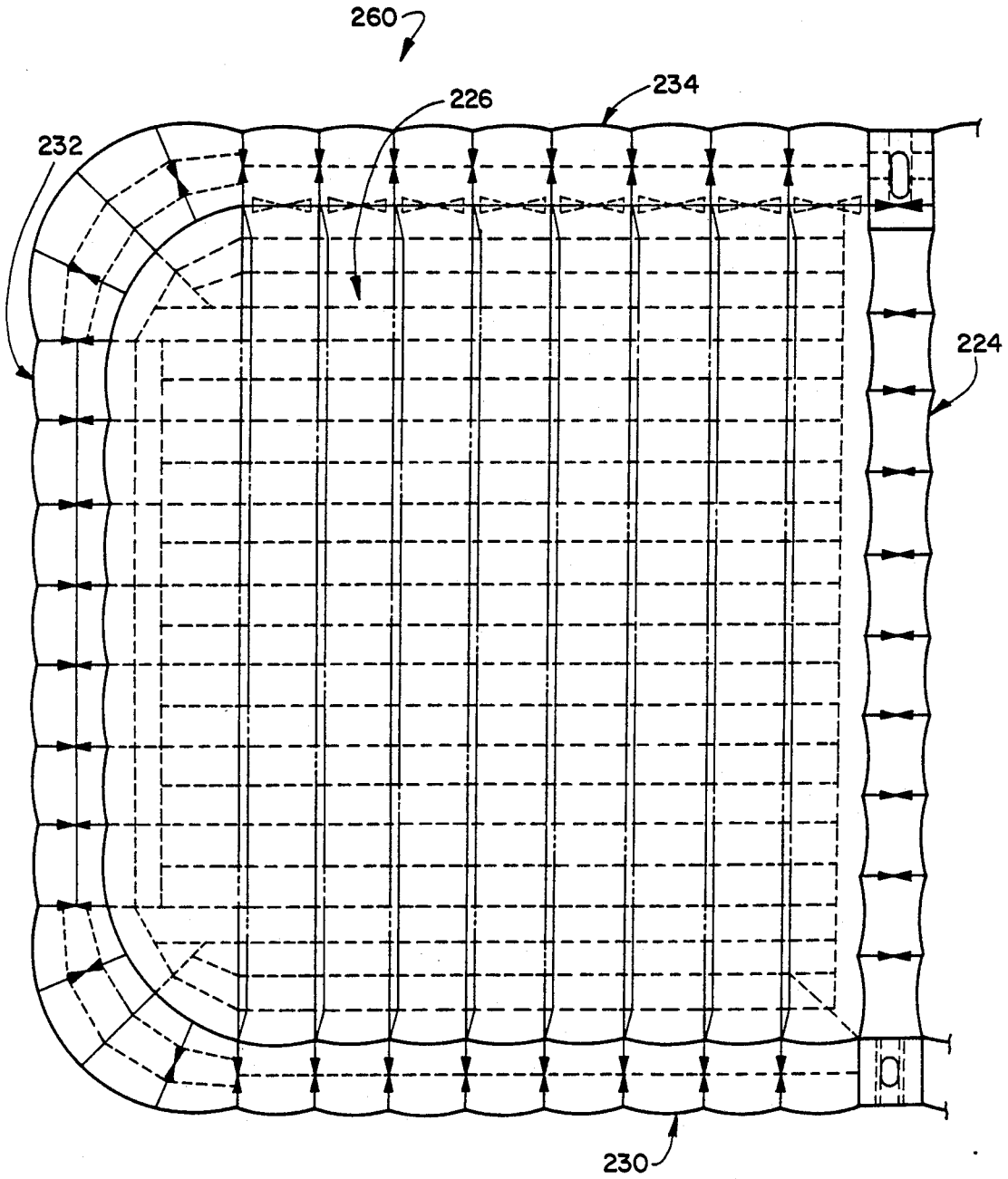
FIG. 38 is a fragmentary diagrammatic end view of a completed module at an end closed by a transverse bulkhead.
Figure 39:
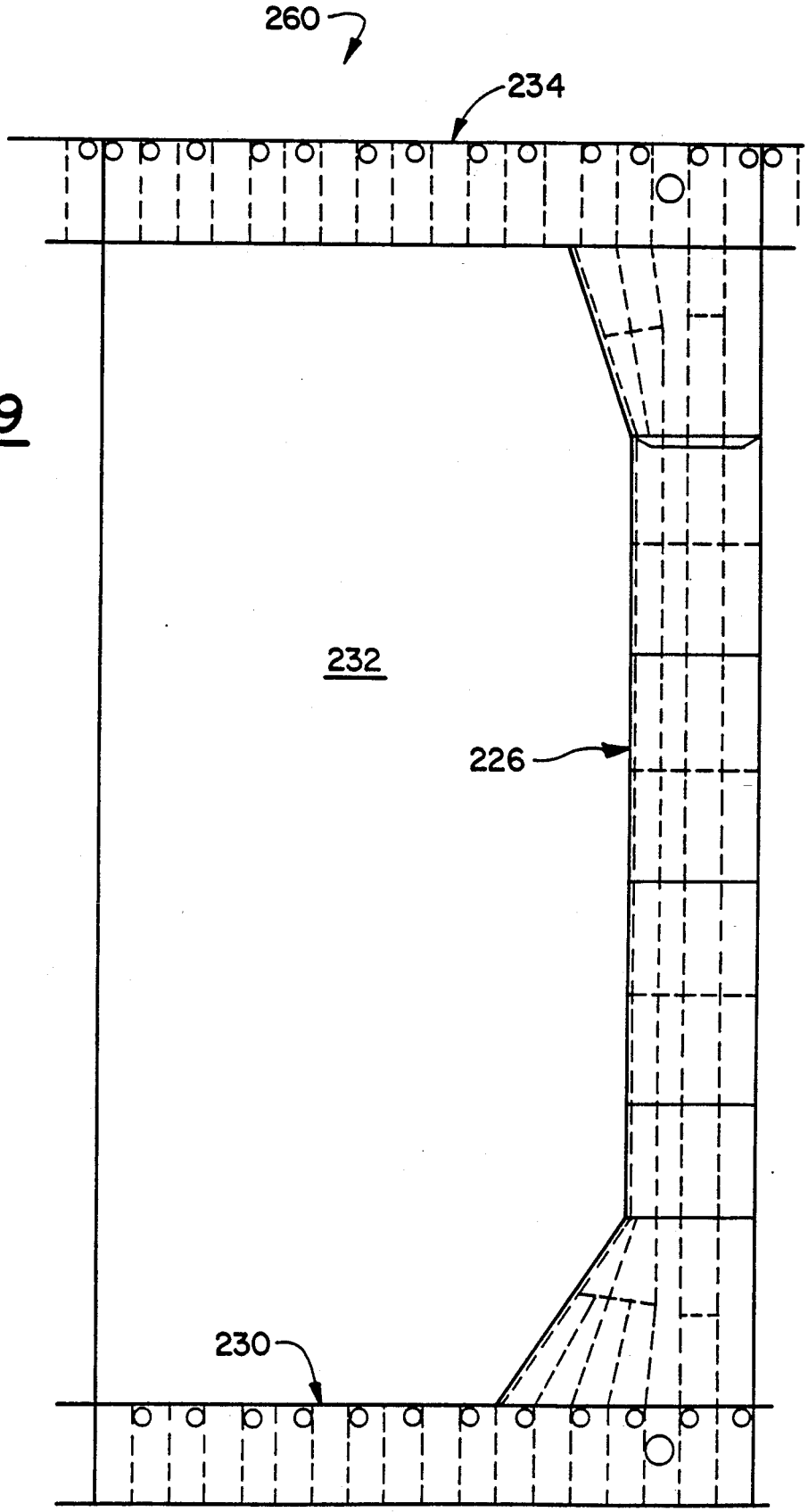
FIG. 39 is a fragmentary vertical longitudinal sectional view of the module of FIGS. 33 and 34, showing a typical shape and position for a transverse bulkhead.

The subassembly 182, after this cleaning, painting and curing, is lifted from the touch-up blast and paint facility 186 using the revolving crane 184 and relocated over the transverse bulkhead-erecting devices 210 and transverse bulkheads 212 shown in FIGS. 34 and 35. The transverse bulkheads 212 are raised by a spreader bar 214 with attached electromagnets 216 attached to the revolving crane 184. As the electromagnets 216 raise the transverse bulkheads 212, the erecting devices 210, also influenced by the electromagnets 216, follow, until the transverse bulkheads 212 are properly positioned in the subassembly cells 182 (preferably approximately 12 inches from their bottoms). At this point, the transverse bulkhead-erecting devices 210 latch, as shown in FIG. 35, and hold the transverse bulkheads in the proper position. These cell transverse bulkhead units are then welded robotically, as depicted in FIG. 36, using robotic welder 218 or are welded manually.

Figure 40:
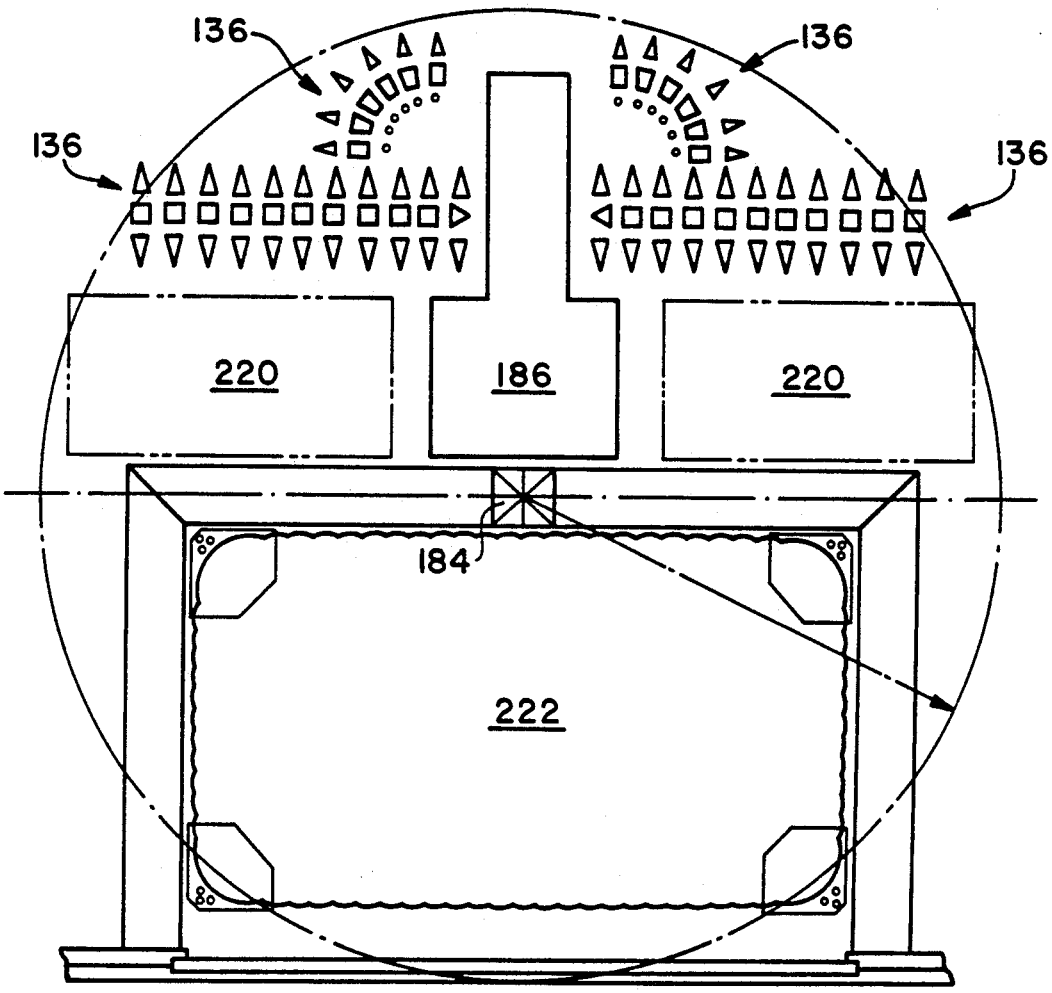
FIG. 40 is a fragmentary diagrammatic plan view showing the subassembly fixture, touch-up blast and paint facility, subassembly transverse bulkhead installation facility and the module assembly fixture and launching dock.
Figure 41:
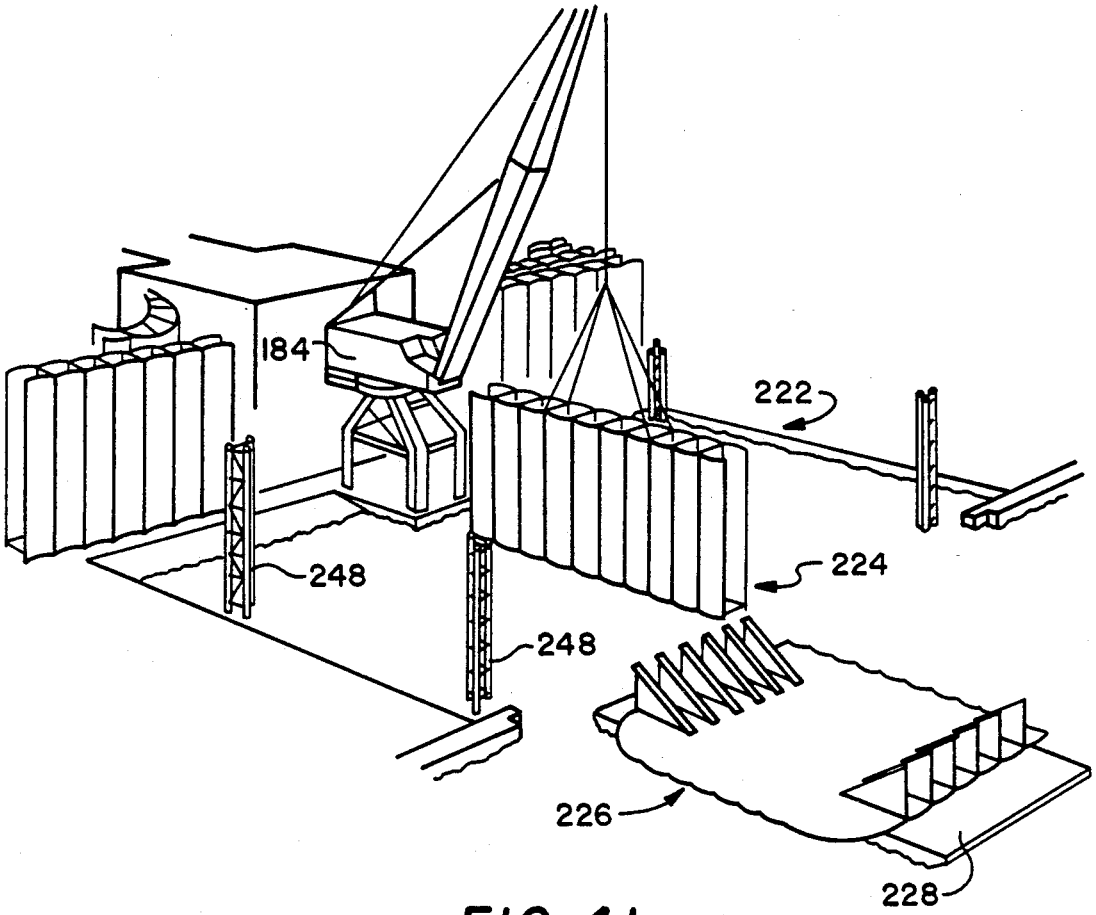
FIGS. 41 and 42 are fragmentary pictorial perspective views showing subassemblies being joined into modules in the module assembly fixture and launching dock.
Figure 42:
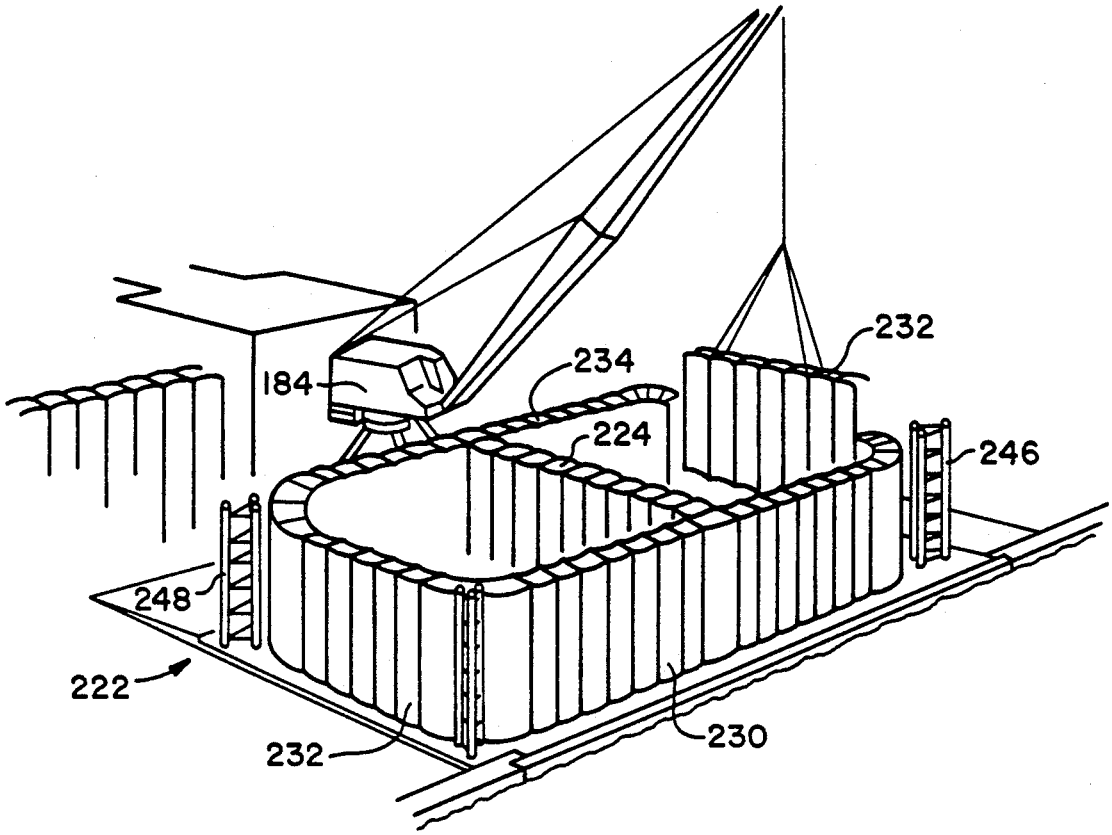
Figure 43:
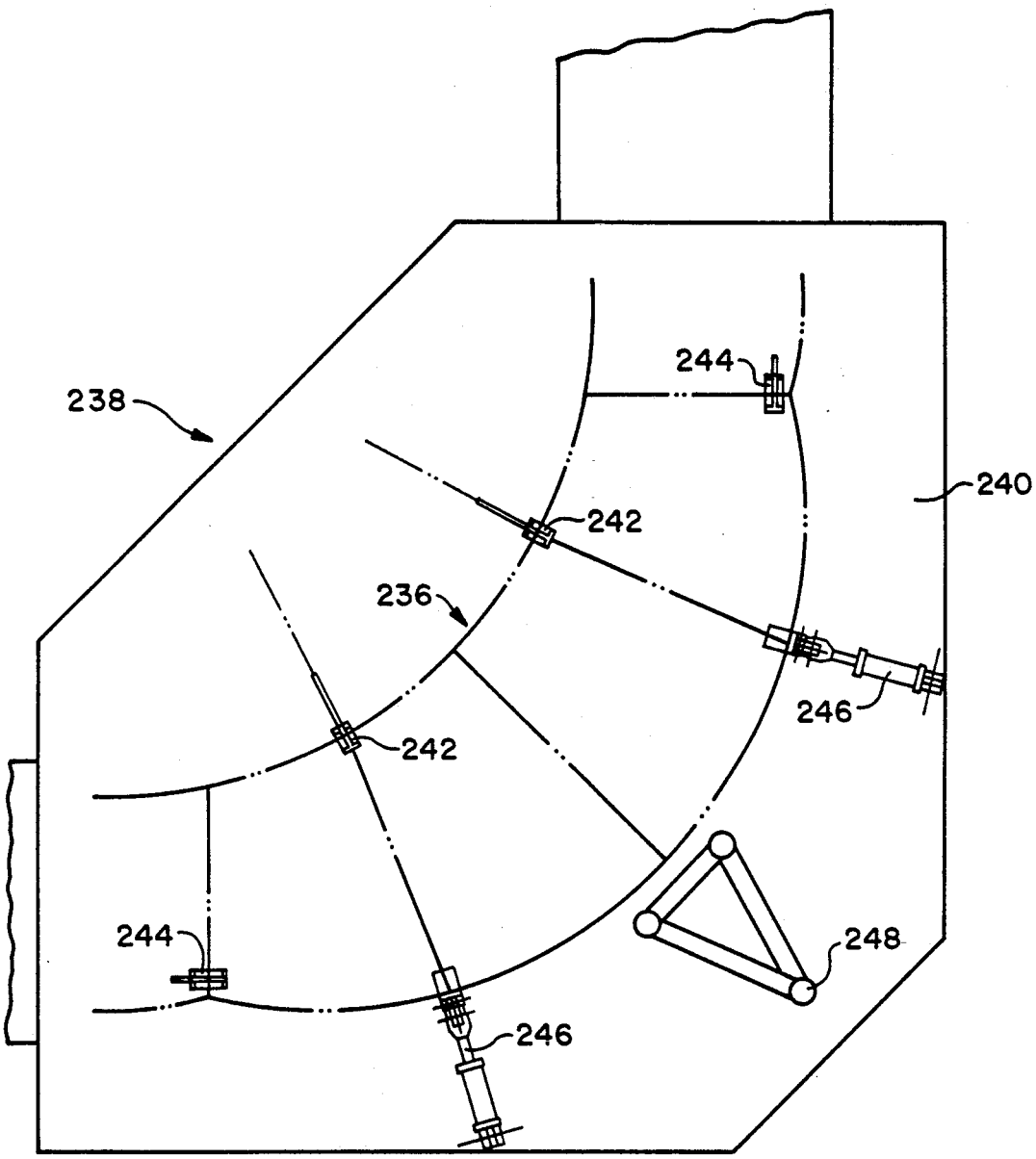
FIG. 43 is a fragmentary pictorial detailed plan view of one of four bottom corner fixtures of the module assembly fixture and launching dock.
Figure 44:
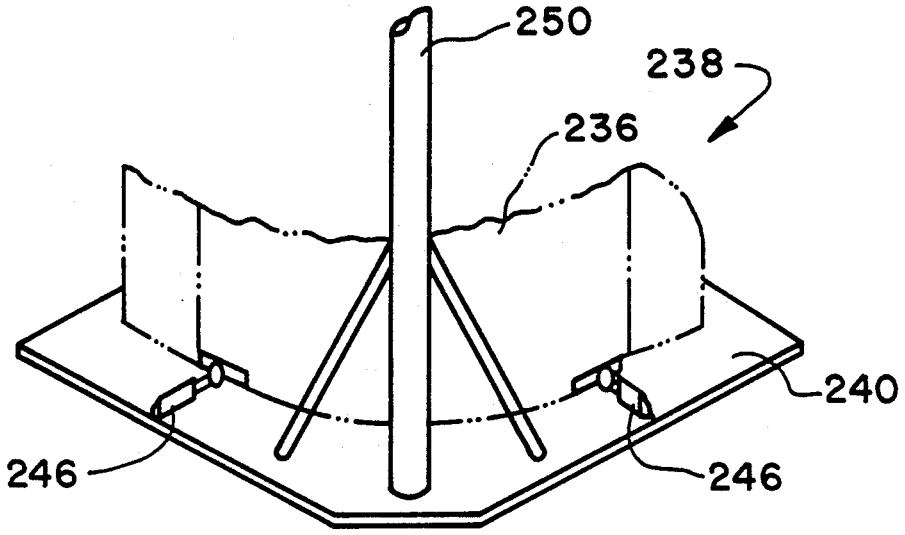
FIG. 44 is a fragmentary pictorial perspective view of the bottom corner fixture depicted in FIG. 43.
Figure 45:
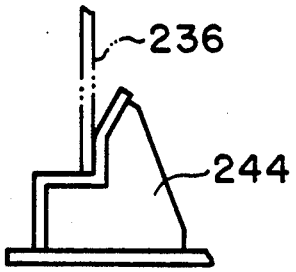
FIGS. 45, 46 and 47 are fragmentary pictorial sectional views of the positioning and indexing devices used with the bottom corner fixture depicted in FIGS. 43 and 44.
Figure 46:
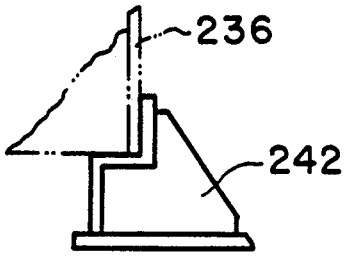
Figure 47:
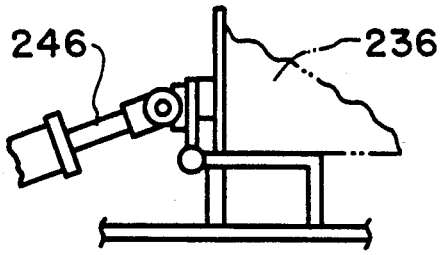
Figure 48:
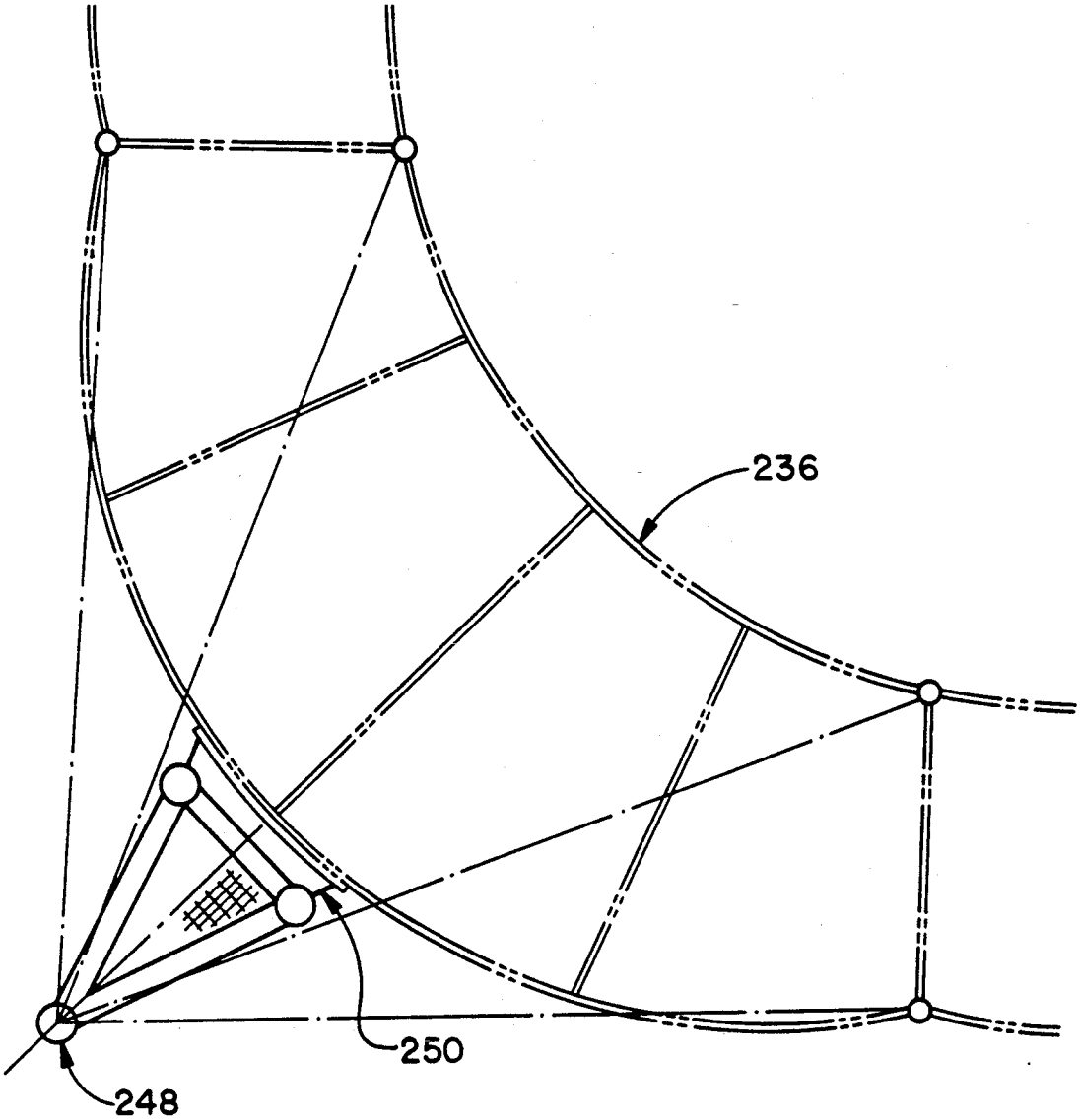
FIG. 48 is a fragmentary horizontal cross-sectional view of a rotating kingpost with fixed index used for aligning the tops of curved plate longitudinal subassemblies to each other.

The subassembly 182, after installation and welding of cell transverse bulkhead units, is lifted from the subassembly transverse bulkhead installation facility 220 using a revolving crane 184 and is placed in the module assembly fixture and launching dock 222 shown in FIG. 40.

FIG. 40 depicts the general arrangement of a preferred assembly area including subassembly fixtures 136 for both curved and straight subassemblies, touch-up blast and paint facility 186, subassembly transverse bulkhead installation facilities 220, module assembly fixture and launching dock 222 and revolving crane 184 with a radius sufficient to service all of these areas.

Referring to FIGS. 41–48, a module is created from the several subassemblies by placing a double longitudinal vertical wall 224 in the module assembly fixture and launching dock 222 with the revolving crane 184. Transverse bulkhead subassemblies 226 are then introduced into the module assembly fixture and launching dock 222 by barge 228, and placed in position alongside the double longitudinal vertical wall 224 by the revolving crane 184.

The remaining subassemblies making up a module having a double bottom 230, double side walls 232 and double deck 234, are then placed around the double longitudinal vertical wall 224 and transverse bulkheads 226 (FIGS. 37–39, 41 and 42) with the revolving crane 184.

The curved subassemblies 236 are positioned very accurately in the module assembly fixture and launching dock 222 (FIGS. 43–48). This is accomplished by the curved subassembly alignment fixture 238 comprising a base 240, radial alignment stops 242, transverse alignment stop 244 and ram indices 246. The hydraulically operated ram indices 246 lock the curved subassemblies 236 against the stops 242, 244. The remaining subassemblies are then aligned to the curved subassemblies 236.

Integral with the curved subassembly alignment fixtures 283 are four rotating kingposts 248, each with a fixed index 250 which is used for positively aligning the tops of the subassemblies 236. Each fixed index 250, when rotated around kingpost 248 to a position shown in FIG. 48, serves as a positive stop against the upper part of the respective subassembly 236. Comealongs, with cables or other simple devices, can be used to position the subassembly 236 against the fixed index 250. Later, the fixed index 250 can be rotated away from the subassembly 236 around the kingpost 248 so that the completed module can be removed from the module assembly fixture and launching dock.

The curved subassembly alignment fixtures 238 with rotating kingposts 248 are portable so that different module sizes can be assembled in the module assembly fixture and launching dock 222.

Figure 49:
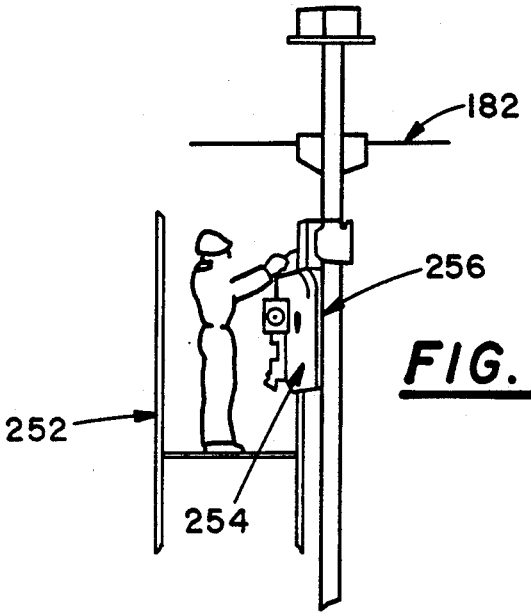
FIG. 49 is a fragmentary pictorial sectional view from inside the double hull of two curved plate longitudinal subassemblies, depicting electrogas welding of one of the butt joints joining the subassemblies.
Figure 50:
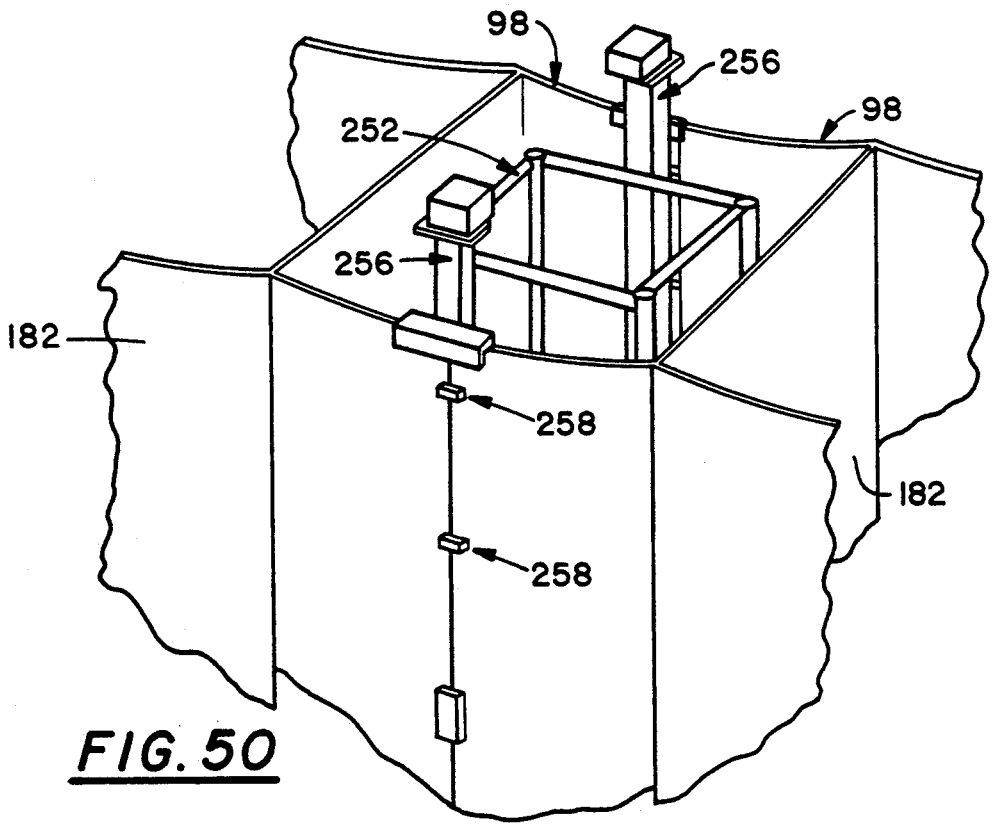
FIG. 50 is a fragmentary pictorial perspective view of the electrogas welding fixture and equipment inside a subassembly cell.
Figure 51:
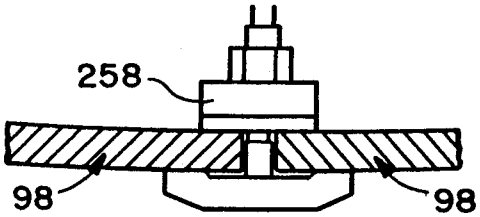
FIG. 51 is a fragmentary pictorial sectional view of a device for fairing butt joints of adjacent subassemblies.

When alignment is complete, the subassemblies are joined together to form a module (FIGS. 49–51). An electrogas welding apparatus frame 252 is placed inside the subassembly cell at the place that the joints are to be made. Two electrogas welding units 254, one for each joint, are attached to the electrogas welding apparatus frame 252 by a vertical track 256. Each electrogas welding unit 254 operates independently on its own vertical track 256 attached to the electrogas welding apparatus frame 252. To keep the edges of this joint fair and true, a series of joint fairway clamps 258 are attached to the subassembly curved plates 98 at the joints. The operator removes the joint fairing clamps 258 as the electrogas welding unit 254 progresses up the joint.

Figure 52:
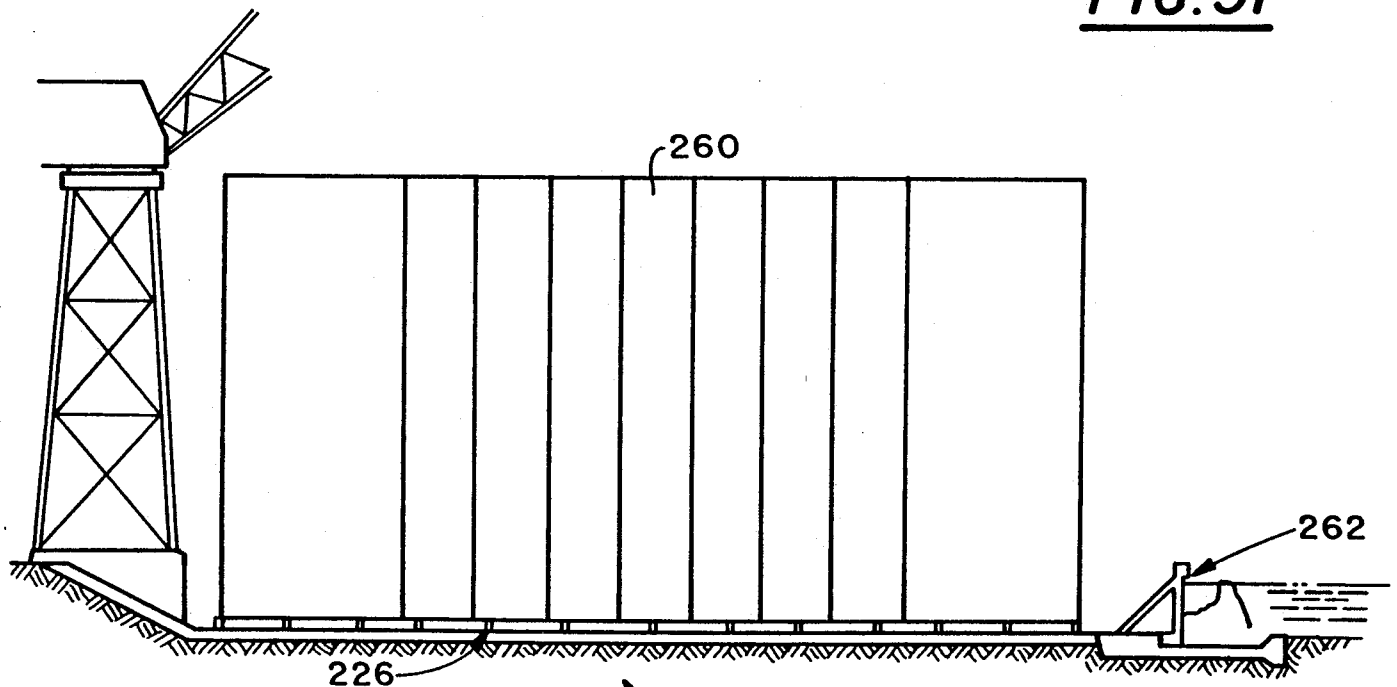
FIG. 52 is a pictorial sectional view of the module ready to be launched on the module assembly fixture and launching dock.

After completion of welding, a module 260, ready for launching, has been assembled (FIG. 52). The module 260 is launched by opening valves in the launching dock gate 262 and, thus, allowing seawater to flood the module assembly fixture and launching dock 222 until the module 260 floats, using the transverse bulkheads 226 as a bottom. The launching dock gate 262 is then opened.

Figure 53:
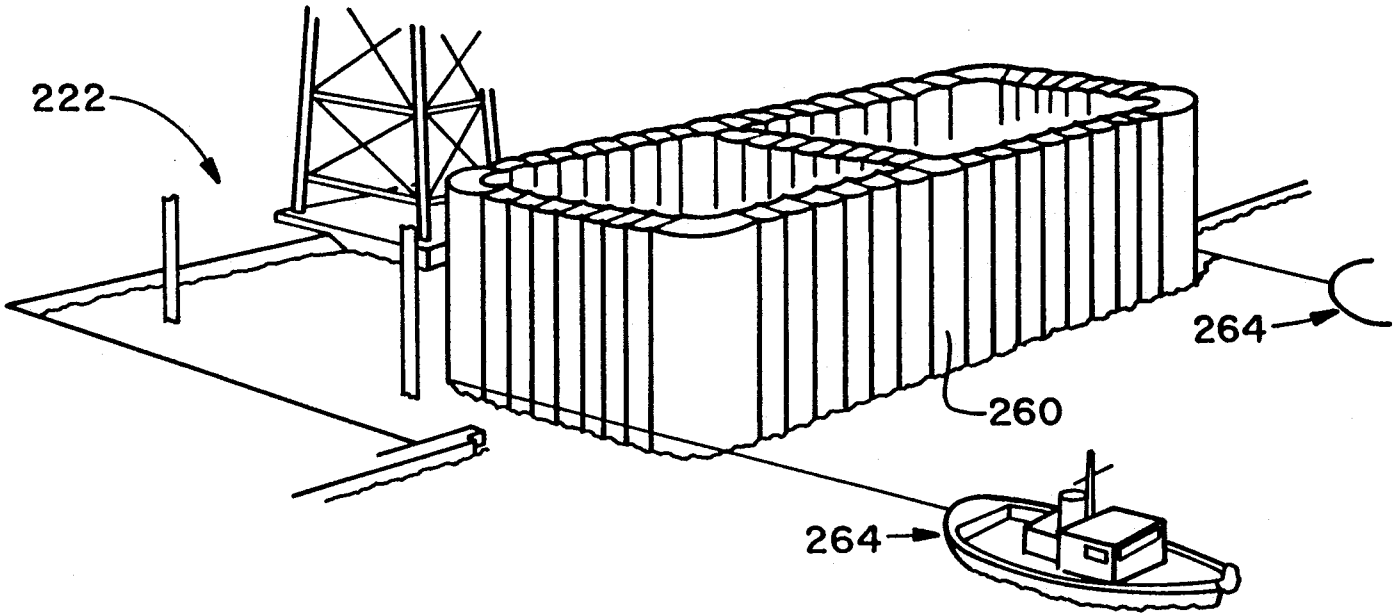
FIG. 53 is a fragmentary perspective view of the module being launched from the module assembly fixture and launching dock.

The module 260 can then be removed from the module assembly fixture and launching dock 222 by means of tugboats 264 or other suitable means (FIG. 53). Alternately, the module 260 will be constructed at ground level, translated to a launching sled upon final welding of longitudinal structure and launched by lowering a launching sled down inclined ways until the module floats off.

Figure 54:
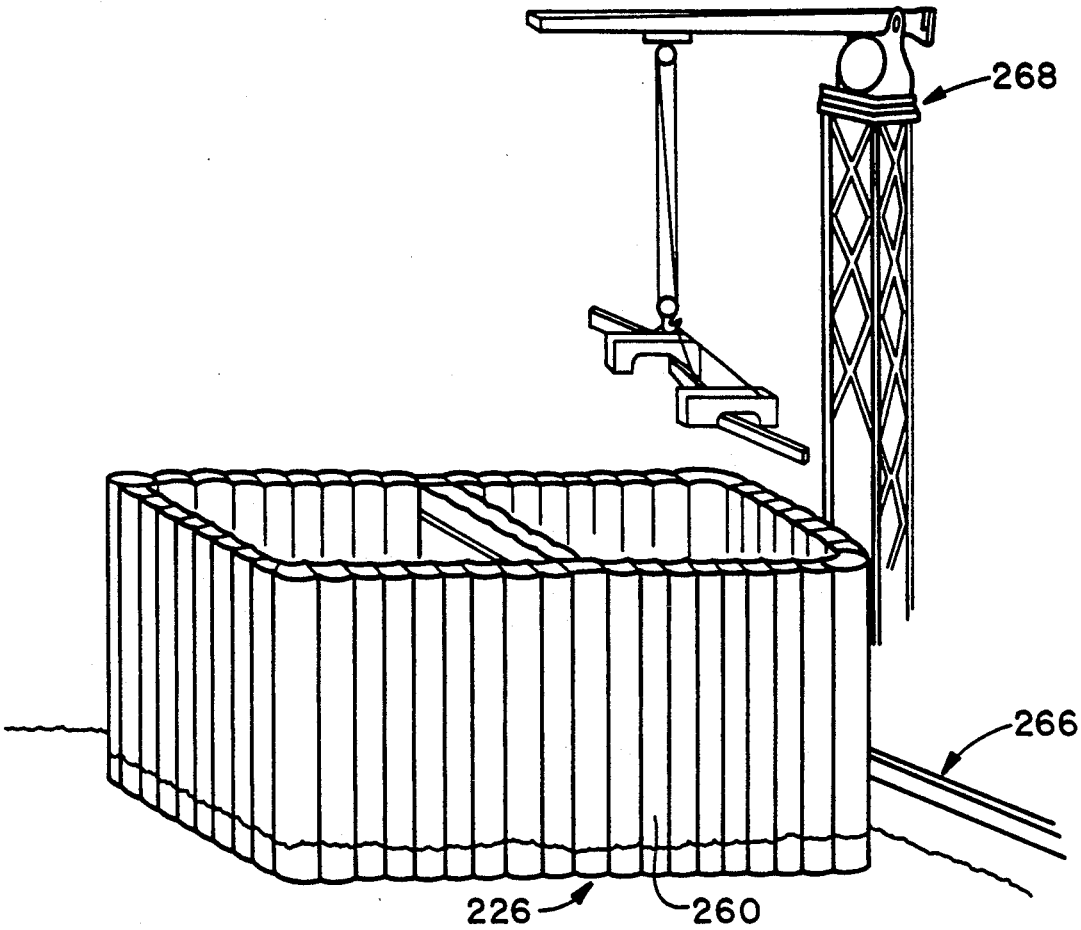
FIG. 54 is a fragmentary pictorial perspective view showing a module alongside a shipyard pier being outfitted with a ladder assembly utilizing a crane on the pier.
Figure 55:
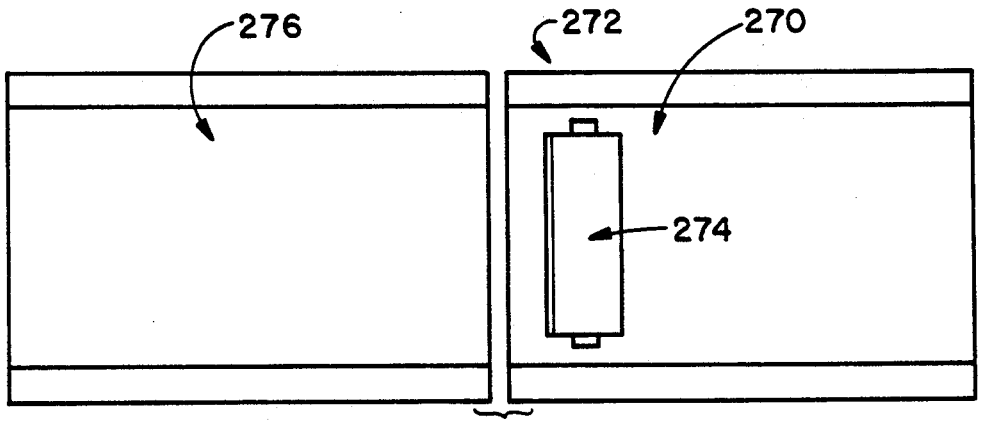
FIG. 55 is a fragmentary plan view of a two-section floating drydock depicting module turning trunions on the outboard section.
Figure 56:
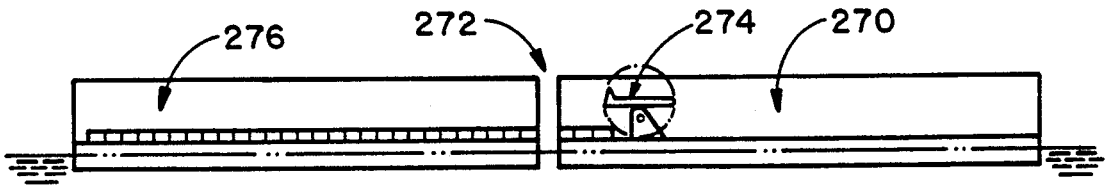
FIG. 56 is a fragmentary elevation cross section of FIG. 55.

Referring to FIG. 54, various internal piping and structural outfitting assemblies (foundations, ladders, etc.) are loaded into the open end of the module 260 floating in water on its bulkhead 226 alongside a shipyard pier 266 using a pier crane 268 and temporarily secured until the module 260 can be subsequently turned to its upright position.

Figure 57:
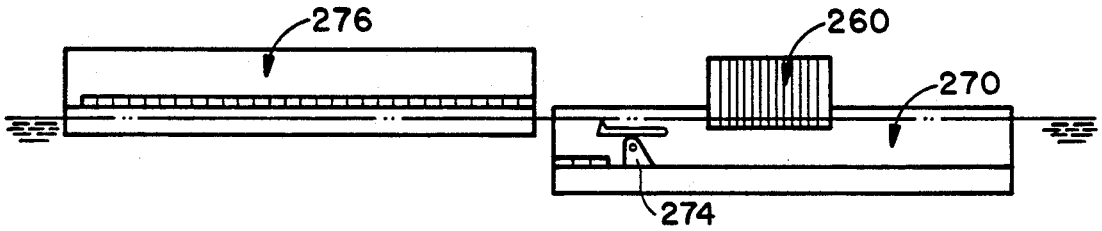
FIG. 57 is a fragmentary elevation view of the structure of FIG. 56 showing the outboard floating drydock section submerged with an afloat module entering the floating drydock section.
Figure 58:
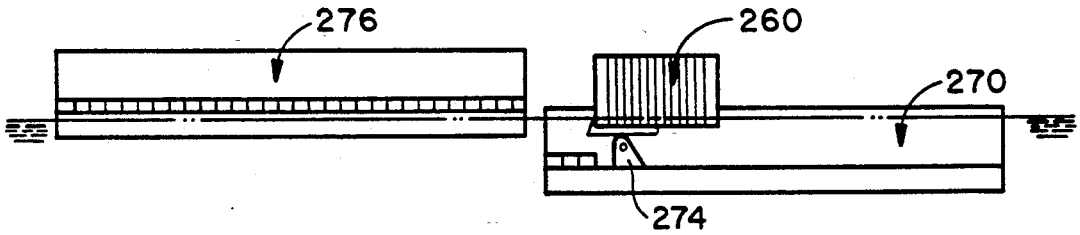
FIG. 58 is a fragmentary elevation view of the structure of FIG. 57 showing the afloat module centered over the module-turning trunions of the outboard drydock section.

Referring to FIGS. 55 through 62, the module 260 is translated from its position floating in water on its bulkhead 226, to its upright position high and dry on the outboard section 270 of a two-section floating drydock 272. This is accomplished by installing a module-turning trunion 274 on the floating drydock outboard section 270 and sinking the floating drydock outboard section 270 by pumping river water into its ballast tanks sufficiently to permit the floating module 260 to be floated to a location over the module-turning trunion 274 (FIGS. 57 and 58).

Figure 59:
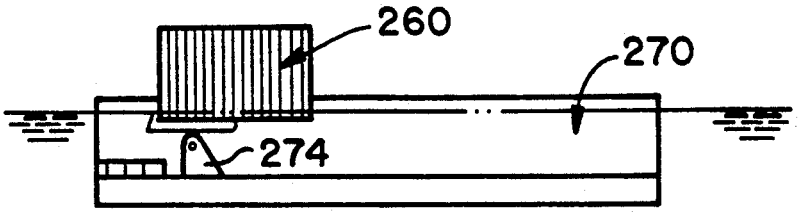
FIGS. 59 through 62 are fragmentary elevation views which schematically show successive steps in drydocking the floating module on the module turning trunions of the floating drydock depicting the module turning to an upright position, as the weight of ballast water in the bottom ballast tanks of the module overcomes the progressively decreasing upward buoyancy of the water supporting the weight of the module.
Figure 60:
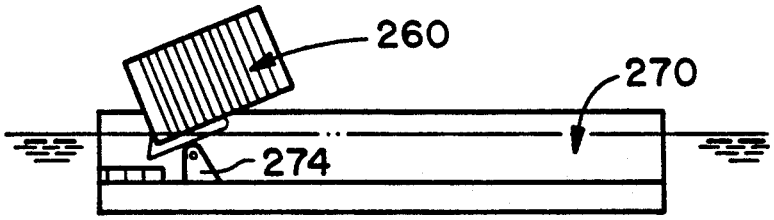
Figure 61:
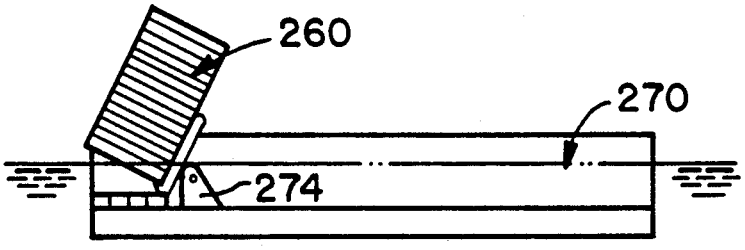

The double-bottom tanks of the module are then filled with approximately one-thousand tons of salt water to make the product of the weight and moment arm of the bottom of the module (to the left of the trunion in FIG. 59) greater than the product of the weight and moment arm of the top of the module (to the right of the trunion in FIG. 59).

Figure 62:
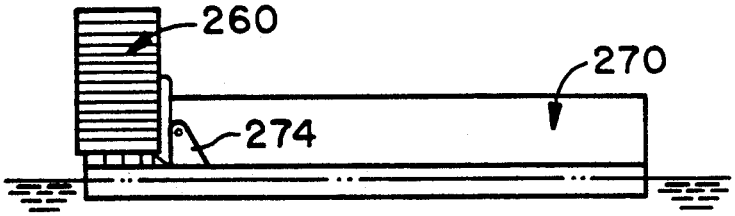

Referring to FIGS. 59 through 62, the river water in the ballast tanks of the outboard section of the floating drydock 270 is pumped out progressively, causing the floating drydock section with its module 260 load to rise out of the water concurrently, causing the module 260 to progressively turn on the axis of the module-turning trunion 274 as the water buoyancy supporting the module 260 is progressively eliminated. With all water buoyancy supporting the module 260 eliminated as the drydock section rises completely out of the water, the module 260 turns into its full upright position (FIG. 62).

Figure 63:
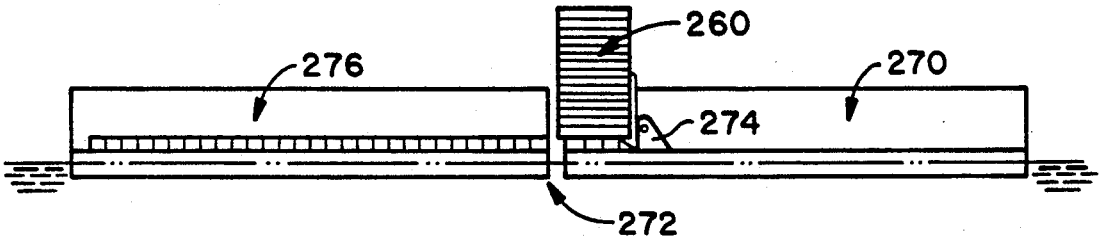
FIGS. 63 and 64 are fragmentary elevation views of the module being rolled on tracks from the outboard floating drydock section to the inboard floating drydock section.
Figure 64:
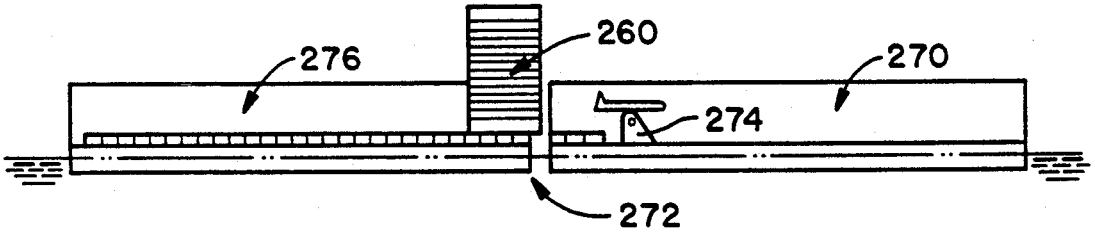

Referring to FIGS. 63 and 64, the module is then pulled from its inboard position on the outboard floating drydock section 270 to the outboard position on the inboard floating drydock section 276, utilizing a winch for pulling the module 260, and rollers on tracks for supporting the weight of the module 260.

Figure 65:
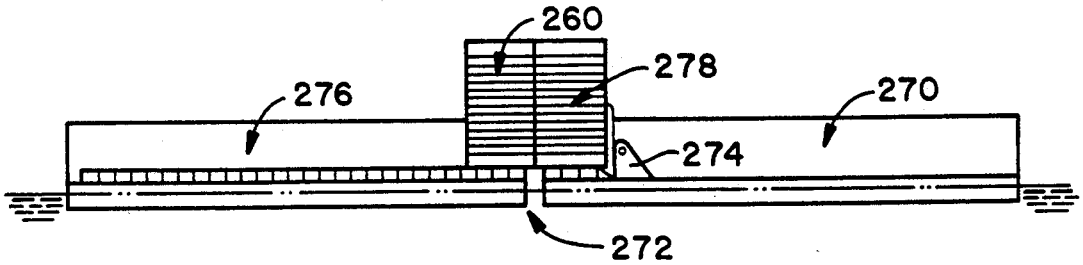
FIG. 65 is a fragmentary view of a second module which has been turned to an upright position using the method shown in FIGS. 59 through 62 being further joined to the first module in the position of FIG. 64.

Referring to FIG. 65, a second module 278 is turned to an upright position using the same procedure as that utilized for turning the first module to an upright position. The second module 278, resting on the inboard end of the outboard section of the floating drydock 272, is joined by welding to the first module 260 resting on the outboard end of the inboard section of the floating drydock.

Figure 66:
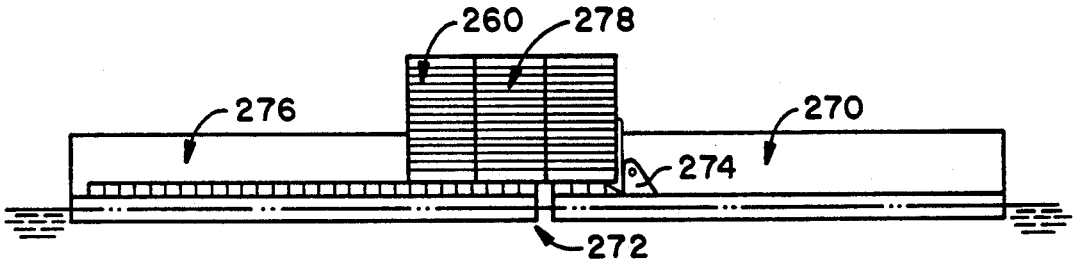
FIGS. 66 through 71 are fragmentary elevation views which schematically show successive steps of joining modules three through eight to form one-half of a double-hull tanker midbody.
Figure 67:
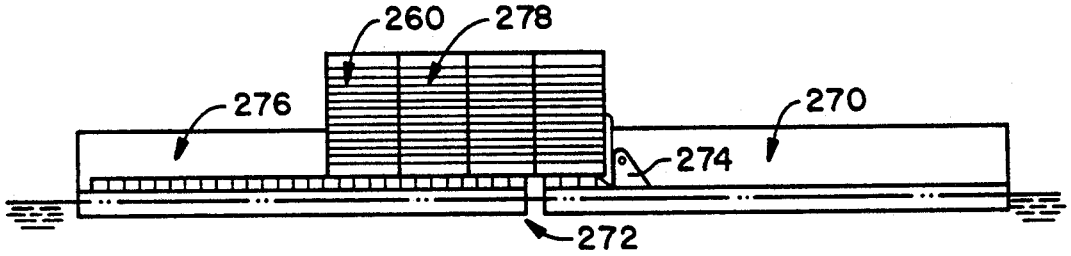
Figure 68:
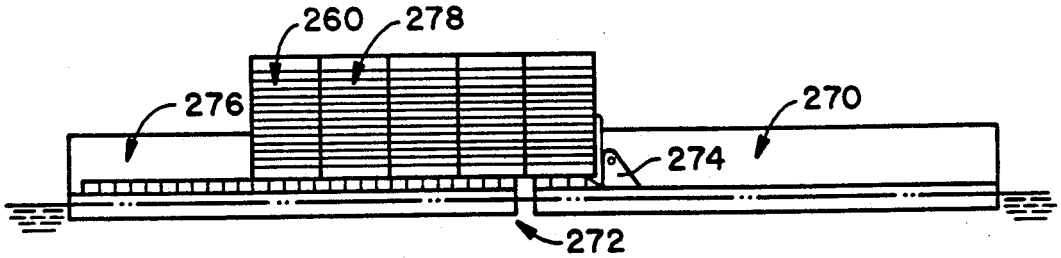
Figure 69:
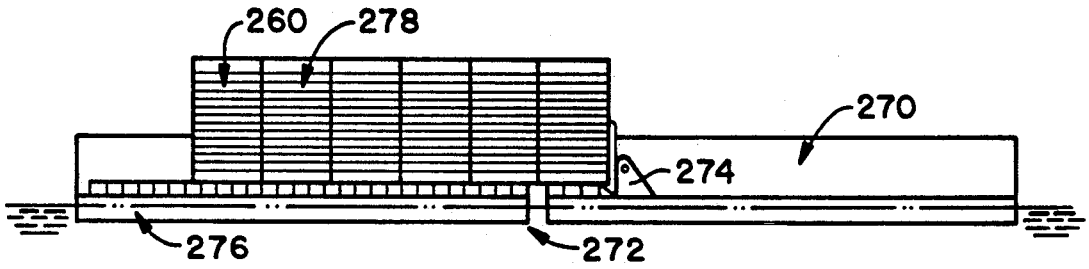
Figure 70:
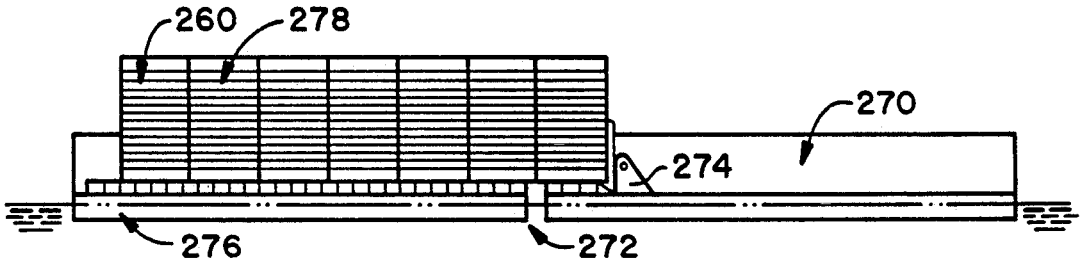
Figure 71:
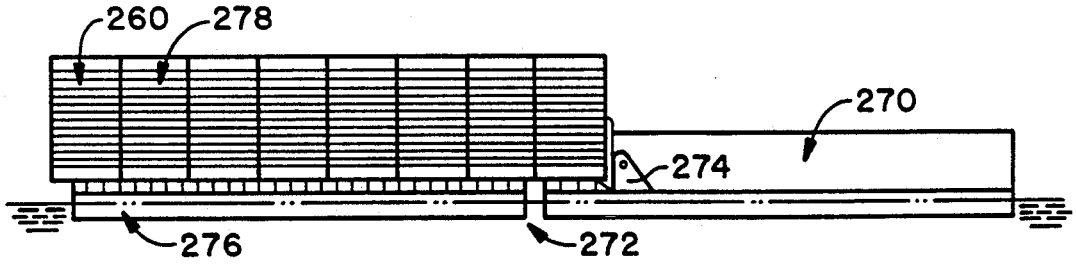
Figure 72:
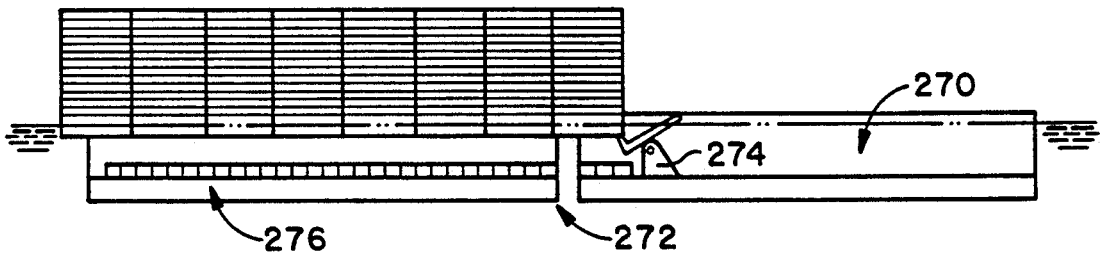
FIG. 72 is a fragmentary elevation view showing the launching of both sections of the floating drydock, of one-half of the double-hull tanker midbody.

Referring to FIG. 66, combined first and second modules are pulled approximately 50 feet using the same procedure as used in pulling the first module alone. Repeating the procedures depicted in FIGS. 65 and 66, another six modules are joined by welding to the first two modules (FIGS. 66 through 71) joining a total of eight modules (and, thereby, forming one-half of a double-hull tanker midbody), and launched off both sections of the floating drydock as depicted in FIG. 72. A second half of a double-hull tanker midbody is manufactured and launched using the same procedure.

Figure 73:
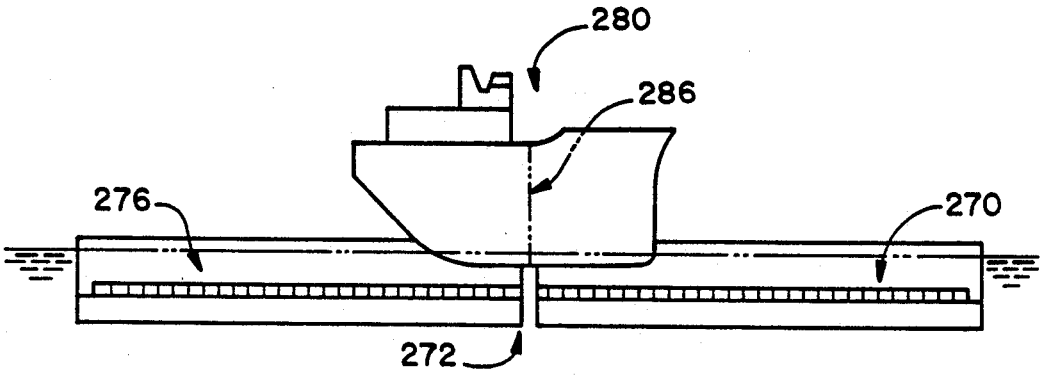
FIGS. 73 through 76 are fragmentary elevation views which schematically show successive steps of drydocking of a tanker bow/stern combination on a two-section floating drydock, cutting of the joint between the bow and stern and undocking of the tanker bow.
Figure 74:
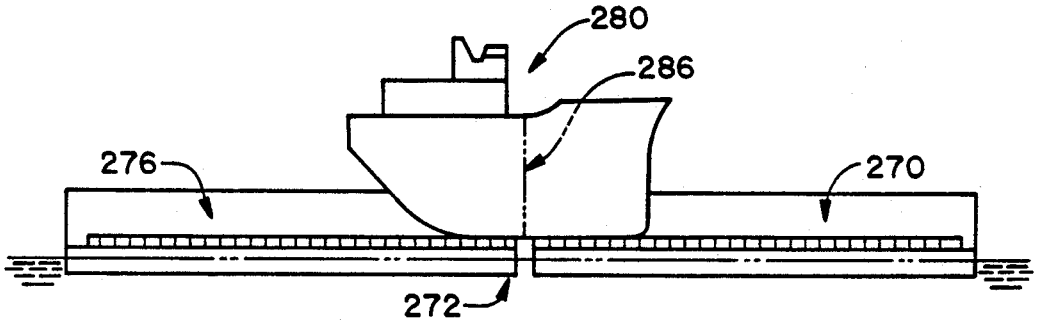
Figure 75:
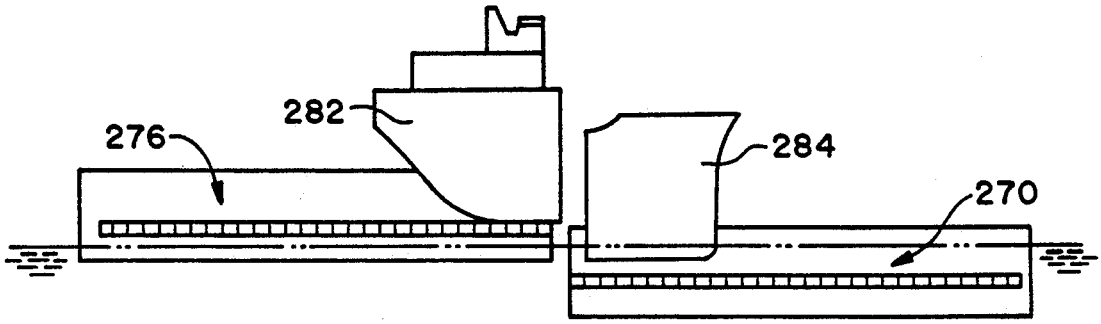
Figure 76:
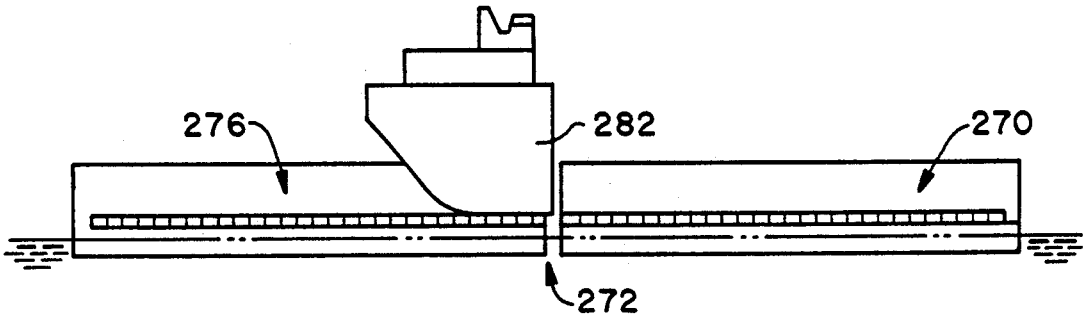
Figure 77:
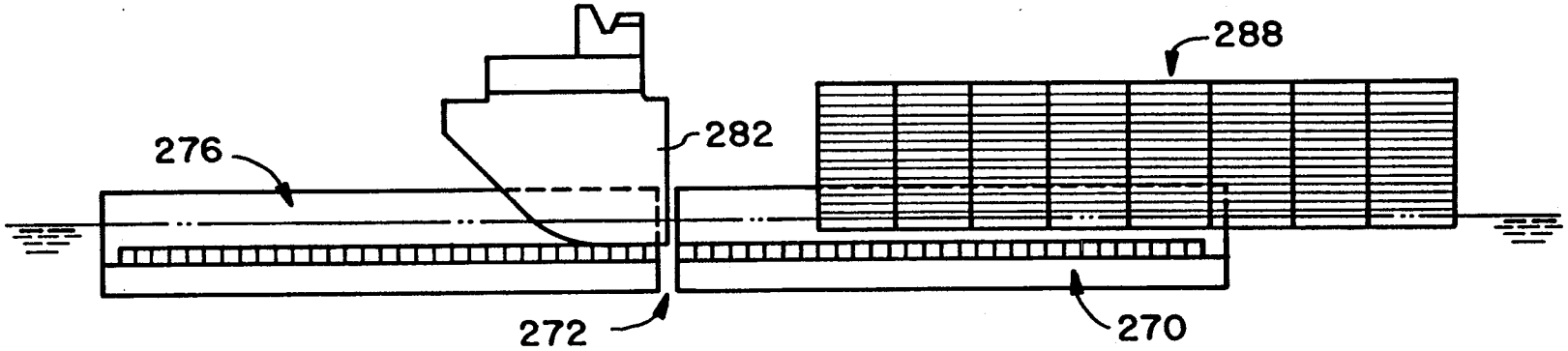
FIGS. 77 through 80 are fragmentary elevation views which schematically show successive steps of drydocking of one-half of a double-hull tanker midbody on the drydock section vacated by the tanker bow, joining of the tanker stern with that one-half of a double-hull tanker midbody to make a double-hull tanker afterbody, and undocking that double-hull tanker afterbody.
Figure 78:
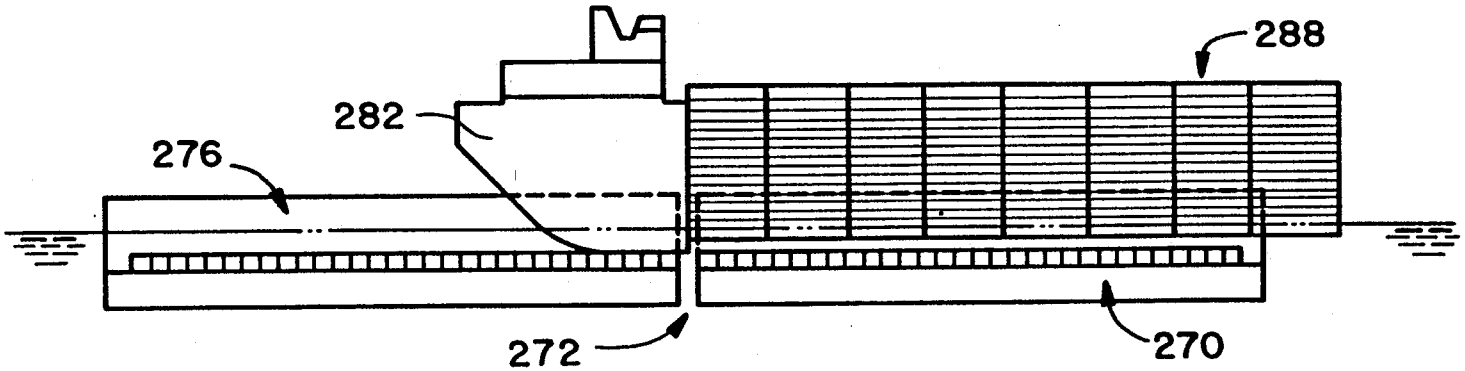
Figure 79:
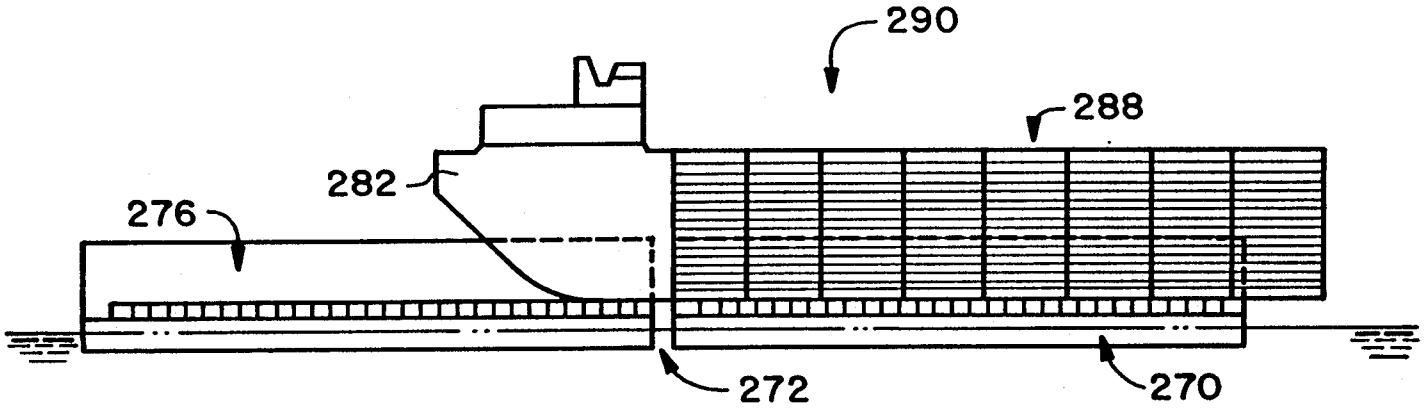
Figure 80:
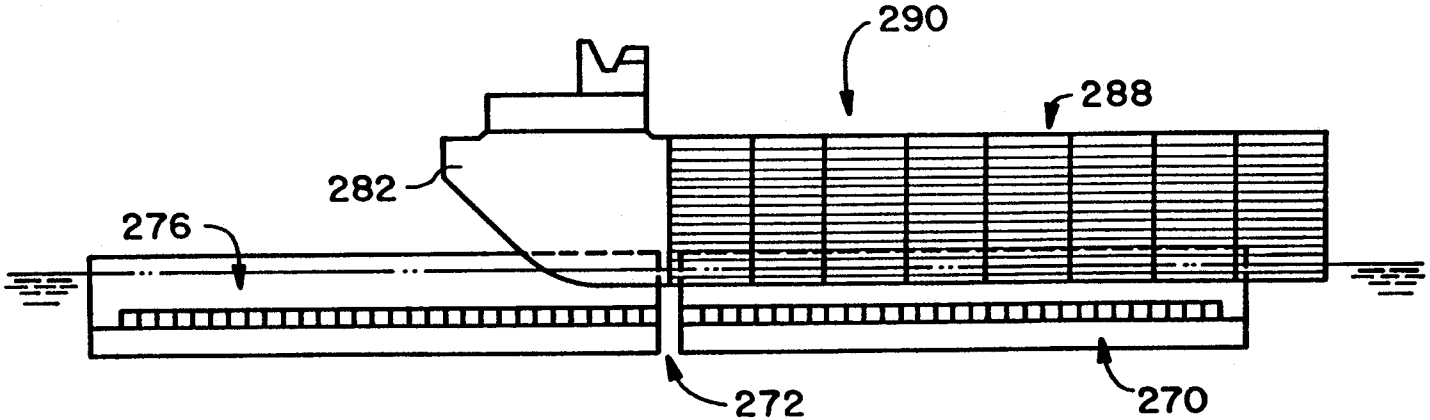
Figure 81:
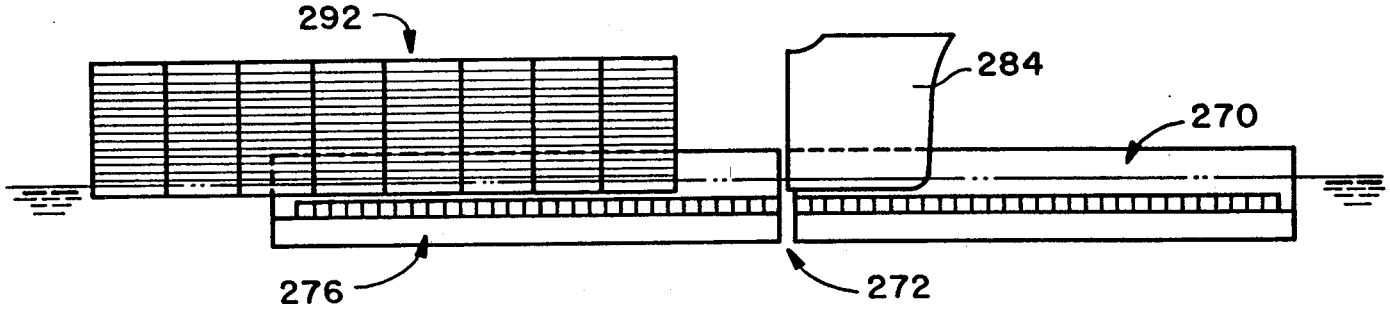
FIGS. 81 through 84 are fragmentary elevation views which schematically show successive steps of drydocking the tanker bow and the other half of the double-hull tanker midbody using both sections of the floating drydock, joining them to each other to make a double-hull tanker forebody, and undocking that double hull tanker forebody.
Figure 82:
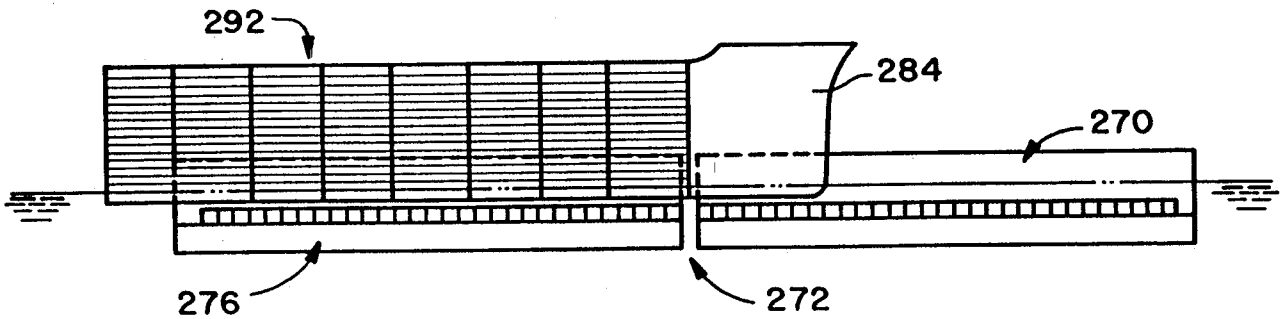
Figure 83:
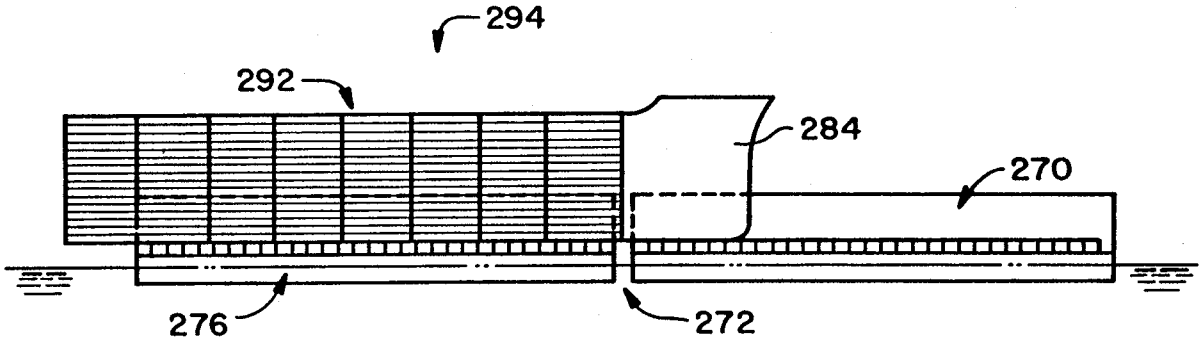
Figure 84:
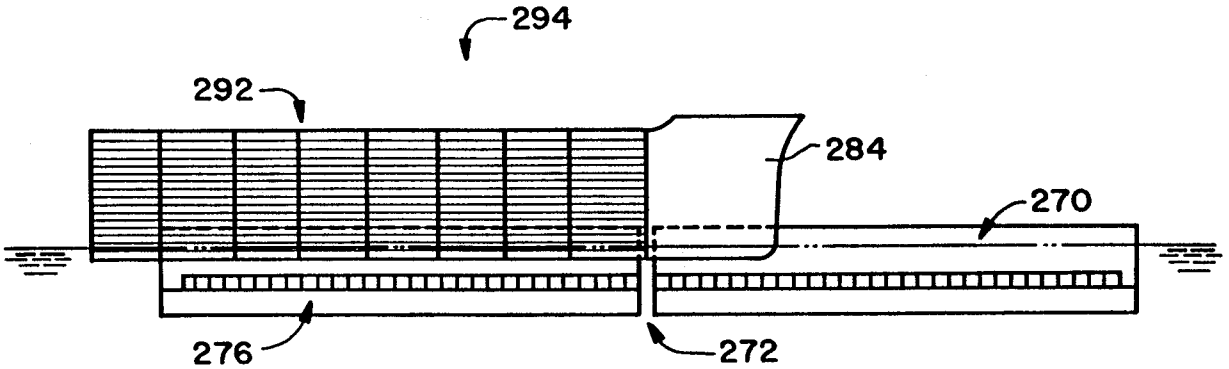
Figure 85:
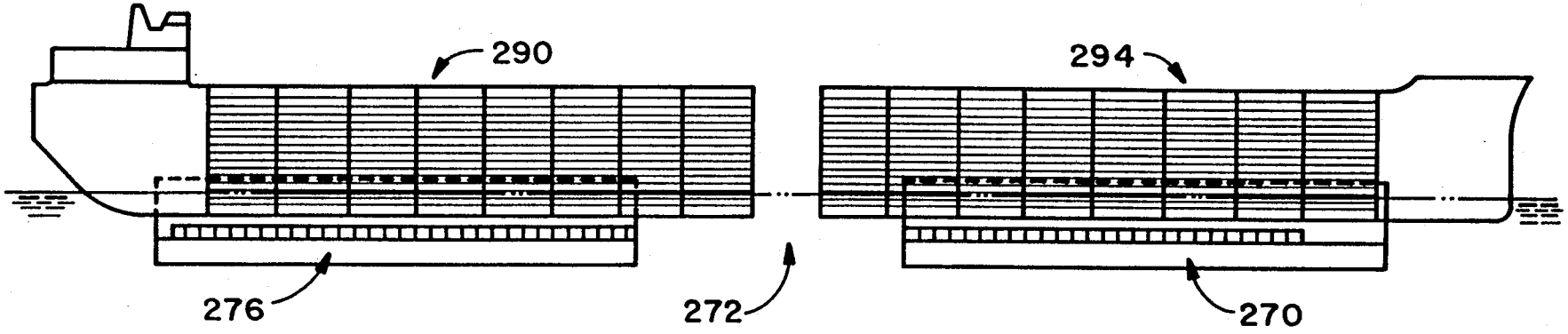
FIGS. 85 through 88 are fragmentary elevation views which schematically show successive steps of drydocking the double-hull tanker afterbody and the double-hull tanker forebody on individual sections of the two-section floating drydock, joining the afterbody and forebody to make a complete double-hull tanker, and undocking the completed double hull tanker.
Figure 86:
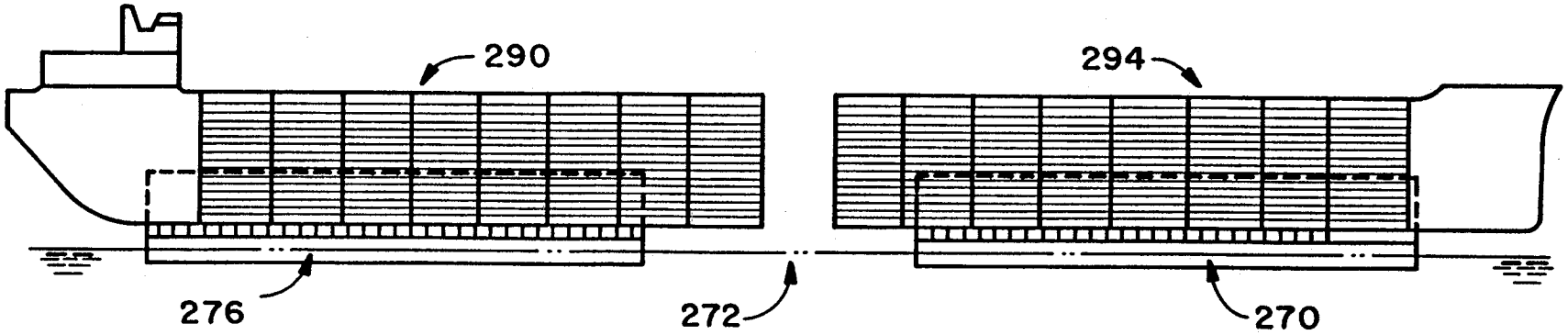
Figure 87:
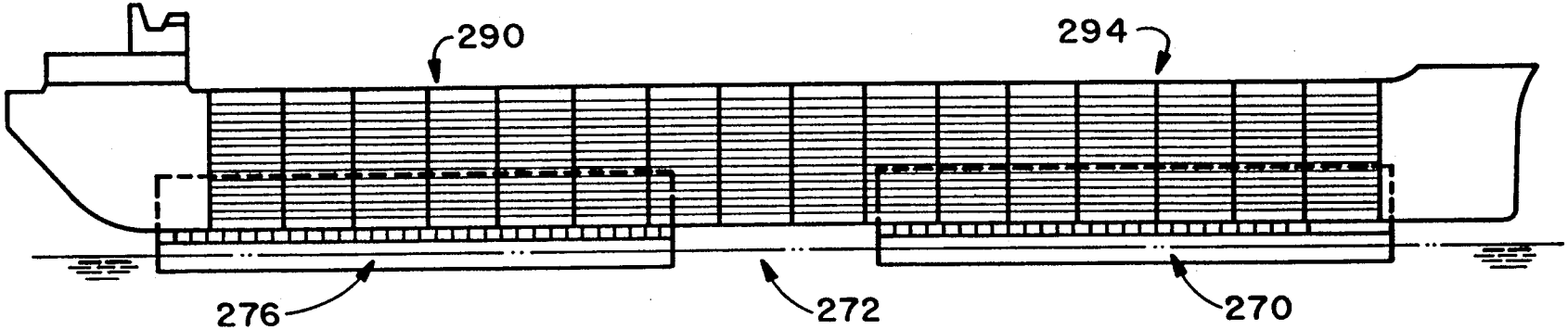
Figure 88:
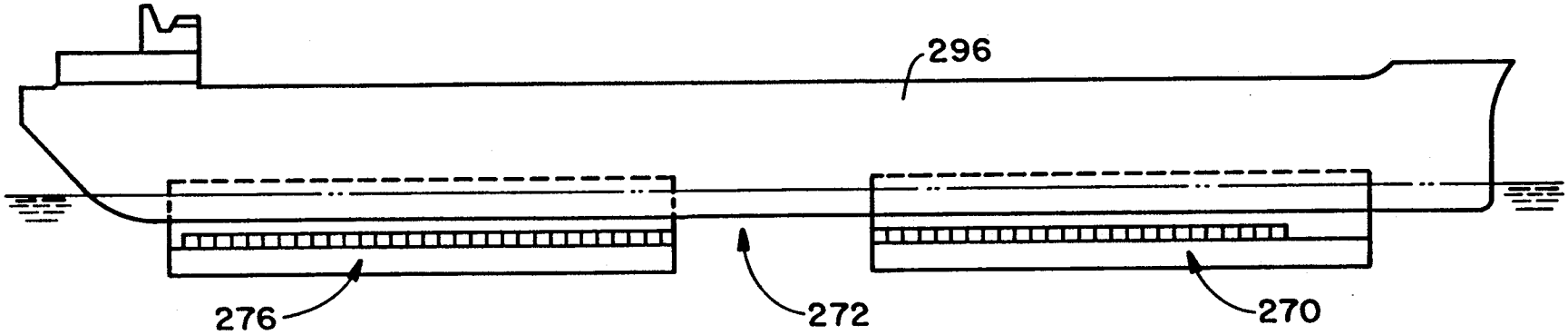

Referring to FIG. 73, a tanker bow/stern vessel 280 (i.e., a vessel which is minus a midbody, but otherwise complete and functional including all machinery and accommodations) is acquired from a traditional shipyard and drydocked such that its stern 282 is completely on the inboard section of the two-section floating drydock 276, its bow 284 is completely on the outboard section of the two-section floating drydock 270 and the joint 286, joining the bow 284 and stern 282, is precisely over the joint, joining the two sections of the floating drydock 272.

Referring to FIGS. 74 through 80, the joint 286 between the bow 284 and stern 282 is cut using oxygen-acetylene burning torches. Then, the bow 284 is undocked by submerging the outboard section of the floating drydock 270 and one-half of the double-hull tanker midbody 288 is drydocked in place of the tanker bow 284 and joined to the tanker stern 282 by welding, thereby forming a double-hull tanker afterbody 290. This tanker afterbody 290 is then launched into the river by submerging both sections of the floating drydock.

Referring to FIGS. 81 through 84, the tanker bow 284 and the other half of the double-hull tanker midbody 292 are drydocked using both floating drydock sections 272 and joined by welding, forming a double-hull tanker forebody 294. This tanker forebody 294 is then launched into the river by submerging both sections of the floating drydock 272.

Referring to FIGS. 85 through 88, the tanker forebody 294 is drydocked on one section of the floating drydock 270 and the tanker afterbody 290 on the other section of the floating drydock 276. The tanker forebody 294 is then pulled together with the tanker afterbody 290 and joined together by welding, thereby forming a complete double-hull tanker 296. This complete double-hull tanker is then launched by submerging both sections of the floating drydock 272.

It should now be apparent that the vessel hull construction and method as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A method for erecting from an upended to an upright orientation a vessel hull module for a double-walled tanker midbody, which module includes inner and outer hulls interconnected by longitudinal plates so as to define double-hull left, right and bottom walls each comprising a respective series of longitudinal cells, and a deck, bridging between said left and right walls, and transverse bulkhead means closing corresponding one ends of said cells and a corresponding one end of the space defined peripherally inwardly of said left, right and bottom walls and said deck, the opposite ends of said space being open, said method comprising:

(a) providing a floating drydock section which is capable of being elevated and depressed in a body of water by pumping out and flooding ballast tanks thereof;

(b) providing on said floating drydock a trunnion assembly including a support and trunnions journalling the support for pivotal movement about a substantially horizontal axis between a substantially horizontal first position, and a substantially vertical second position;

(c) disposing said floating drydock in a body of water in a floating condition and disposing in the same body of water, adjacent said drydock, said module in an upended condition, floating with its closed end down;

(d) depressing said drydock by flooding ballast tanks thereof and floating said upended module onto said support, with said support in said first, generally horizontal position, so that said upended module is supported on said support with said bottom wall and said deck of said upended module disposed on opposite sides of an imaginary vertical plane containing said axis of said trunnion assembly;

(e) filling a heavier-than-air fluid medium into at least some of said cells of said bottom wall and pumping water out of the ballast tanks of said drydock section, so as to gradually elevate said drydock section and thereby cause said upended module on said support to rotate about said axis, with said support, until said support has said second, generally horizontal second position and said module is upright and rests on a support surface which is located adjacent to said support of said trunnion assembly.

2. The method of claim 1, wherein:

said heavier-than-air fluid medium is water.

3. The method of claim 1, wherein:

said body of water is a body of fresh water and said heavier-than-air fluid medium is seawater.

4. The method of claim 1, wherein:

said support surface is located on said floating drydock section.

5. The method of claim 1, wherein:

step (c) includes assembling said module on said floating drydock section from a plurality of hull and deck subassemblies and transverse bulkhead elements, while said floating drydock section is elevated in said body of water.

6. The method of claim 5, further including: as part of step (c), depressing said elevated floating drydock and floating off thereof said upended module into said body of water; and installing additional structural elements in said upended module while said upended module is floating in said body of water.

7. The method of claim 6, wherein:

while said upended module is floating in said body of water, likewise successively assembling a plurality of like modules on said floating drydock and floating each off into said body of water as a respective upended module.

8. A method for fabricating a major component of a double-hulled tanker, comprising:

erecting from an upended to an upright orientation a vessel hull module for a double-walled tanker midbody, which module includes inner and outer hulls interconnected by longitudinal plates so as to define double-hull left, right and bottom walls each comprising a respective series of longitudinal cells, and a deck, bridging between said left and right walls, and transverse bulkhead means closing corresponding one ends of said cells and a corresponding one end of the space defined peripherally inwardly of said left, right and bottom walls and said deck, the opposite ends of said space being open, by:

(a) providing a floating drydock section which is capable of being elevated and depressed in a body of water by pumping out and flooding ballast tanks thereof;

(b) providing on said floating drydock a trunnion assembly including a support and trunnions journalling the support for pivotal movement about a substantially horizontal axis between a substantially horizontal first position, and a substantially vertical second position;

(c) disposing said floating drydock in a body of water in a floating condition and disposing in the same body of water, adjacent said drydock, said module in an upended condition, floating with its closed end down;

(d) depressing said drydock by flooding ballast tanks thereof and floating said upended module onto said support, with said support in said first, generally horizontal position, so that said upended module is supported on said support with said bottom wall and said deck of said upended module disposed on opposite sides of an imaginary vertical plane containing said axis of said trunnion assembly;

(e) filling a heavier-than-air fluid medium into at least some of said cells of said bottom wall and pumping water out of the ballast tanks of said drydock section, so as to gradually elevate said drydock section and thereby cause said upended module on said support to rotate about said axis, with said support, until said support has said second, generally horizontal second position and said module is upright and rests on a support surface which is located adjacent to said support of said trunnion assembly, step (c) including:

assembling said module on said floating drydock section from a plurality of hull and deck subassemblies and transverse bulkhead elements, while said floating drydock section is elevated in said body of water;

depressing said elevated floating drydock and floating off thereof said upended module into said body of water; and installing additional structural elements in said upended module while said upended module is floating in said body of water;

while said upended module is floating in said body of water, likewise successively assembling a plurality of like modules on said floating drydock and floating each off into said body of water as a respective upended module;

steps (d) and (e) being successively conducted on each of said modules;

(f) shifting along said support each upright module most recently subjected to step (e) along its own longitudinal axis away from said trunnion assembly before each respectively successive conduct of step (e); and (g) serially connecting all of said upright modules to one another end-to-end, thereby providing a tanker longitudinal midbody component.

9. The method of claim 8, further comprising:

(h) providing a second said floating drydock section adjacent the first-described said floating drydock section; and as step (f) is conducted, shifting the respective upright module most recently subjected to step (e) from said support on said first-described floating drydock section, onto said second floating drydock section; step (g) being conducted on said second floating drydock section.

10. The method of claim 9, wherein:

at each instance while conducting step (g) that a respectively more recently assembled said upright module is connected end-to-end to a respectively previously assembled said upright module, the respective more recently assembled said upright module is supported on said first-described floating drydock section and the respective previously assembled said upright module is supported on said second floating drydock section, and the respective module ends to be connected to one another are disposed effectively between said first-described and second floating drydock modules; and, as part of said each instance, said first-described and second floating drydock modules are positionally adjusted relative to one another on said body of water for aligning the respective said module ends to be connected.

11. The method of claim 10, further comprising:

(i) after step (h) has been completed, providing on said support of said first-described floating drydock section one of a tanker bow section and a tanker stern section having an end effectively disposed between said first-described and said second floating drydock sections in juxtaposition with an end of said tanker longitudinal midbody component;

(j) connecting said end of said tanker longitudinal midbody to said end of said one of said tanker bow section and stern section, to thereby provide a respective bow- or stern-ended tanker midbody component; and (k) depressing said first-described and second floating drydock sections and floating said respective bow- or stern-ended tanker midbody component therefrom onto said body of water.

12. A method for fabricating a double-hulled tanker, comprising:

conducting the following series of steps to provide a bow-ended first longitudinal midbody component for said tanker:

erecting from an upended to an upright orientation a vessel hull module for a double-walled tanker midbody, which module includes inner and outer hulls interconnected by longitudinal plates so as to define double-hull left, right and bottom walls each comprising a respective series of longitudinal cells, and a deck, bridging between said left and right walls, and transverse bulkhead means closing corresponding one ends of said cells and a corresponding one end of the space defined peripherally inwardly of said left, right and bottom walls and said deck, the opposite ends of said space being open, by:

(a) providing a floating drydock section which is capable of being elevated and depressed in a body of water by pumping out and flooding ballast tanks thereof;

(b) providing on said floating drydock a trunnion assembly including a support and trunnions journalling the support for pivotal movement about a substantially horizontal axis between a substantially horizontal first position, and a substantially vertical second position;

(c) disposing said floating drydock in a body of water in a floating condition and disposing in the same body of water, adjacent said drydock, said module in an upended condition, floating with its closed end down;

(d) depressing said drydock by flooding ballast tanks thereof and floating said upended module onto said support, with said support in said first, generally horizontal position, so that said upended module is supported on said support with said bottom wall and said deck of said upended module disposed on opposite sides of an imaginary vertical plane containing said axis of said trunnion assembly;

(e) filling a heavier-than-air fluid medium into at least some of said cells of said bottom wall and pumping water out of the ballast tanks of said drydock section, so as to gradually elevate said drydock section and thereby cause said upended module on said support to rotate about said axis, with said support, until said support has said second, generally horizontal second position and said module is upright and rests on a support surface which is located adjacent to said support of said trunnion assembly, step (c) including:

assembling said module on said floating drydock section from a plurality of hull and deck subassemblies and transverse bulkhead elements, while said floating drydock section is elevated in said body of water;

depressing said elevated floating drydock and floating off thereof said upended module into said body of water; and installing additional structural elements in said upended module while said upended module is floating in said body of water;

while said upended module is floating in said body of water, likewise successively assembling a plurality of like modules on said floating drydock and floating each off into said body of water as a respective upended module;

steps (d) and (e) being successively conducted on each of said modules;

(f) shifting along said support each upright module most recently subjected to step (e) along its own longitudinal axis away from said trunnion assembly before each respectively successive conduct of step (e); and (g) serially connecting all of said upright modules to one another end-to-end, thereby providing a tanker longitudinal midbody component;

(h) providing a second said floating drydock section adjacent the first-described said floating drydock section; and as step (f) is conducted, shifting the respective upright module most recently subjected to step (e) from said support on said first-described floating drydock section, onto said second floating drydock section; step (g) being conducted on said second floating drydock section;

at each instance while conducting step (g) that a respectively more recently assembled said upright module is connected end-to-end to a respectively previously assembled said upright module, the respective more recently assembled said upright module is supported on said first-described floating drydock section and the respective previously assembled said upright module is supported on said second floating drydock section, and the respective module ends to be connected to one another are disposed effectively between said first-described and second floating drydock modules; and, as part of said each instance, said first-described and second floating drydock modules are positionally adjusted relative to one another on said body of water for aligning the respective said module ends to be connected;

(i) after step (h) has been completed, providing on said support of said first-described floating drydock section a tanker bow section having an end effectively disposed between said first-described and said second floating drydock sections in juxtaposition with an end of said tanker longitudinal midbody component;

(j) connecting said end of said tanker longitudinal midbody to said end of said tanker bow section, to thereby provide a bow-ended tanker midbody component; and (k) depressing said first-described and second floating drydock sections and floating said bow-ended tanker midbody component therefrom onto said body of water;

(l) repeating the series of steps (a)–(h) to provide a second tanker longitudinal midbody component;

(m) after step (l) has been completed, providing on said support of said first-described floating drydock section a tanker stern section having an end effectively disposed between said first-described and said second floating drydock sections in juxtaposition with an end of said second tanker longitudinal midbody component;

(n) connecting said end of said second tanker longitudinal midbody to said end of said tanker stern section, to thereby provide a respective stern-ended tanker midbody component;

(o) depressing said first-described and second floating drydock sections and floating said stern-ended tanker midbody component therefrom onto said body of water;

(p) maneuvering said bow-ended and stern-ended tanker midbody components and said first-described and second floating drydock sections so that one of said components is supported by said first-described floating drydock section and the other of said components is supported by said second floating drydock sections, with respective free ends of each juxtaposed effectively between said first-described and second floating drydock sections and said components in longitudinal alignment;

(q) joining said free ends together to provide a double-hulled tanker; and (r) depressing said first-described and second floating drydock sections and floating said double-hulled tanker therefrom onto said body of water.

13. The method of claim 12, further including:

(s) prior to conducting steps (i) and (m), acquiring a combined bow section end-connected to stern section, longitudinal midbodiless vessel and providing said vessel on said body of water adjacent said first-described and second floating drydock sections;

(t) depressing said first-described and second floating drydock sections, floating said vessel thereover and elevating said first-described and second floating drydock sections so that a joint between said bow and stern sections is effectively located between said first-described and second floating drydock sections, and said vessel is cooperatively supported by said first-described and second floating drydock sections; and (u) disconnecting said bow and stern sections from one another at said joint.

14. The method of claim 13, further comprising:

(v) subsequent to conducting step (u) and prior to conducting steps (i) and (m), depressing said first-described and said second floating drydock sections, and floating said bow and stern sections respectively therefrom onto said body of water.

15. A bow-ended tanker midbody component produced by the process of claim 11.

16. A stern-ended tanker midbody component produced by the process of claim 11.

17. An upright vessel hull module produced by the process of claim 1.

18. A tanker longitudinal midbody component produced by the process of claim 8.

19. A double-hulled tanker produced by the process of claim 12.

* * * * *